US006115565A

United States Patent [19]

Noda

[11] Patent Number: 6,115,565

[45] **Date of Patent: *Sep. 5, 2000**

[54] SEALING MEMBER, CLEANING APPARATUS, PROCESS CARTRIDGE AND ELECTROPHOTOGRAPHIC IMAGE FORMING APPARATUS

[75] Inventor: Shinya Noda, Toride, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/069,289

[22] Filed: Apr. 29, 1998

[30] Foreign Application Priority Data

Nov. 7, 1997 [JP] Japan ..... 9-322234

[51] Int. Cl.[7] ..... G03G 21/00; G03G 15/08

[52] U.S. Cl. ..... 399/102; 399/111; 399/343

[58] Field of Search ..... 399/102, 106, 399/103, 105, 98, 99, 111, 123, 343, 104, 350

[56] References Cited

U.S. PATENT DOCUMENTS

| | | | |
|---|---|---|---|
| 4,400,082 | 8/1983 | Kiba | 399/102 |
| 5,029,316 | 7/1991 | Koiso | 399/102 |
| 5,223,893 | 6/1993 | Ikemoto et al. | 399/111 |
| 5,502,547 | 3/1996 | Shirai | 399/102 |
| 5,740,500 | 4/1998 | Hashimoto | 399/111 X |
| 5,774,765 | 6/1998 | Hirota et al. | 399/102 |

FOREIGN PATENT DOCUMENTS

| | | |
|---|---|---|
| 1-177065 | 7/1989 | Japan . |
| 5-066706 | 3/1993 | Japan . |

*Primary Examiner*—Sophia S. Chen
*Attorney, Agent, or Firm*—Fitzpatrick, Cella, Harper & Scinto

[57] ABSTRACT

A sealing member for a cleaning container for containing a developer removed from an electrophotographic photosensitive drum by a cleaning member contacting the photosensitive drum, includes a developer leakage preventing portion for preventing leakage of the developer from the cleaning container, leakage preventing portion being in contact with one longitudinal end portion of the cleaning member; a developer removing portion for removing the developer from the photosensitive drum, wherein the developer removing portion contacts the photosensitive drum at a position across the photosensitive drum from a spacer for providing a predetermined gap between the photosensitive drum and a developing roller for supplying a developer to the photosensitive drum.

16 Claims, 30 Drawing Sheets

SEALING MEMBER, CLEANING APPARATUS, PROCESS CARTRIDGE AND ELECTROPHOTOGRAPHIC IMAGE FORMING APPARATUS

FIELD OF THE INVENTION AND RELATED ART

The present invention relates to a sealing member installed in a cleaning means container for storing the developer removed from an electrophotographic photosensitive drum, a cleaning apparatus for removing developer from an electrophotographic photosensitive member, a process cartridge removably installable in the main assembly of an electrophotographic image forming apparatus, and an electrophotographic image forming apparatus in which a process cartridge is removably installable, and which is used for forming images on recording medium.

In this specification, the term "electrophotographic image forming means" means an apparatus which forms images on recording medium with the use of an electrophotographic image forming system. For example, it includes an electrophotographic copying machine, an electrophotographic printer (laser beam printer, LED printer, and the like), a facsimile machine, a word processor, and the like.

The term "process cartridge" means a cartridge which integrally comprises a developing means for developing a latent image formed on an electrophotographic photosensitive member, a cleaning means for cleaning the developer remaining on an electophotogaphic photosenitive member, and an electrophotographic photosensitive member, and which is removably installable in the main assembly of an image forming apparatus. A process cartridge may integrally comprise, in addition to a developing means, a cleaning means, and an electrophotographic photosensitive member, a charging means for charging the electrophotographic photosensitive member.

In an electrophotographic image forming apparatus, such as an electrophotographic copying machine or an electrophotographic printer which employs an electrophotographic image recording system, images are formed in the following manner. First, the electrophotographic photosensitive member is charged, and then, an electrostatic latent image is formed on the electrophotographic photosensitive member by exposing the charged electrophotographic photosensitive member in accordance with image formation data. Then, the latent image is developed into a visible image (toner image) by a developing means; and developer is adhered to the electrostatic latent image by the developing means. Thereafter, the toner image is transferred onto a recording medium to obtain a final image.

Also in the case of such an apparatus as described above, a process cartridge, which is removably installable in the main assembly of an image forming apparatus, and integrally comprises an electrophotographic photosensitive drum, a charging means, a developing means, a cleaning means, and the like, has been put to practical use to simplify the maintenance for an image forming apparatus.

In the case of such a process cartridge, in order to assure that the latent image formed on the electrophotographic photosensitive drum is properly developed with developer, the toner particles which remain on the electrophotographic photosensitive drum after the transfer of the latent image onto recording medium, and/or the toner particles which go astray from the toner image and adhere to the electrophotographic photosensitive drum after the image transfer, are removed by the cleaning member of the cleaning means. In order to prevent the toner particles removed by the cleaning member from leaking out of a cleaning means container, the cleaning means container is provided with a sealing member. Further, the cleaning means container is provided with a wiping member which cleans the portion of the electrophotographic photosensitive drum which is outside the cleaning range of the cleaning member. In other words, the cleaning means container is provided with the sealing member and the wiping member, which are independent from each other; the toner particles removed by the cleaning member are prevented from leaking out by the sealing member, and the portions of the electrophotographic photosensitive drum which are outside the cleaning range of the cleaning member, are cleaned by the wiping member.

SUMMARY OF THE INVENTION

The present invention is a result of the further development of the aforementioned conventional technologies.

An object of the present invention is to provide a sealing member, a cleaning apparatus, and a process cartridge, which are capable of reliably preventing developer from leaking, as well as removing the developer which is adhering to an electrophotographic photosensitive drum, and also to provide an image forming apparatus in which such a process cartridge is removably installable.

Another object of the present invention is to provide a single-piece sealing member, a cleaning apparatus, and a process cartridge, which are capable of preventing the developer removed from an electrophotographic photosensitive drum from leaking out, and also are capable of removing the developer which is adhering to the portions of the electrophotographic photosensitive member which are outside the cleaning range of the cleaning member, and also to provide an image forming apparatus in which such a process cartridge is removably installable.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

[Descriptions of Embodiments of Present Invention]

Hereinafter, the embodiments of the present invention will be described in detail with reference to the drawings.

The following are the preferable embodiments of the present invention. In the following descriptions, the term "short direction of a process cartridge B" means the direction in which the process cartridge B is installed into, or removed from, the main assembly 14 (hereinafter, "image forming apparatus main assembly," or simply "apparatus main assembly") of an electrophotographic image forming apparatus. It coincides with the direction in which recording medium is conveyed. The term "longitudinal direction of the process cartridge B" means the direction perpendicular (substantially perpendicular) to the direction in which the process cartridge B is installed into, or removed from, the apparatus main assembly 14. It is parallel to the surface of the recording medium, and is perpendicular (substantially perpendicular) to the direction in which the recording medium is conveyed. The "left or right" of the process cartridge B means the left or right of the process cartridge as the process cartridge is seen from above, and from the direction from which the recording medium is conveyed.

Figure 1:
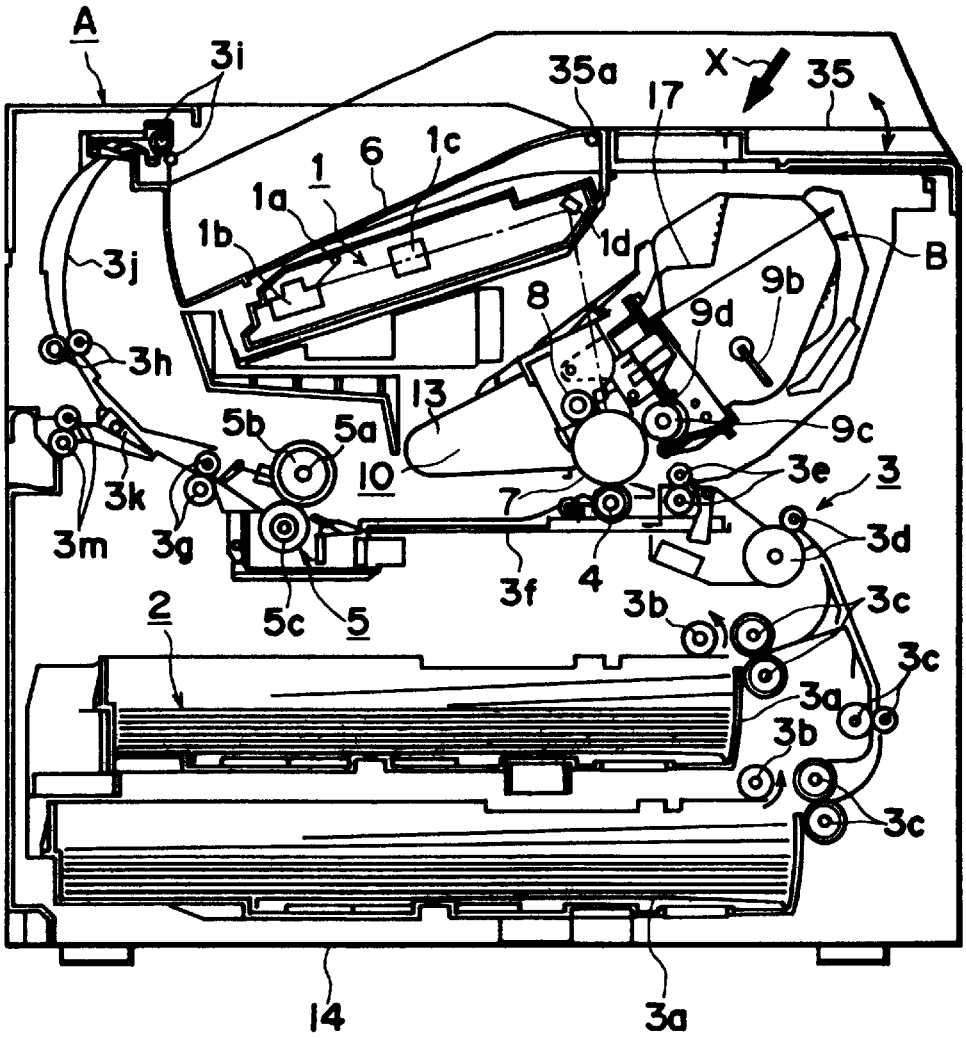
FIG. 1 is a vertical section of a typical is electrophotographic image forming apparatus.
Figure 2:
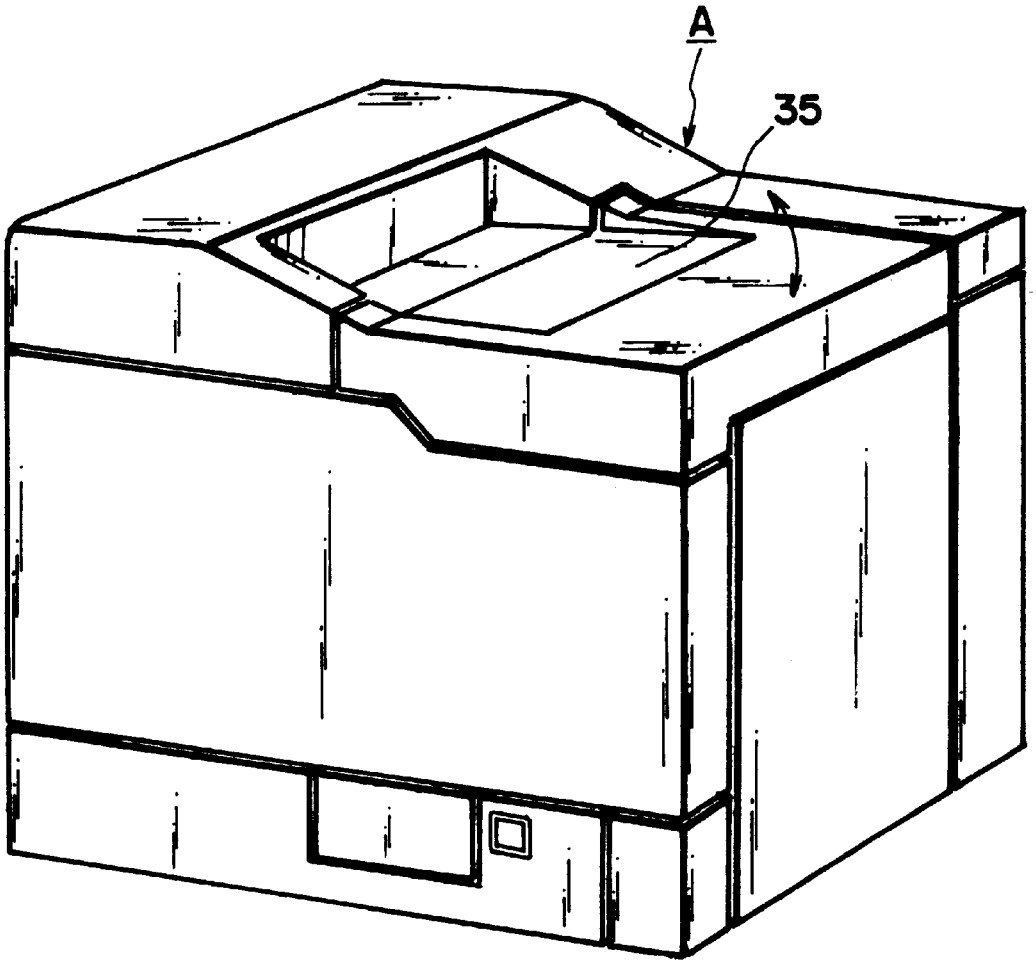
FIG. 2 is an external perspective view of the electrophotographic image forming apparatus illustrated in FIG. 1.
Figure 3:
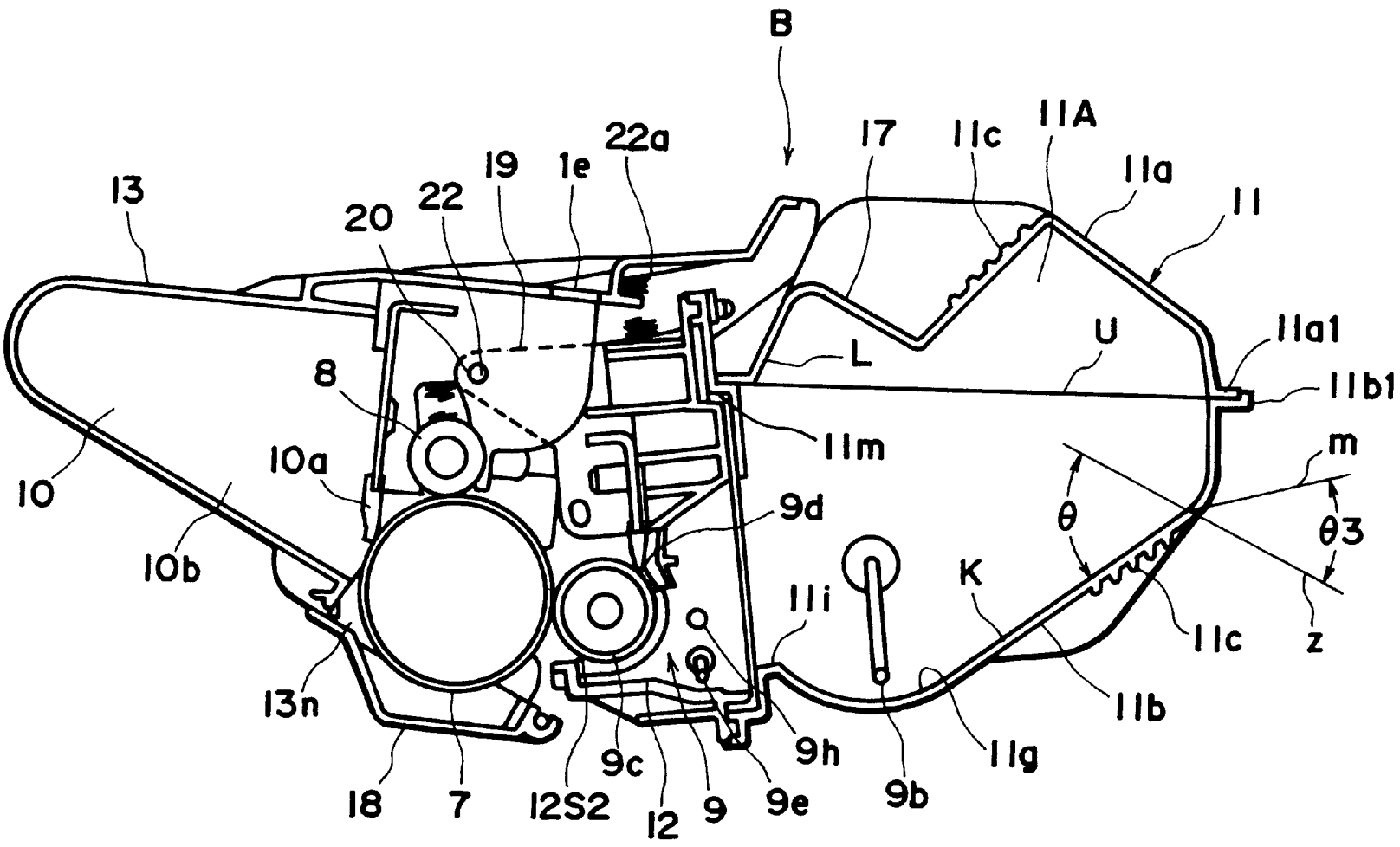
FIG. 3 is a vertical cross section of a process cartridge.
Figure 4:
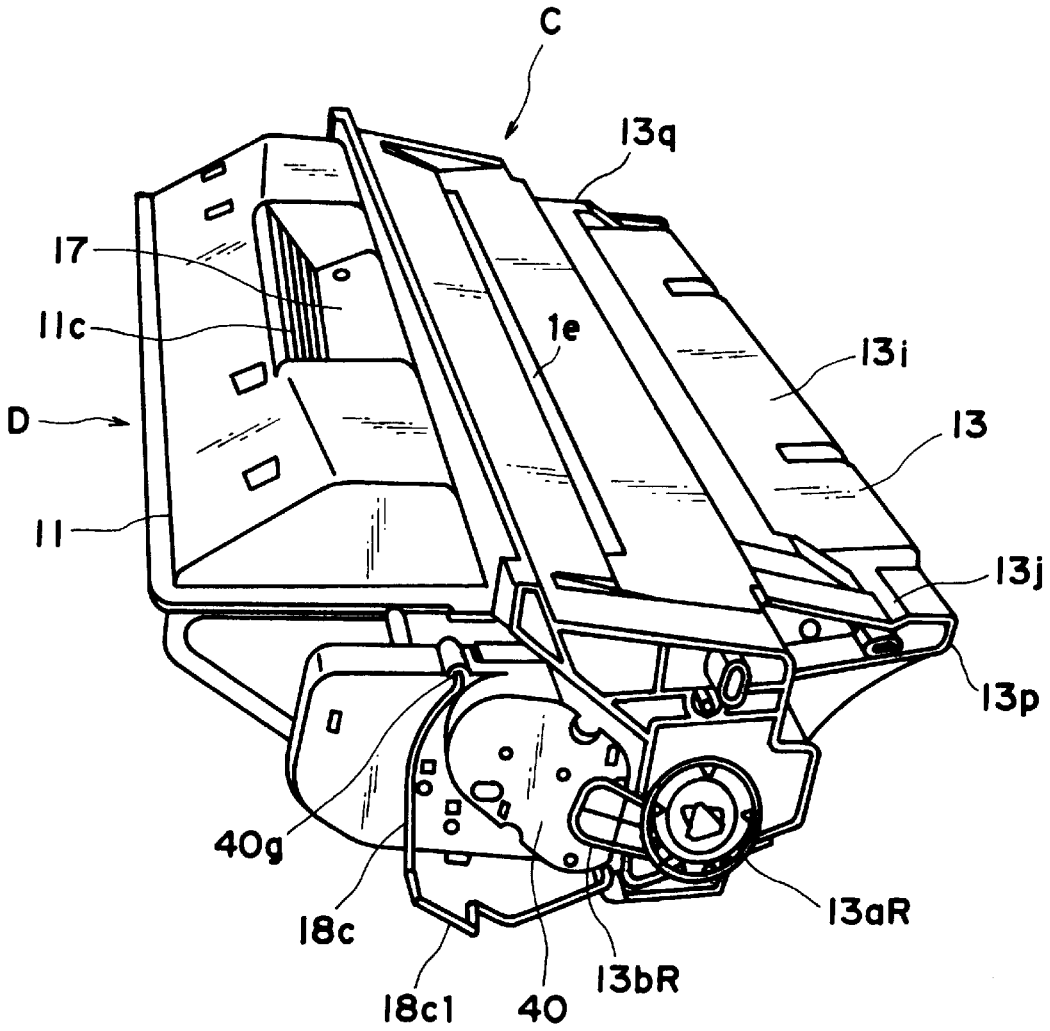
FIG. 4 is an external perspective view of the process cartridge illustrated in FIG. 3, as seen from diagonally above the right-hand side of the cartridge.
Figure 5:
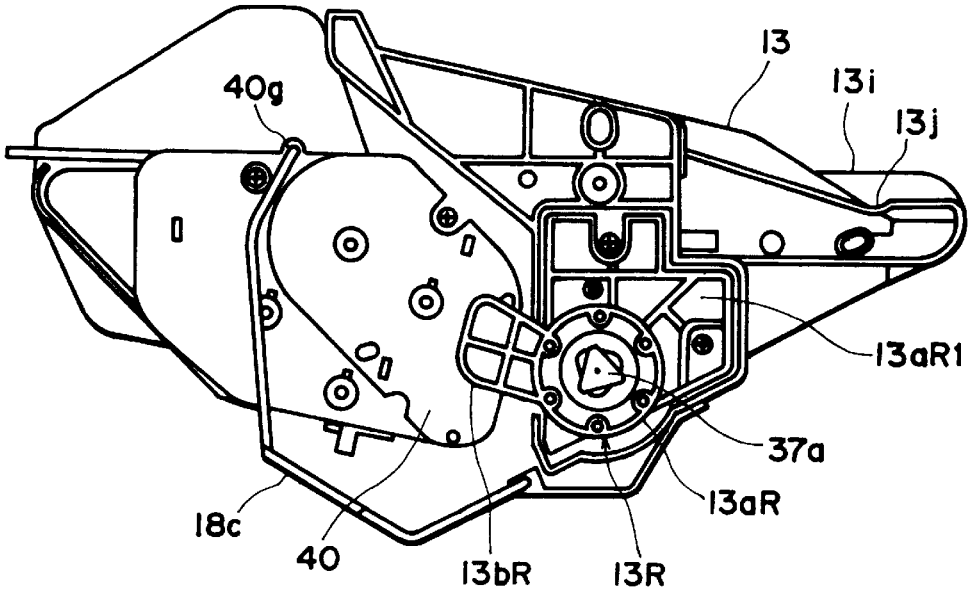
FIG. 5 is a plan view of the right-hand end of the process cartridge illustrated in FIG. 3.
Figure 6:
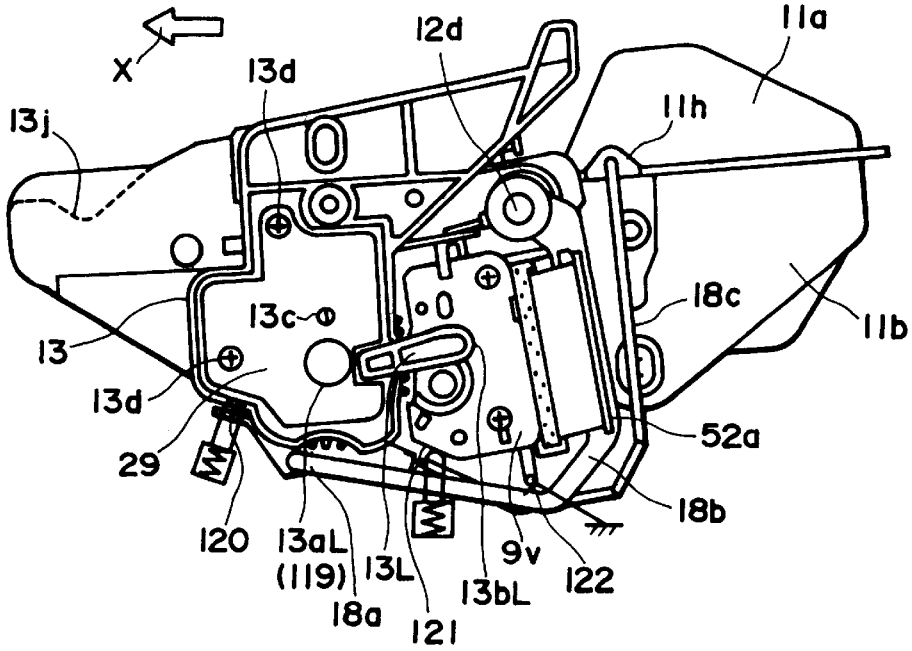
FIG. 6 is a plan view of the left-hand end of the process cartridge illustrated in FIG. 3.
Figure 7:
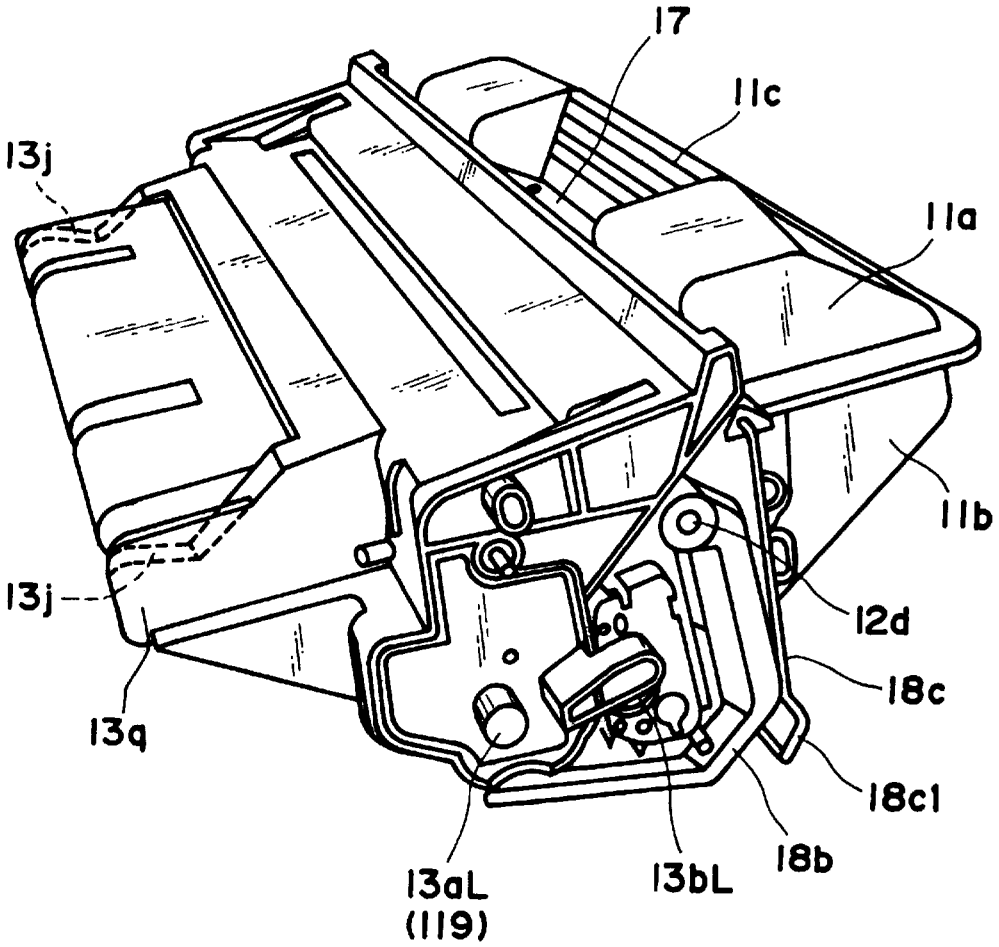
FIG. 7 is an external perspective view of the process cartridge illustrated in FIG. 3, as seen from diagonally above the left-hand side of the cartridge.
Figure 8:
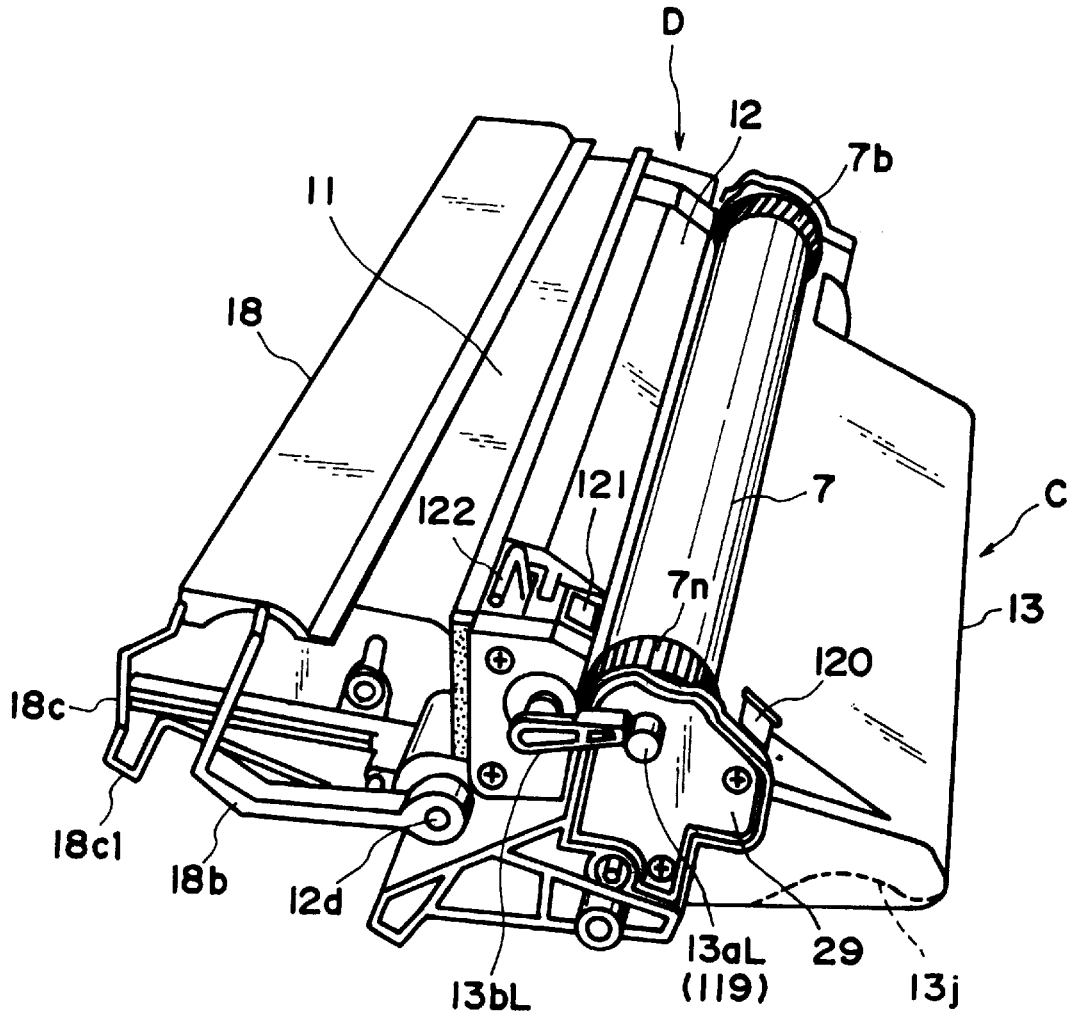
FIG. 8 is an external perspective view of the process cartridge illustrated in FIG. 3, showing the bottom left-hand side of the cartridge.

FIG. 1 is a vertical section of an electrophotographic image forming apparatus (laser beam printer) in accordance with the present invention, and depicts the structure thereof. FIG. 2 is an external perspective view of the electrophotographic image forming apparatus. FIGS. 3–8 are illustrations of the different sides of a process cartridge in accordance with the present invention. More specifically, FIG. 3 is a vertical section of the process cartridge; FIG. 4, an external perspective view; FIG. 5, a plan view of the right-hand side; FIG. 6, a plan view of the left-hand side; FIG. 7, a perspective view from diagonally above one of the longitudinal ends; and FIG. 8 is a perspective view of the inversely positioned process cartridge, as seen from above. Further, in the following descriptions, the "top" surface of the process cartridge B means.

Hereinafter, the embodiments of the present invention will be described with reference to the drawings.

Next, desirable embodiments of the present invention will be described. In the following description, the "widthwise" direction of a process cartridge B means the direction in which the process cartridge B is installed into, or removed from, the main assembly of an image forming apparatus, and coincides with the direction in which a recording medium is conveyed. The "lengthwise" direction of the process cartridge B means a direction which is intersectional with (substantially perpendicular to) the direction in which the process cartridge B is installed into, or removed from, the main assembly 14 It is parallel to the surface of the recording medium, and intersectional with (substantially perpendicular to) the direction in which the recording medium is conveyed. Further, the "left" or "right" means the left or right relative to the direction in which the recording medium is conveyed, as seen from above.

FIG. 1 is an electrophotographic image forming apparatus (laser beam printer) which embodies the present invention, depicting the general structure thereof; FIG. 2, an external perspective thereof; and FIGS. 3–8 are drawings of process cartridges which embody the present invention. More specifically, FIG. 3 is a cross-section of a process cartridge; FIG. 4, an external perspective view of the process cartridge; FIG. 5, a right-hand side view of the process cartridge; FIG. 6, a left-hand side view of the process cartridge; FIG. 7, a perspective view of the process cartridge as seen from the top left direction; and FIG. 8 is a perspective view of the process cartridge as seen from the bottom left direction. In the following description, the "top" surface of the process cartridge B means the surface which faces upward when the process cartridge B is in the main assembly 14 of the image forming apparatus, and the "bottom" surface means the surface which faces downward.

I. Electrophotographic Image Forming Apparatus A and Process Cartridge B

First, referring to FIGS. 1 and 2, a laser beam printer A as an electrophotographic image forming apparatus which embodies the present invention will be described. FIG. 3 is a cross-section of a process cartridge which also embodies the present invention.

Referring to FIG. 1, the laser beam printer A is an apparatus which forms an image on a recording medium (for example, recording sheet, OHP sheet, and fabric) through an electrophotographic image forming process. It forms a toner image on an electrophotographic photosensitive drum (hereinafter, photosensitive drum) in the form of a drum. More specifically, the photosensitive drum is charged with the use of a charging means, and a laser beam modulated with the image data of a target image is projected from an optical means onto the charged peripheral surface of the photosensitive drum, forming thereon a latent image in accordance with the image data. This latent image is developed into a toner image by a developing means. Meanwhile, a recording medium 2 placed in a sheet feeding cassette 3*a* is reversed and conveyed by a pickup roller 3*b,* a conveyer roller pairs 3*c* and 3*d,* and register roller pair 3*e,* in synchronism with the toner formation. Then, voltage is applied to an image transferring roller 4 as a means for transferring the toner image formed on the photosensitive drum 7 of the process cartridge B, whereby the toner image is transferred onto the recording medium 2. Thereafter, the recording medium 2, onto which the toner image has been transferred, is conveyed to a fixing means 5 by guiding conveyer 3*f.* The fixing means 5 has a driving roller 5*c,* and a fixing roller 5*b* containing a heater 5*a,* and applies heat and pressure to the recording medium 2 as the recording medium 2 is passed through the fixing means 5, so that the image having been transferred onto the recording medium 2 is fixed to the recording medium 2. Then, the recording medium 2 is conveyed farther, and is discharged into a delivery tray 6 through a reversing path 3*j,* by discharging roller pairs 3*g,* 3*h* and 3*i.* The delivery tray 6 is located at the top of the main assembly 14 of the image forming apparatus A. It should be noted here that a pivotable flapper 3*k* may be operated in coordination with a discharge roller pair 3*m* to discharge the recording medium 2 without passing it through tho reversing path 3*j.* The pickup roller 3*b,* conveyer roller pairs 3*c* and 3*d,* register roller pair 3*e,* guiding conveyer 3*f,* discharge roller pairs 3*g,* 3*h* and 3*i,* and discharge roller pair 3*m* constitute a conveying means 3.

Referring to FIGS. 3–8, in the process cartridge B, on the other hand, the photosensitive drum 7 with a photosensitive layer 7*e* (FIG. 11) is rotated to uniformly charge its surface by applying voltage to the charging roller 8 as a photosensitive drum charging means. Then, a laser beam modulated with the image data is projected onto the photosensitive drum 7 from the optical system 1 through an exposure opening 1*e,* forming a latent image on the photosensitive drum 7. The thus formed latent image is developed with the use of toner and the developing means 9. More specifically, the charging roller 8 is disposed in contact with the photosensitive drum 7 to charge the photosensitive drum 7. It is rotated by the rotation of the photosensitive drum 7. The developing means 9 provides the peripheral surface area (area to be developed) of the photosensitive drum 7 with toner so that the latent image formed on the photosensitive drum 7 is developed. The optical system 1 comprises a laser diode 1*a,* a polygon mirror 1*b,* a lens 1*c,* and a deflective mirror 1*d.*

In the developing means 9, the toner contained in a toner container 11A is delivered to an developing roller 9*c* by the rotation of a toner feeding member 9*b.* The developing roller 9*c* contains a stationary magnet. It Is also rotated so that a layer of toner with triboelectric charge is formed on the peripheral surface of the developing roller 9*c.* The image developing area of the photosensitive drum 7 is provided with the toner from this toner layer, the toner is transferred onto the peripheral surface of the photosensitive drum 7 in a manner to reflect the latent image, visualizing the latent image as a toner image. The developing blade 9*d* is a blade which regulates the amount of the toner adhered to the peripheral surface of the developing roller 9*c* and also triboelectrically charges the toner. Adjacent to the developing roller 9*e,* a toner stirring member 9*e* is rotatively disposed to circulatively stir the toner within the image developing chamber.

After the toner image formed on the photosensitive drum 7 is transferred onto the recording medium 2 by applying voltage with polarity opposite to that of the toner image to the image transferring roller 4, the residual toner on the photosensitive drum 7 is removed by the cleaning means 10. The cleaning means 10 comprises an elastic cleaning blade 10*a* disposed in contact with the photosensitive drum 7, and the toner remaining on the photosensitive drum 7 is scraped off by the elastic leaning blade 10*a,* being collected into a waste toner collector 10*b.*

The process cartridge B is formed in the following manner. First, a toner chamber frame 11 which comprises a toner container (toner storing portion) 11A for storing toner is joined with an image developing chamber frame 12 which houses the image developing means 9 such as an image developing roller 9*c,* and then, a cleaning chamber frame 13, in which the photosensitive drum 7, the cleaning means 10 such as the cleaning blade 10*a,* and the charging roller 8 are mounted, is joined with the preceding two frames 11 and 12 to complete the process cartridge B. The thus formed process cartridge B is removably installable into the main assembly 14 of tho image forming apparatus A.

The process cartridge B is provided with an exposure opening is through which a light beam modulated with image data is projected onto the photosensitive drum 7, and a transfer opening 13*n* through which the photosensitive drum 7 opposes the recording medium 2. The exposure opening 1*e* is a part of the cleaning chamber frame 11, and the transfer opening 13*n* is located between the image developing chamber frame 12 and the cleaning chamber frame 13.

Next, the structure of the housing of the process cartridge B in this embodiment will be described The process cartridge in this embodiment is formed in tho following manner. First the toner chamber frame 11 and the image developing chamber frame 12 are joined, and then, the cleaning chamber frame 13 is rotatively joined with the preceding two frames 11 and 12 to complete the housing. In this housing, the aforementioned photosensitive drum 7, charging roller 8, developing means 9, cleaning means 10, and the like, are mounted to complete the process cartridge 2 The thus formed process cartridge B is removably installable into the cartridge accommodating means provided in the main assembly 14 of an image forming apparatus.

II. Housing Structure of Process Cartridge B

As described above, the housing of the process cartridge B in this embodiment is formed by joining the toner chamber frame 11, the image developing chamber frame 12, and the cleaning chamber frame 13. Next, the structure of the thus formed housing will be described.

Figure 13:
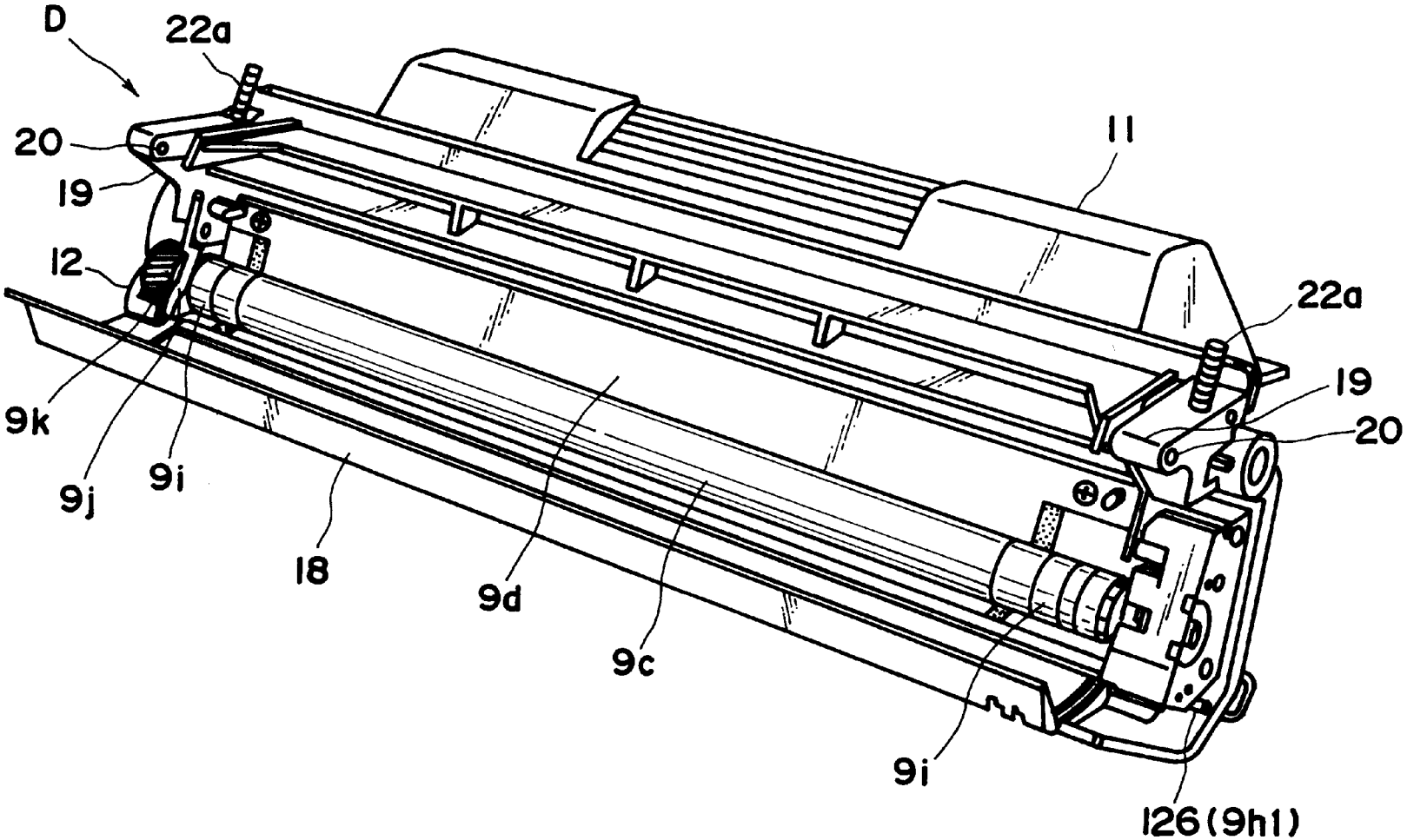
FIG. 13 is a perspective view of a developing unit.
Figure 19:
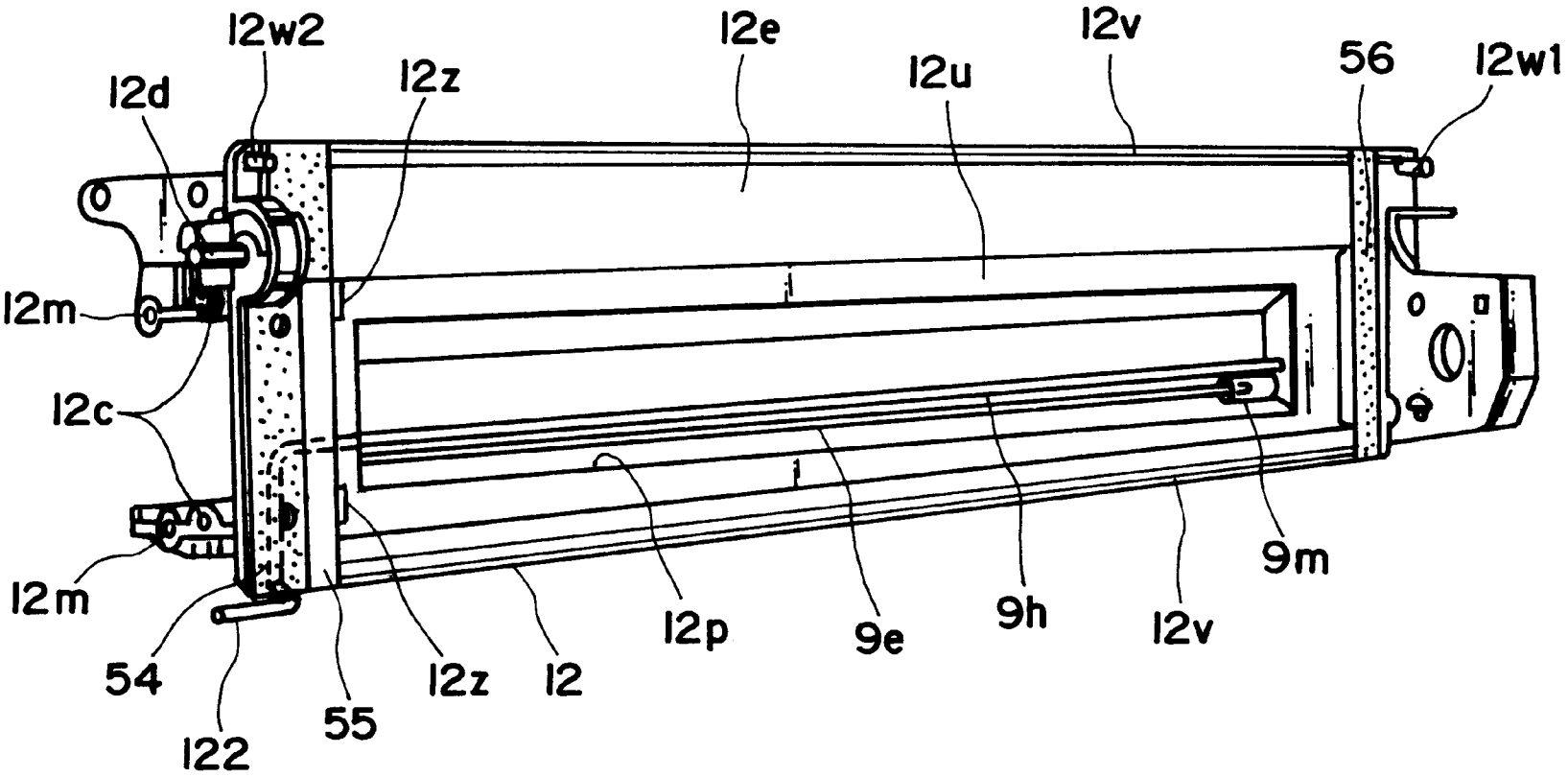
FIG. 19 is a perspective view of the developing means frame.
Figure 20:
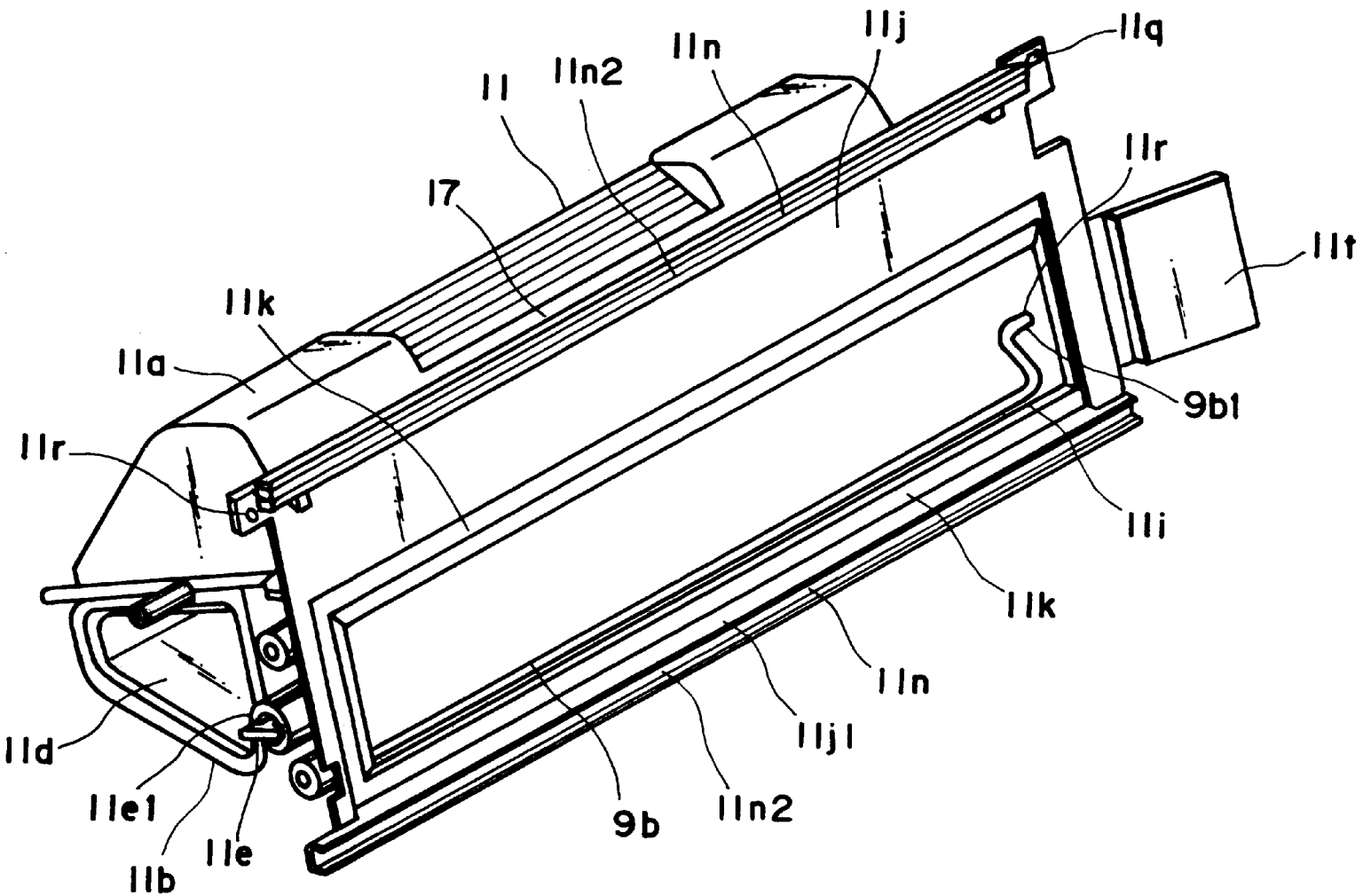
FIG. 20 is a perspective view of the toner containing frame.

Referring to FIGS. 3 and 20, in the toner chamber frame 11, the toner feeding member 9*b* is rotatively mounted. In the image developing chamber frame 12, the image developing roller 9*c* and the developing blade 9*d* are mounted, and adjacent to the developing roller 9*e*, the stirring member 9*e* is rotatively mounted to circulatively stir the toner within the image developing chamber. Referring to FIGS. 3 and 19, in the image developing chamber frame 12, a rod antenna 9*h* is mounted, extending in the lengthwise direction of the developing roller 9*c* substantially in parallel to the developing roller 9*c*. The toner chamber frame 11 and the development chamber frame 12, which are equipped in the above-described manner, are welded together (in this embodiment, by ultrasonic wave) to form a second frame which constitutes an image developing unit D (FIG. 13).

The image developing unit of the process cartridge B is provided with a drum shutter assembly 16, which covers the photosensitive drum 7 to prevent it from being exposed to light for an extend period of time or from coming in contact with foreign objects when or after the process cartridge 3 is removed from the main assembly 14 of an image forming apparatus Referring to FIG. 6, the drum shutter assembly 18 has a shutter cover 18*a* which covers or exposes the transfer opening 13*n* illustrated in FIG. 3, and linking members 18*b* and 18*c* which support the shutter cover 18. On the upstream side relative to the direction in which the recording medium 2 is conveyed, one end of the right-hand side linking member 18*c* is fitted in a hole 40*g* of a developing means gear holder 40 as shown in FIGS. 4 and 5, and one end of the left-hand side linking member 18*c* is fitted in a boss 11*h* of the bottom portion 11*b* of the toner chamber frame 11. The other ends of the left- and right-hand linking members 18*c* are attached to the corresponding lengthwise ends of the shutter cover 18*a*, on the upstream side relative to the recording medium conveying direction. The linking member 18*c* is made of metallic rod. Actually, the left- and right-hand linking members 18*c* are connected through the shutter cover 18*a*; in other words, the left- and right-hand linking members 18*c* are the left- and right-hand ends of a single piece linking member 18*c*. The linking member 18*b* is provided only on one lengthwise end of the shutter cover 18*a*. One end of the linking member 18*b* is attached to the shutter cover 18*a*, on the downstream side, relative to the recording medium conveying direction, of the position at which the linking member 18*c* is attached to the shutter cover 18*a*, and the other end of the linking member 18*b* is fitted around a dowel 12*d* of the image development chamber frame 12. The linking member 18*b* is formed of synthetic resin.

The linking members 18*b* and 18*c* which are different in length, form a four piece linkage structure in conjunction with the shutter cover 18*a* and the toner chamber frame 11. As the process cartridge B is inserted into an image forming apparatus, the portion 18*c*1 of the linking member 18*c*, which projects away from the process cartridge B, comes in contact with the stationary contact member (unillustrated) provided an the lateral wall of the cartridge accommodating space S of the mains assembly 14 of the image forming apparatus, and activates the drum shutter assembly 18 to open the shutter cover 18*a*.

The drum shutter assembly 18 constituted of the shutter cover 18*a* and the linking members 18*b* and 18*c* is loaded with the pressure from an unillustrated torsional coil spring fitted around a dowel 12*d*. One end of the spring is anchored to the linking member 18*b*, and the other end is anchored to the image developing chamber frame 12, so that the pressure is generated in the direction to cause the shutter cover 18*a* to cover the transfer opening 13*n*.

Referring again to FIGS. 3 and 12, the cleaning means frame 13 is fitted with the photosensitive drum 7, the charging roller 8, and the various components of the cleaning means 10, to form a first frame as a cleaning unit C (FIG. 12).

Figure 12:
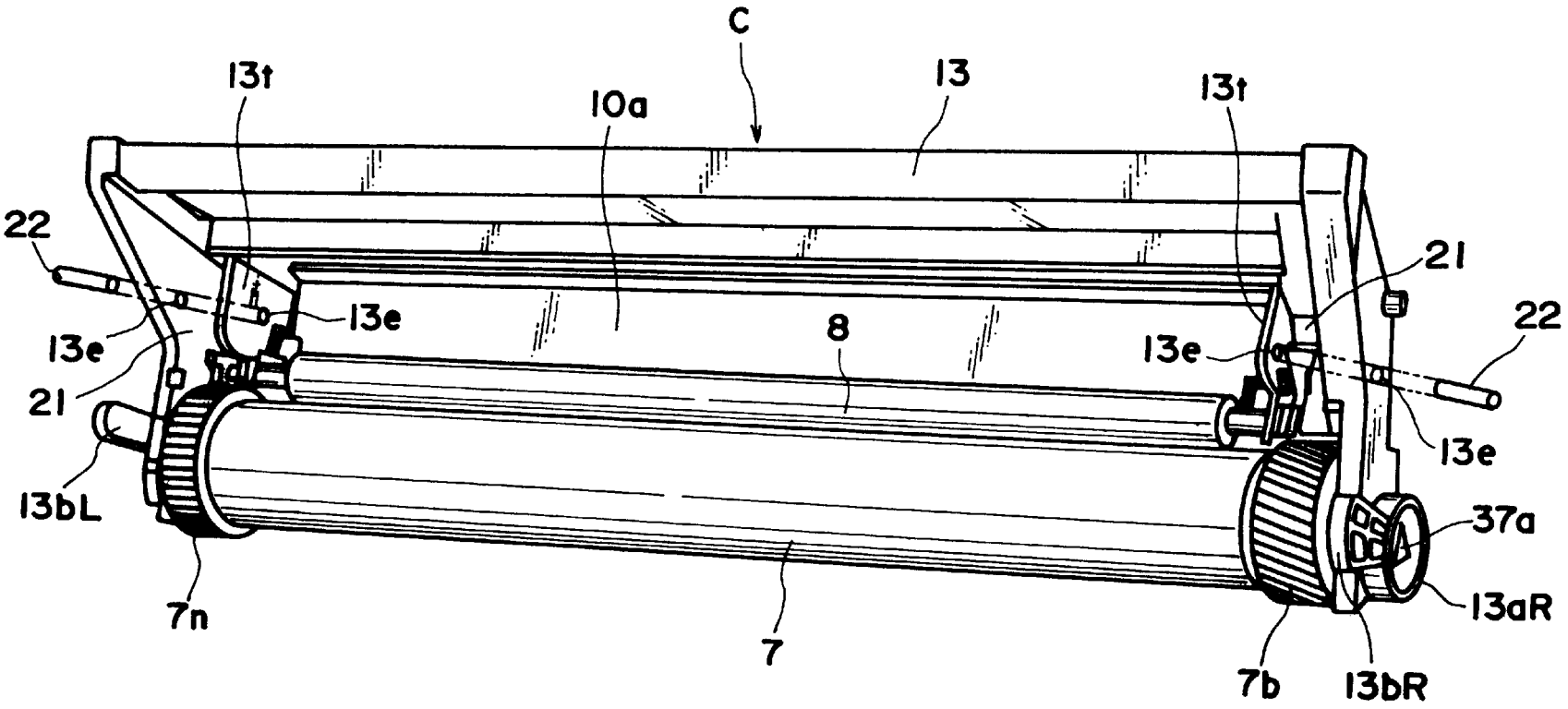
FIG. 12 is a perspective view of a cleaning unit.

Then, the aforementioned image developing unit D and cleaning unit C are joined with the use of a joining member 22, in a mutually pivotable manner, to complete the process cartridge B. More specifically, referring to FIG. 13, both lengthwise (axial direction of the developing roller 9*c*) ends of the image developing chamber frame 12 are provided with an arm portion 19, which is provided with a round hole 20 which is in parallel to the developing roller 9*c*. On the other hand, a recessed portion 21 for accommodating the arm portion 19 is provided at each lengthwise end of the cleaning chamber frame (FIG. 12). The arm portion 19 is inserted in this recessed portion 21, and the joining member 22 is pressed into the mounting hole 13*e* of the cleaning chamber frame 13, put through the hole 20 of the end portion of the arm portion 19, and pressed, farther, into the hole 13*e* of an partitioning wall 13*t*, so that the image developing unit D and the cleaning unit C are joined. to be pivotable relative to each other about the joining member 22. In joining the image developing unit D and the cleaning unit C, a compression type coil spring 22*a* is placed between the two units, with one end of the coil spring being fitted around an unillustrated dowel erected from the base portion of the arm portion 19, and the other end being pressed against the top wall of the recessed portion 21 of the cleaning chamber frame 13. As a result, the image developing chamber frame 12 is pressed downward to reliably keep the developing roller 9*c* pressed downward toward the photosensitive drum 7. More specifically, referring to FIG. 13. a roller 9*i* having a diameter larger than that of the developing roller 9*c* is attached to each lengthwise end of the developing roller 9*c*, and this roller 9*i* is pressed on the photosensitive drum 7 to maintain a predetermined gap (approximately 300 $\mu$m) between the photosensitive drum 7 and the developing roller 9*c*. The top surface of the recessed portion 21 of the cleaning chamber frame 13 is slanted so that the compression type coil spring 22*a* is gradually compressed when the image developing unit D and the cleaning unit C are united. That is, the image developing unit D and the cleaning unit C are pivotable toward each other about the joining member 22, wherein the positional relationship (gap) between the peripheral surface of the photosensitive drum 7 and the peripheral surface of the developing roller 9*c* is precisely maintained by the elastic force of the compression type coil spring 22*a*.

Since the compression type coil spring 22*a* is attached to the base portion of the arm portion 19 of the image developing chamber frame 12, the elastic force of the compression type coil spring 22*a* affects nowhere but the base portion of the arm portion 19. In a case in which the image developing chamber frame 12 is provided with a dedicated spring mount for the compression type coil spring 22*a*, the adjacencies of the spring seat must be reinforced to precisely maintain the predetermined gap between the photosensitive drum 7 and the developing roller 9*c*. However, with the placement of the compression type coil spring 22*a* in the above described manner, it is unnecessary to reinforce the adjacencies of the spring seat, that is, the adjacencies of the base portion of the arm portion 19 in the case of this embodiment, because the base portion of the arm portion 19 is inherently greater in strength and rigidity.

The above described structure which holds together the cleaning chamber frame 13 and the image developing chamber frame 12 will be described later in more detail.

III. Structure of Process Cartridge B Guiding Means

Figure 9:
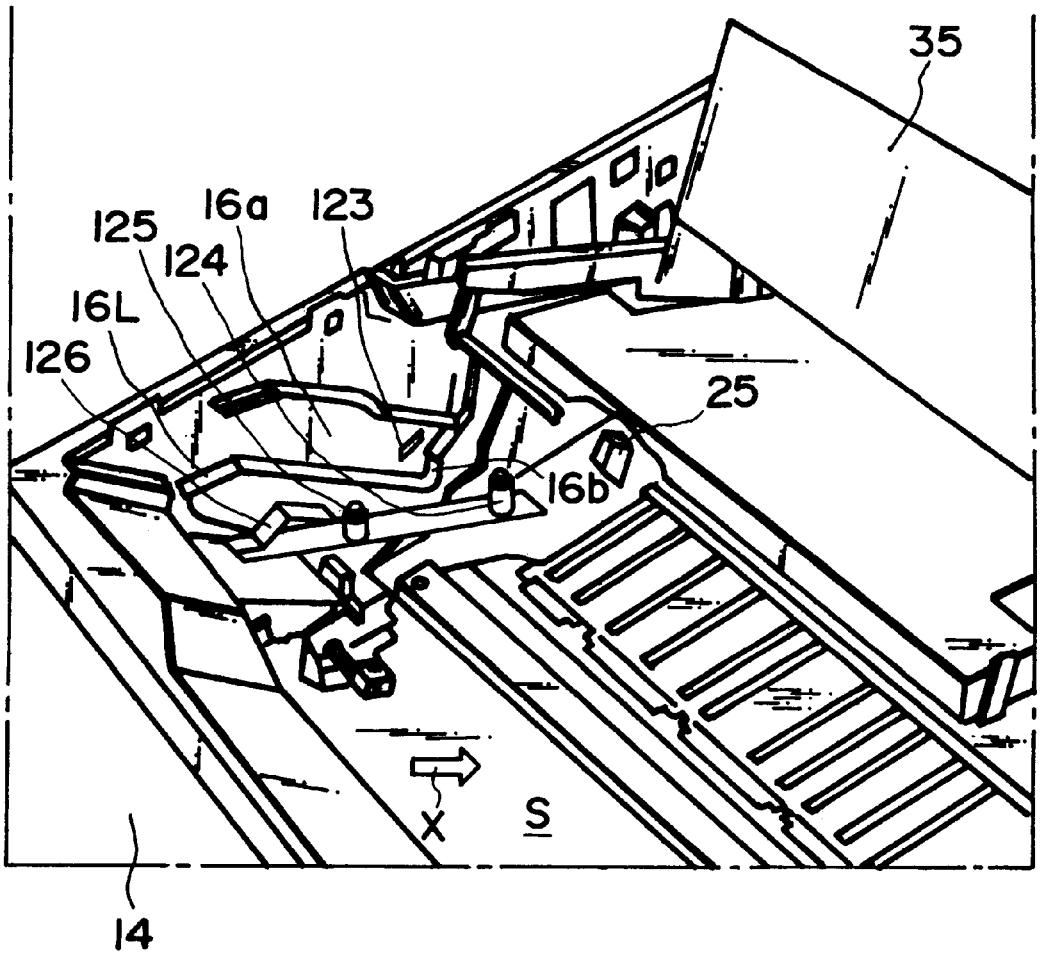
FIG. 9 is an external perspective view of the process cartridge space in the main assembly of the image forming apparatus illustrated in FIG. 1.
Figure 10:
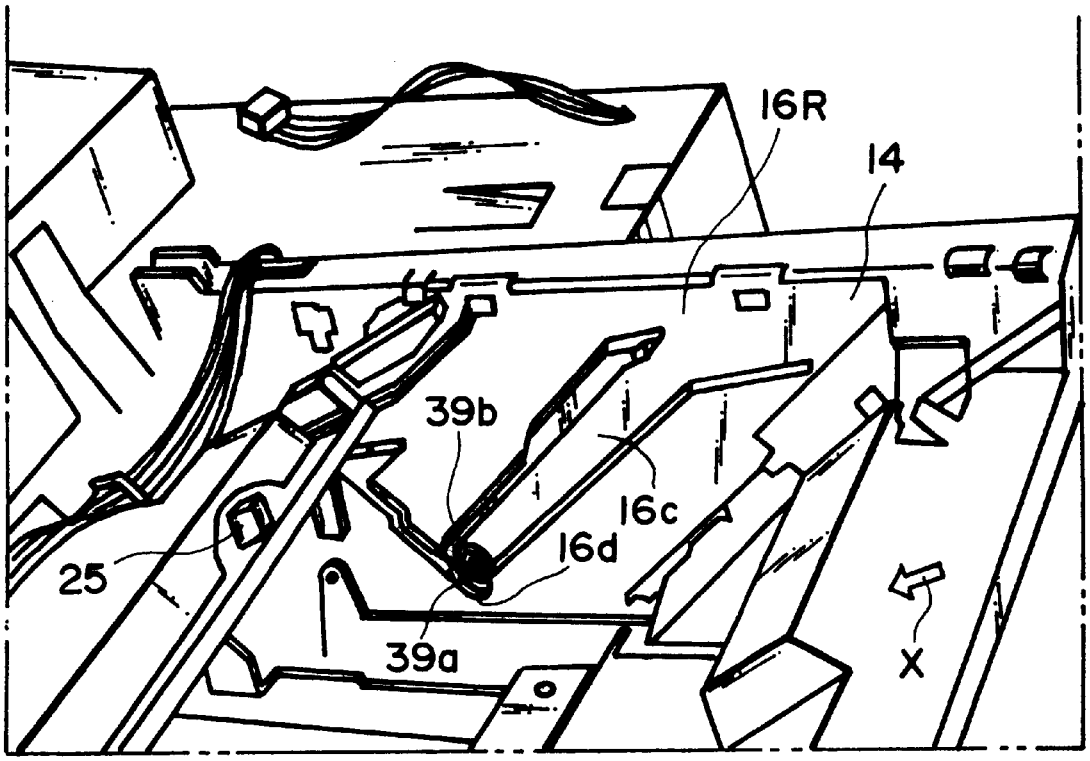
FIG. 10 is an external perspective view of the process cartridge space in the main assembly of the image forming apparatus illustrated in FIG. 1.

Next, the means for guiding the process cartridge B when the process cartridge B is installed into, or removed from, the main assembly 14 of an image forming apparatus. This guiding means is illustrated in FIGS. 9 and 10. FIG. 9 is a perspective view of the left-hand side of the guiding means, as seen (in the direction of an arrow mark X) from the side from which the process cartridge B is installed into the main assembly 14 of the image forming apparatus A (as seen from the side of the image developing unit D side). FIG. 10 is a perspective view of the right-hand side of the same, as seen from the same side.

Referring to FIGS. 4, 5, 6 and 7, each lengthwise end of the cleaning frame portion 13 is provided with means which serves as a guide when the process cartridge B is installed into, or removed from, the apparatus main assembly 14. This guiding means is constituted of a cylindrical guides 13*a*R and 13*a*L as a cartridge positioning guiding member, and rotation controlling guides 13*b*R and 13*b*L as means for controlling the attitude of the process cartridge B when the process cartridge B is installed or removed.

As illustrated in FIG. 5, the cylindrical guide 13*a*R is a hollow cylindrical member. The rotation controlling guides 13*b*R is integrally formed together with the cylindrical guide 13*a*R, and radially protrudes from the peripheral surface of the cylindrical guide 13*a*R. The cylindrical guide 13*a*R is provided with a mounting flange 13*a*R1 which is also integral with the cylindrical guide 13*a*R. Thus, the cylindrical guide 13*a*R, the rotation controlling guide 13*b*R, and the mounting flange 13*a*R1 constitute the right-hand side guiding member 13R, which is fixed to the cleaning chamber frame 13 with small screws put through the screw holes of the mounting flange 13*a*R*a*. With the right-hand side guiding member 13R being fixed to the cleaning chamber frame 13, the rotation controlling guide 13*b*R extends over the lateral wall of the developing means gear holder 40 fixed to the image developing chamber frame 12.

Figure 11:
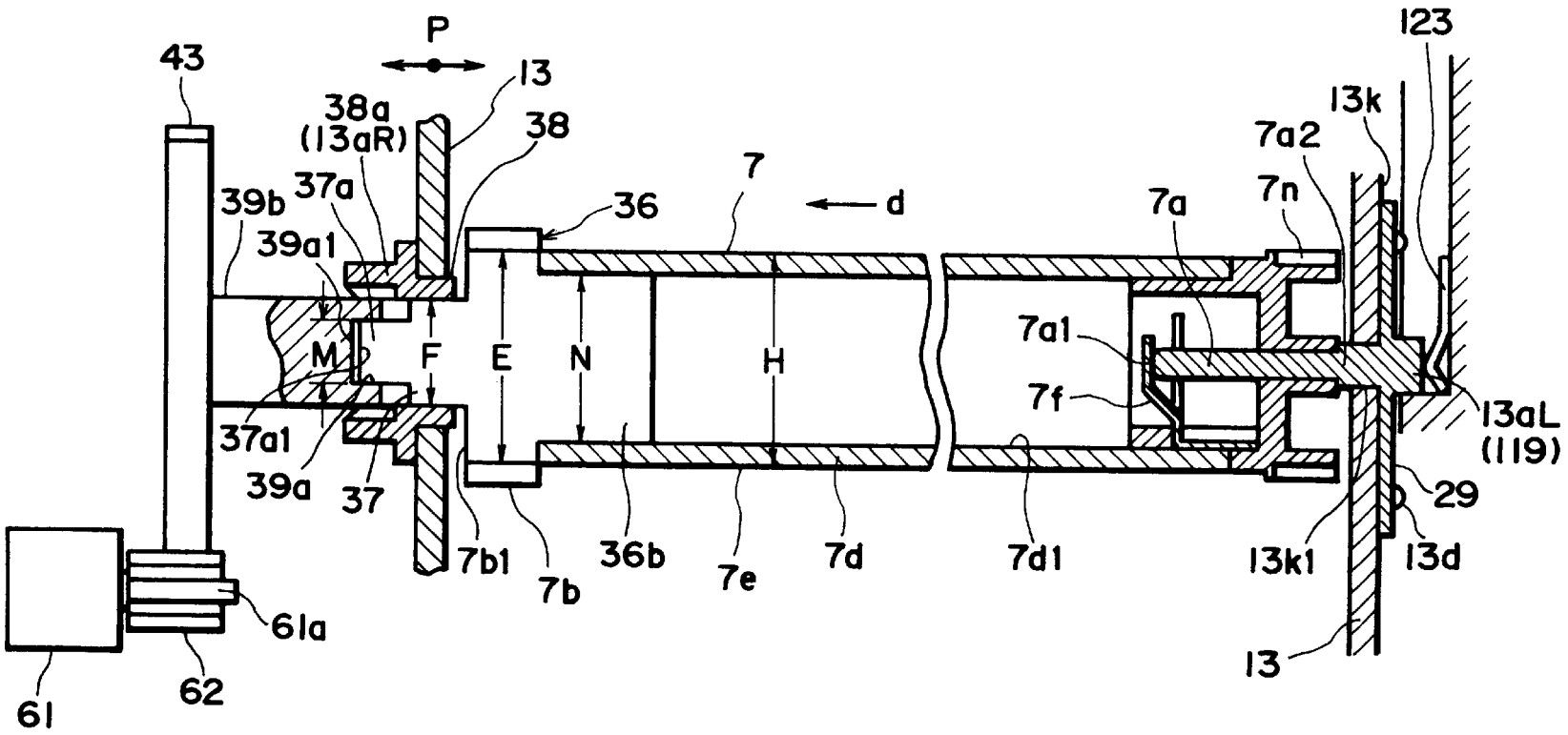
FIG. 11 is a vertical section of an electrophotographic photosensitive drum and the driving mechanism for the drum.

Referring to FIG. 11, a drum shaft member is constituted of a drum shaft portion 7*a* inclusive of a larger diameter portion 7*a*2, a disk-shaped flange portion 29 and a cylindrical guide portion 13*a*L. The larger diameter portion 7*a*2 is fitted in the hole 13*k*1 of the cleaning frame portion 13. The flange portion 29 is engaged with a positioning pin 13*c* projecting from the side wall of the lengthwise end wall of the cleaning frame portion 13, being prevented from rotating, and is fixed to the cleaning frame portion 13 with the use of small screws 13*d*. The cylindrical guide 13*a*L projects outward (toward front, that is, the direction perpendicular to the page of FIG. 6). The aforementioned stationary drum shaft 7*a* which rotatively supports a spur gear 7*n* fitted around the photosensitive drum 7 projects inwardly from the flange 29 (FIG. 11). The cylindrical guide 13*a*L and the drum shaft 7*a* are coaxial. The flange 29, the cylindrical guide 13*a*L, and the drum shaft 7*a*, are integrally formed of metallic material such as steel.

Referring to FIG. 6, there is a rotation controlling guide 13*b*L slightly away from the cylindrical guide 13*a*L. It is long and narrow, extending substantially in the radial direction of the cylindrical guide 13*a*L and also projecting outward from the cleaning chamber frame 13. It is integrally formed with the cleaning chamber frame 13. In order to accommodate this rotation controlling guide 13*b*L, the flange 29 is provided with a cutaway portion. The distance the rotation controlling guide 13*b*L projects outward is such that its end surface is substantially even with the end surface of the cylindrical guide 13*a*L. The rotation controlling guide 13*b*L extends over the side wall of the developing roller bearing box 9*v* fixed to the image developing chamber frame 12. As is evident from the above description, the left-hand side guiding member 13L is constituted of separate two pieces: the metallic cylindrical guide 13*a*L and the rotation controlling guide 13*b*L of synthetic resin.

Next, a regulatory contact portion 13*j*, which is a part of the top surface of the cleaning chamber frame 13, will be described. In the following description of the regulatory contact portion 13*j*, "top surface" means the surface which faces upward when the process cartridge B is in the main assembly 14 of an image forming apparatus.

Referring to FIGS. 4–7, two portions 13*j* of the top surface 13*i* of the cleaning unit C, which are the portions right next to the right and left front corners 13*p* and 13*q*, relative to the direction perpendicular to the direction in which the process cartridge B is inserted, constitute the regulatory contact portions 13*j*, which regulate the position and attitude of the process cartridge B when the cartridge B is installed into the main assembly 14. In other words, when the process cartridge B is installed into the main assembly 14, the regulatory contact portion 13*j* comes in contact with the fixed contact member 25 provided in the main assembly 14 of an image forming apparatus (FIGS. 9, 10 and 30), and regulates the rotation of the process cartridge B about the cylindrical guide 13*a*R and 13*a*L.

IV. Guiding Means in the Main Assembly

Next, the guiding means on the main assembly side 14 will be described. Referring to FIG. 1, as the lid 35 of the main assembly 14 of an image forming apparatus is pivotally opened about a supporting point 35*a* in the counterclockwise direction, the top portion of the main assembly 14 is exposed, and the process cartridge accommodating portion appears as illustrated in FIGS. 9 and 10. The left and right internal walls of the image forming apparatus main assembly 14, relative to the direction in which the process cartridge B is inserted, are provided with guide members 16L (FIG. 9) and 16R (FIG. 10), respectively, which extend diagonally downward from the side opposite to the supporting point 35*a*.

As show n in the drawings, the guide members 16L and 16R comprise guide portions 16*a* and 16*c*, and positioning grooves 16*b* and 16*d* connected to the guide portions 16*a* and 16*c,* respectively . The guide portions 16*a* and 16*c* extend diagonally downward, as seen from the direction indicated by an arrow mark X, that is, the direction in which the process cartridge B is inserted. The positioning grooves 16*b* and 16*d* have a semicircular cross-section which perfectly matches the cross-section of the cylindrical guides 13*a*L or 13*a*R of the process cartridge B. After the process cartridge B is completely installed in the apparatus main assembly 14, the centers of semicircular cross-sections of the positioning groove 16*b* and 16*d* coincide with the axial lines of the cylindrical guides 13*a*L and 13*a*R, respectively, of the process cartridge B, and hence, with the axial line of the photosensitive drum 7.

Figure 30:
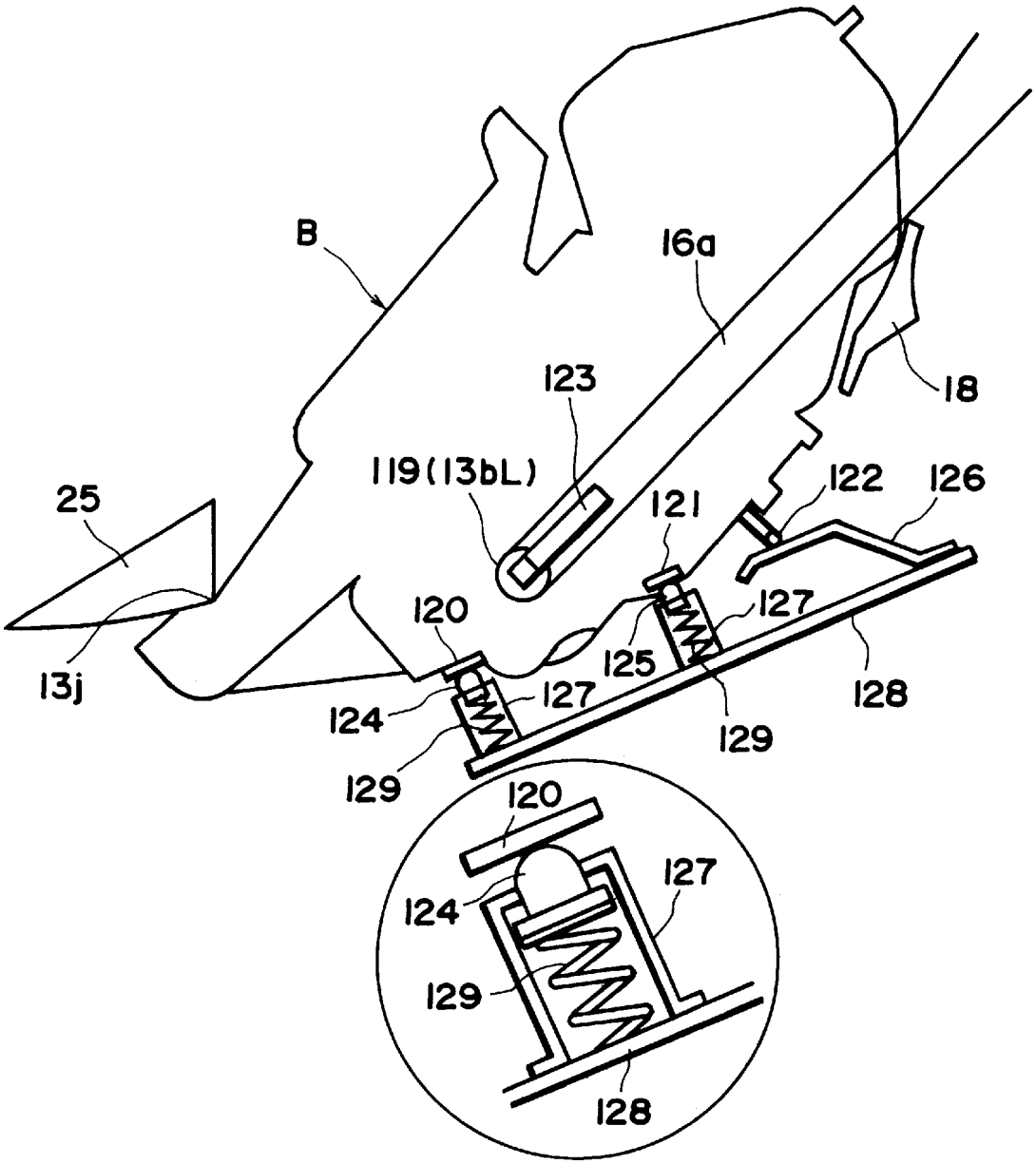
FIG. 30 is a vertical section of the process cartridge in the main assembly of the electrophotographic image forming apparatus, and the areas adjacent thereto, depicting the positional relationship between the electrical contact points on the process cartridge side, and the electrical contact members on the main assembly side, in a state in which the process cartridge is being installed into, or removed from, the main assembly.

The width of the guide portions 16*a* and 16*c* as seen from the direction in which the process cartridge B is installed or removed is wide enough to allow the cylindrical guides 13*a*L and 13*a*R to ride on them with a reasonable amount of play. Therefore, the rotation controlling guide 13*b*L and 13*b*R which are narrower than the diameter of the cylindrical guide. 13*a*L and 13*a*R naturally fit more loosely in the guide portions 16*a* and 16*c* than the cylindrical guides 13*a*L and 13*a*R, respectively, yet their rotation is controlled by the guide portions 16*a* and 16*c.* In other words, when the process cartridge B is installed, the angle of the process cartridge B is kept within a predetermined range. After the process cartridge B is installed in the image forming apparatus main assembly 14, the cylindrical guides 13*a*L and 13*a*R of the process cartridge B are in engagement with the positioning grooves 16*b* and 16*d* of the guiding members 13L and 13R, and the left and right regulatory contact portions 13*j* located at the front portion, relative to the cartridge inserting direction, of the cleaning chamber frame 13 of the process cartridge B, are in contact with the fixed positioning members 25, respectively (FIG. 30).

The weight distribution of the process cartridge B is such that when the line which coincides with the axial lines of the cylindrical guide 13*a*L and 13*a*R is level, the image developing unit D side of the process cartridge B generates larger moment about this line than the cleaning unit C side.

V. Mounting and Demounting of the Process Cartridge Relative to the Main Assembly The process cartridge B is installed into the image forming apparatus main assembly 14 in the following manner by the user. First, the cylindrical guide 13*a*L and 13*a*R of the process cartridge B are inserted into the guide portion 16*a* and 16*c,* respectively, of the cartridge accomodating portion in the image forming apparatus main assembly 14 by grasping the recessed portion 17 and ribbed portion 11*c* of the process cartridge B with one hand, and the rotation controlling guide 13*b*L and 13*b*R are also inserted into the guide portions 16*a* and 16*c,* tilting downward the front portion, relative to the inserting direction, of the process cartridge B. Then, the process cartridge B is inserted farther with the cylindrical guides 13*a*L and 13*a*R and the rotation controlling guides 13*b*L and 13*b*R of the process cartridge B following the guide portions 16*a* and 16*c,* respectively, until the cylindrical guides 13*a*L and 13*a*R reach the positioning grooves 16*b* and 16*d* of the image forming apparatus main assembly 14. Then, the cylindrical guides 13*a*L and 13*a*R become seated in the positioning grooves 16*b* and 16*d,* respectively, due to the weight of the process cartridge B itself; the cylindrical guides 13*a*L and 13*a*R of the process cartridge B are accurately positioned relative to the positioning grooves 16*b* and 16*d.* In this condition, the line which coincides with the axial lines of the cylindrical guides 13*a*L and 13*a*R also coincides with the axial line of the photosensitive drum 7, and therefore, the photosensitive drum 7 is reasonably accurately positioned relative to the image forming apparatus main assembly 14. It should be noted here that the final positioning of the photosensitive drum 7 relative to the image forming apparatus main assembly 14 occurs at the same time as the coupling between the two is completed.

Also in this condition, there is a slight gap between the stationary positioning member 25 of the image forming apparatus main assembly 14 and the regulatory contact portion 13*j* of the process cartridge B. At this point of time, the process cartridge B is released from the hand. Then, the process cartridge B rotates about the cylindrical guides 13*a*L and 13*a*R in the direction to lower the image developing unit D side and raise the cleaning unit C side until the regulatory contact portions 13*j* of the process cartridge B come in contact with the corresponding stationary positioning members 25. As a result, the process cartridge B is accurately positioned relative to the image forming apparatus main assembly 14. Thereafter, the lid 35 is closed by rotating it clockwise about the supporting point 35*a*.

In order to remove the process cartridge 2 from the apparatus main assembly 14, the above described steps are carried out in reverse. More specifically, first, the lid 35 of the apparatus main assembly 14 is opened, and the process cartridge B is pulled upward by grasping the aforementioned top and bottom ribbed portions 11*c,* that is, the handhold portions, of the process cartridge by hand. Then, the cylindrical guides 13*a*L and 13*a*R of the process cartridge B rotate in the positioning grooves 16*b* and 16*d* of the apparatus main assembly 14. As a result, the regulatory contact portions 13*j* of the process cartridge B separate from the corresponding stationary positioning member 25. Next, the process cartridge B is pulled more. Then, the cylindrical guides 13*a*L and 13*a*R come out of the positioning grooves 16*b* and 16*d,* and move into the guide portions 16*a* and 16*c* of the guiding member 16L and 16R, respectively, fixed to the apparatus main assembly 14. In this condition, the process cartridge B is pulled more. Then, the cylindrical guides 13*a*L and 13*a*R and the rotation controlling guides 13*b*L and 13*b*R of the process cartridge B slide diagonally upward through the guide portions 16*a* and 16*c* of the apparatus main assembly 14, with the angle of the process cartridge B being controlled so that the process cartridge B can be completely moved out of the apparatus main assembly 14 without making contact with the portions other than the guide portions 16*a* and 16*c*.

Referring to FIG. 12, the spur gear 7*n* is fitted around one of the lengthwise ends of the photosensitive drum 7, which is the end opposite to where the helical drum gear 7*b* is fitted. As the process cartridge B is inserted into the apparatus main assembly 14, the spur gear 7*n* mashes with a gear (unillustrated) coaxial with the image transferring roller 4 located in the apparatus main assembly, and transmits from t he process cartridge B to the transferring roller 4 the driving force which rotates the transferring roller 4.

VI. Toner Chamber Frame

Figure 21:
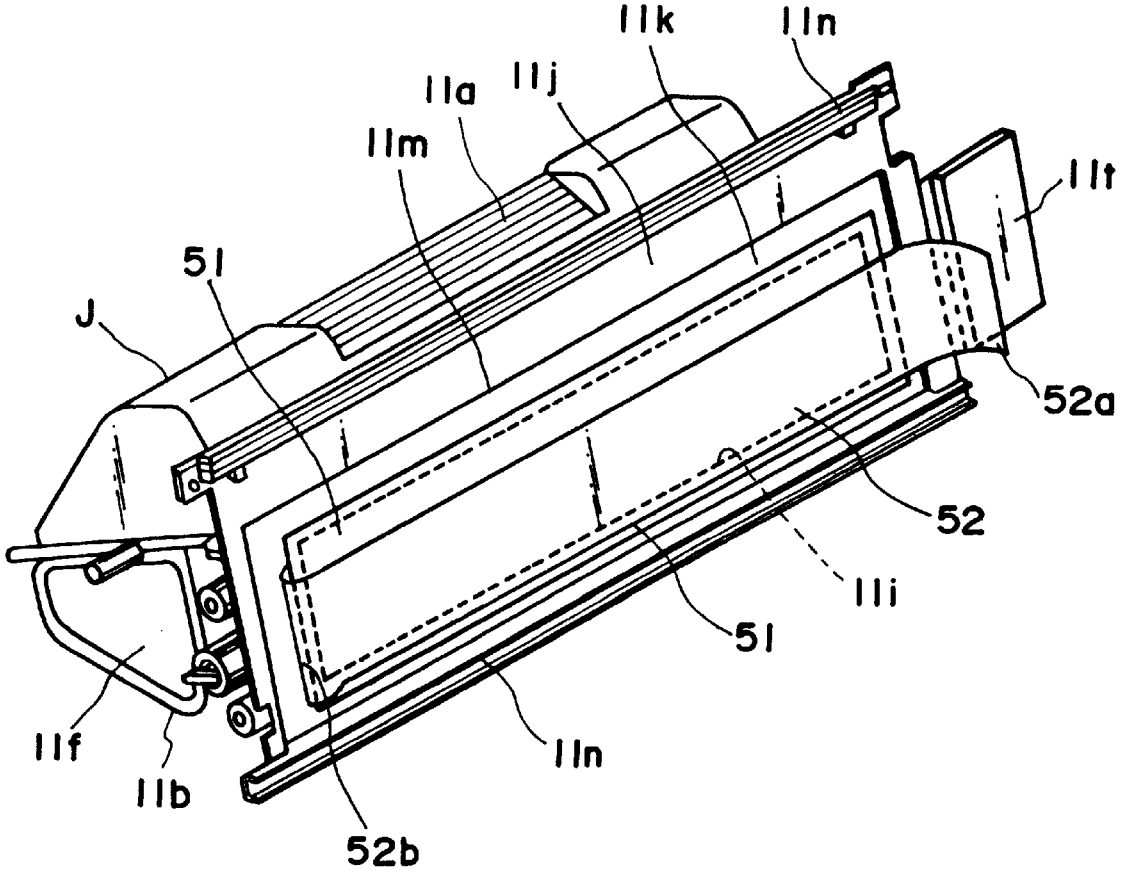
FIG. 21 also is a perspective view of the toner containing frame.

Referring to FIGS. 3, 5, 7, 16, 20 and 21, the toner chamber frame will be described in detail. FIG. 20 is a perspective view of the toner chamber frame as seen before a toner seal is welded on, and FIG. 21 is a perspective view of the toner chamber frame after toner is fitted in.

Referring to FIG. 3, the toner chamber frame 11 is constituted of two portions: the top and bottom portions 11*a* and 11*b*. Referring to FIG. 1, the top portion 11*a* bulges upward, occupying the space on the left-hand side of the optical system 1 in the image forming apparatus main assembly 14, so that the toner capacity of the process cartridge B can be increased without increasing the size of the image forming apparatus A. Referring to FIGS. 3, 4 and 7, the top portion via of the toner chamber frame 11 has a recessed portion 17, which is located at the lengthwise center portion of the top portion 11*a*, and serves as a handhold. An operator of the image forming apparatus can handle the process cartridge B by grasping it by the recessed portion 17 of the top portion 11*a* and the downward facing side of the bottom portion 11*b*. The ribs 11*c* extending on the downward facing surface of the bottom portion 11*b* in the lengthwise direction of the bottom portion 11*b* serve to prevent the process cartridge B from slipping out of the operator's hand. Referring again to FIG. 3, the flange 11*a*1 of the top portion 11*a* is aligned with the raised-edge flange 11*b*1 of the bottom portion 11*b*, the flange 11*a*1 being fitted within the raised edge of the flange 11*b*1 of the bottom portion 11*b*1, so that the walls of the top and bottom portions of the toner chamber frame 11 perfectly meet at the welding surface U. and then, the top and bottom portions 11*a* and 11*b* of the toner chamber frame 11 are welded together by melting the welding ribs with the application of ultrasonic waves. The method for uniting the top and bottom portions 11*a* and 11*b* of the toner chamber frame 11 does not need to be limited to ultrasonic welding. They may be welded by heat or forced vibration, or may be glued together. Further, the bottom portion 11*b* of the toner chamber frame 11 is provided with a stepped portion 11*m*, in addition to the flange 11*b*1 which keeps the top and bottom portions 11*a* the and 11*b* aligned when they are welded together by ultrasonic welding. The stepped portion 11*m* is located above an opening 11*i* and is substantially in the same plane as the flange 11*b*. The structures of stepped portion 11*m* and its adjacencies will be described later.

Figure 16:
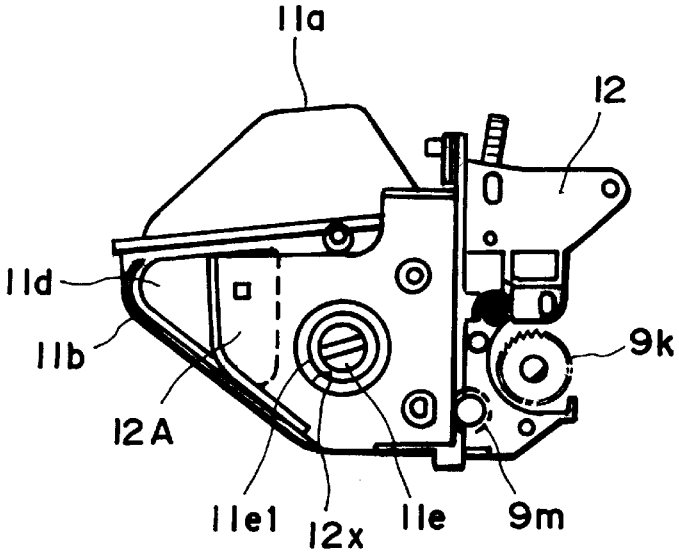
FIG. 16 is an external plan view of one of the lateral ends of the process cartridge, showing the side plate of the developing means frame and the side plate of the toner containing frame.

Before the top and bottom portions 11*a* and 11*b* of the toner chamber frame 11 are united, a toner feeding member 9*b* is assembled into the bottom portion 11, and a coupling member 11*e* is attached to the end of the toner feeding member 9*b* through the hole 11*e*1 of the side wall of the toner chamber frame 11 as shown in FIG. 16. The hole 11*e*1 is located one of the lengthwise ends of the bottom portion 11*b*, and the side plate which has the hole 11*e*1 is also provided with a toner filling opening 11*d* substantially shaped like a right triangle. The triangular rim of the toner filling opening 11*d* is constituted of a first edge which is one of two edges that are substantially perpendicular to each other, and extends along the joint between the top and bottom portion 11*a* and 11*b* of the toner chamber frame 11, a second edge which vertically extends in the direction substantially perpendicular to the first edge, and a third edge, that is, a diagonal edge, which extends along the slanted edge of the bottom portion 11*b*. In other words, the toner filling opening 11*d* is rendered as large as possible, while being located next to the hole 11*e*1. Next, referring to FIG. 20, the toner chamber frame 11 is provided with an opening 11*i* through which toner is fed from the toner chamber frame 11 into the image developing chamber frame 12, and a seal (which will be described later) is welded to seal this opening 11*i*. Thereafter, toner is filled into the toner chamber frame 11 through the toner filling opening 11*d*, and then, the toner filling opening 11*d* is sealed with a toner sealing cap 11*f* to finish a toner unit J. The toner sealing cap 11*f* is formed of polyethylene, polypropylene, or the like, and is pressed into, or glued to, the toner filling opening 11*d* of the toner chamber frame 11 so that it does not come off. Next, the toner unit J is welded to the image developing chamber frame 12, which will be described later, by ultrasonic welding, to form the image developing unit D. The means for uniting the toner unit J and the image developing unit D is not limited to ultrasonic welding; it may be gluing or snap-fitting which utilizes the elasticity of the materials of the two units.

Referring to FIG. 3, the slanted surface K of the bottom portion 11*b* of the toner chamber frame 11 is given an angle of θ so that the toner in the top portion of the toner chamber frame 11 naturally slides down as the toner at the bottom is consumed. More specifically, it is desirable that the angle θ formed between the slanted surface K of the process cartridge B in the apparatus main assembly 14 and the horizontal line Z is approximately 65 deg. when the apparatus main assembly 14 is horizontally placed. The bottom portion 11*b* is given an outwardly bulging portion 11*g* so that it does not interfere with the rotation of the toner feeding member 9*b*. The diameter of the sweeping range of the toner feeding member 9*b* is approximately 37 mm. The height of the bulging portion 11*g* has only to be approximately 0–10 mm from the imaginary extension of the slanted surface K. This is due to the following reason; if the bottom surface of the bulging portion 11*g* is above the imaginary extension of the slanted surface K, the toner which, otherwise, naturally slides down from the top portion of the slanted surface K and is fed into the image developing chamber frame 12, partially fails to be fed into the image developing chamber frame 12, collecting in the area where the slanted surface K and the outwardly bulging portion 11*g* meet. Contrarily, in the case of the toner chamber frame 11 in this embodiment, the toner is reliably fed into the image developing chamber frame 12 from the toner chamber frame 11.

The toner feeding member 9*b* is formed of a steel rod having a diameter of approximately 2 mm, and is in the form of a crank shaft. Referring to FIG. 20 which illustrates one end of the toner feeding member 9*b*, one 9*b*1 of the journals of the toner feeding member 9*b* is fitted in a hole 11*r* which is located in the toner chamber frame 11, adjacent to the opening 11*i* of the toner chamber frame 11. The other of the journals is fixed to the coupling member 11*e* (where the journal is fixed to the coupling member 11*e* is not visible in FIG. 20).

As described above, providing the bottom wall of the toner chamber frame section 11 with the outwardly bulging portion 11*g* as the sweeping space for the toner feeding member 9*b* makes it possible to provide the process cartridge B with stable toner feeding performance without cost increase.

Figure 22:
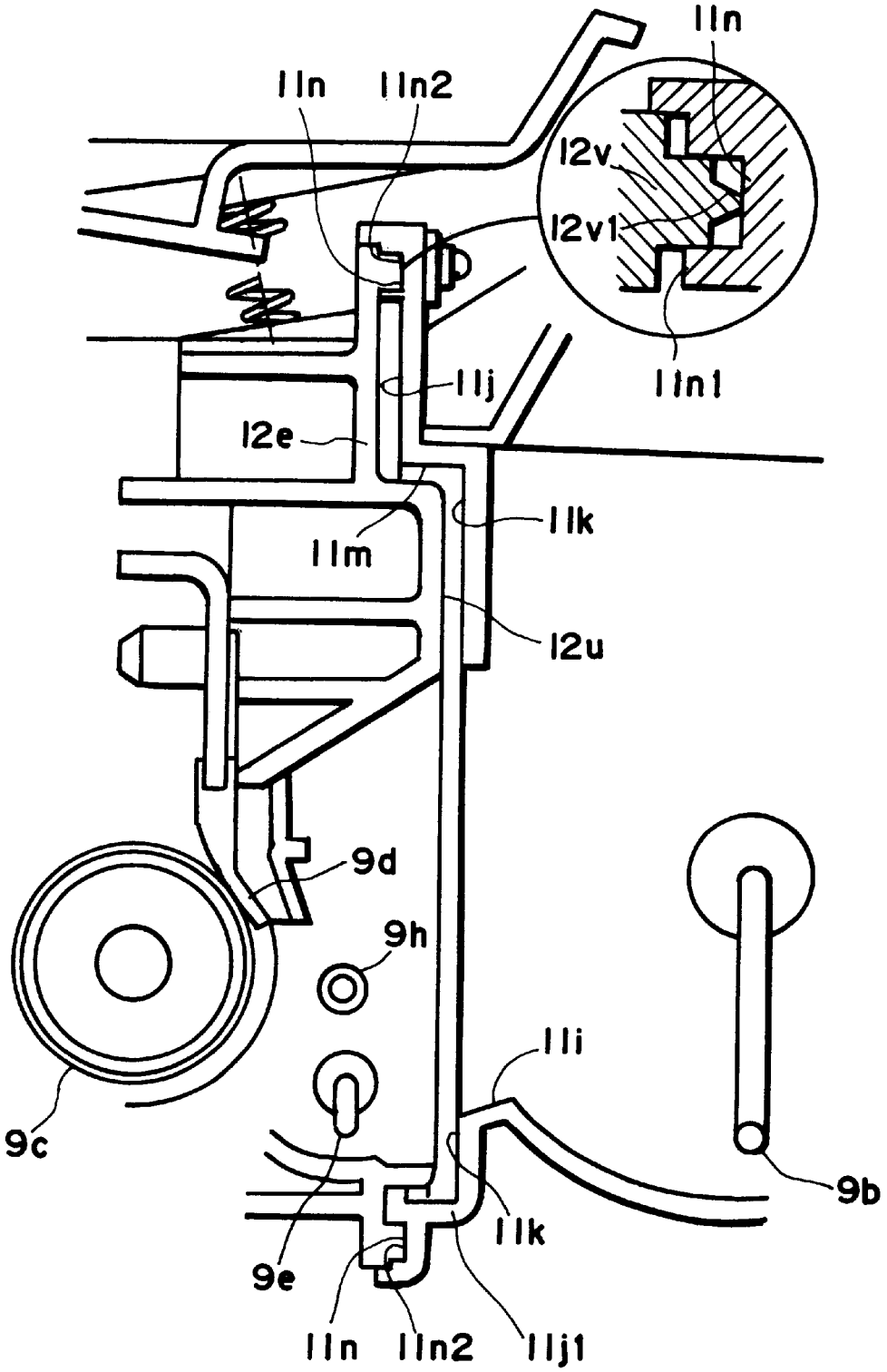
FIG. 22 is a vertical section of the toner seal portion illustrated in FIG. 21.
Figure 35:
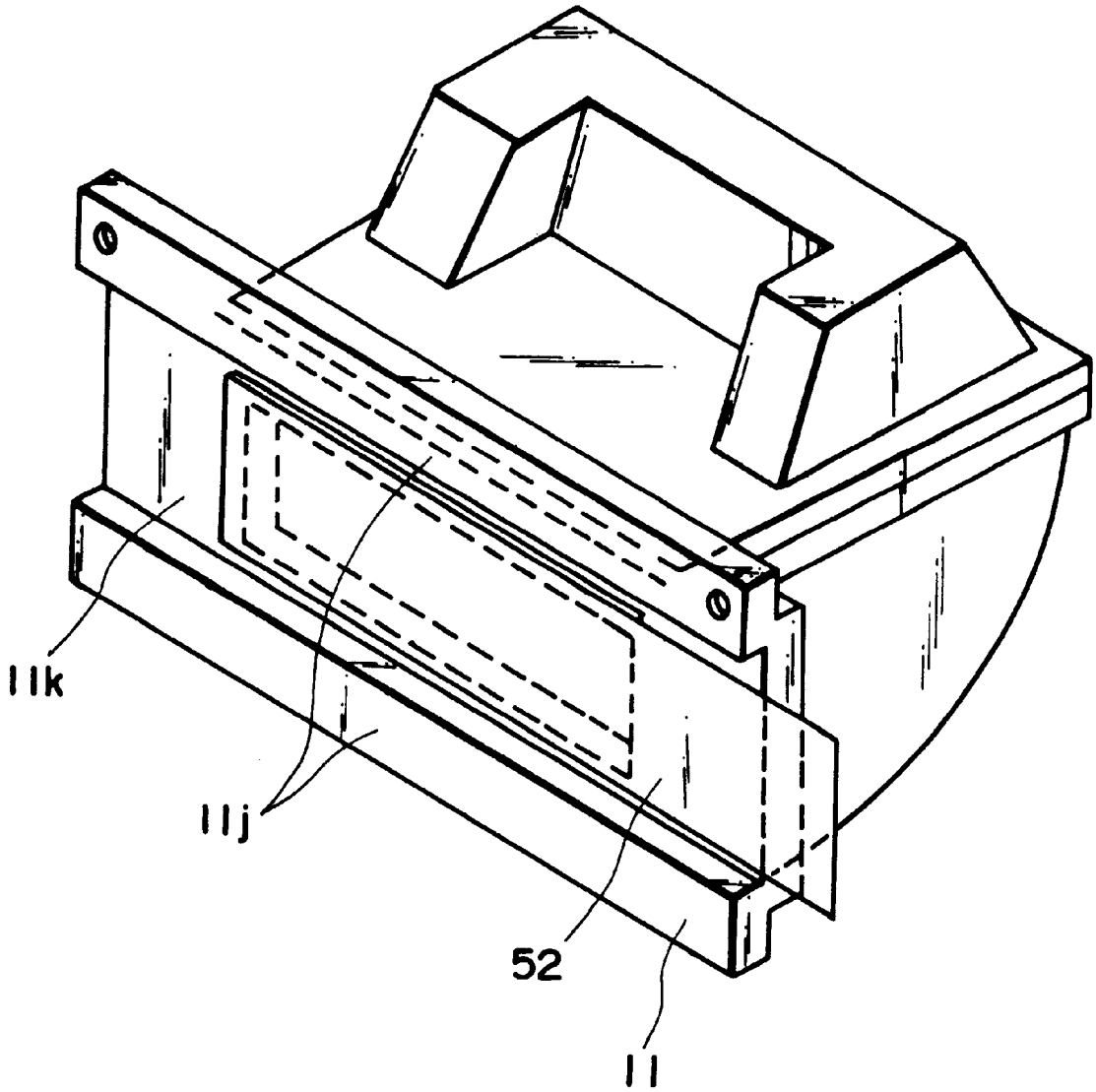
FIG. 35 is a perspective view of another embodiment of the present invention, showing the sealed state of the opening portion of the toner frame.

Referring to FIGS. 3, 20 and 22, the opening 11*i* through which toner is fed from the toner chamber frame section 11 into the development chamber frame section is located at the joint between the is toner chamber frame section 11 and the development chamber frame section 12. The opening 11*i* is surrounded by an recessed surface 11*k* which in turn is surrounded by the top and bottom portions 11*j* and 11*j*1 of the flange of the toner chamber frame 11. The lengthwise outer (top) edge of the top portion 11*j* and the lengthwise outer (bottom) edge of the bottom portion 11*j*1 are provided with grooves 11*n*, respectively, which are parallel to each other. The top portion 11*j* of the flange above the recessed surface 11*k* is in the form of a gate, and the surface of the bottom portion 11*j*1 of the flange is perpendicular to the surface of the recessed surface 11*k*. Referring to FIG. 22, the plane of the bottom surface 11*n*2 of the groove 11*n* is on the outward side (toward the image developing chamber frame 12) of the surface of the recessed surface 11*k*. However, the flange of the toner chamber frame 11 may be structured like the flange illustrated in FIG. 35 in which the top and bottom portion 11*j* of the flanges are in the same plane and surround the opening 11*i* like the top and bottom pieces of a picture frame.

VII. Connection Between Developing Frame 12 and Toner Frame 11

Referring to FIG. 19, an alphanumeric reference 12*u* designates one of the flat surfaces of the image developing chamber frame 12, which faces the toner chamber frame 11. The flange 12*e* which is parallel to the flat surface 12*u* and surrounds all four edges of this flat surface 12*u* like a picture frame is provided at a level slightly recessed from the flat surface 12*u*. The lengthwise edges of the flange 12*e* are provided with a tongue 12*v* which fit into the groove 11*n* of the toner chamber frame 11. The top surface of the tongue 12*v* is provided with an angular ridge 12*v*1 (FIG. 22) for ultrasonic welding. After the various components are assembled into the toner chamber frame 11 and image developing chamber frame 12, the tongue of the image developing chamber frame 12 is fitted into the groove 11*n* of the toner chamber frame 11, and the two frames 11 and 12 are welded together along the tongue 12*v* and groove 11*n* (detail will be given later).

Referring to FIG. 21, a cover film 51, which can be easily torn in the lengthwise direction of the process cartridge B, is pasted to the recessed surface 11*k* to seal the opening 11*i* of the toner chamber frame 11; it is pasted to the toner chamber frame 11, on the recessed surface 11*k*, alongside the four edges of the opening 11*i*. In order to unseal the opening 11*i* by tearing the cover film 51, the process cartridge B is provided with a tear tape 52, which is welded to the cover film 51. The cover tape 52 is doubled back from the lengthwise end 52*b* of the opening 11*i*, is put through between an elastic sealing member 54 such as a piece of felt (FIG. 19) and the opposing surface of the toner chamber frame 11, at the end opposite to the end 52*b*, and is slightly extended from the process cartridge B. The end portion 52*a* of the slightly sticking out tear tape 52 is adhered to a pull-tab 11*t* which is to be grasped with hand (FIGS. 6, 20 and 21). The pull-tab 11*t* is integrally formed with the toner chamber frame 11, wherein the joint portion between the pull-tab 11*t* and the toner chamber frame 11 is substantially thin so that the pull-tab 11*t* can be easily torn away from the toner chamber frame 11. The surface of the sealing member 54, except for the peripheral areas, is covered with a synthetic resin film tape 55 having a small friction coefficient. The tape 55 is pasted to the sealing member 54. Further, the flat surface 12*e* located at the other of the lengthwise end portions of the toner chamber frame 11, that is, the end portion opposite to the position where the elastic sealing member 54 is located, is covered with the elastic sealing member 56, which is pasted to the flat surface 12*e* (FIG. 19).

The elastic sealing members 54 and 56 are pasted on the flange 12*e*, at the corresponding lengthwise ends, across the entire width of the flange 12*e*. As the toner chamber frame 11 and the image developing chamber frame 12 are joined, the elastic sealing members 54 and 56 exactly cover the corresponding lengthwise end portions of the flange 11*j* surrounding the recessed surface 11*k*, across the entire width the flange 11*j*, overlapping with the tongue 12*v*.

Further, in order to precisely position the toner chamber frame 11 and the image developing chamber frame 12 relative to each other when they are joined, the flange 11*j* of the toner chamber frame 11 is provided with a round hole 11*r* and a square hole 11*q* which engage with the cylindrical dowel 12*w*1 and square dowel 12*w*2, respectively, of the image developing chamber frame 12. The round hole 11*r* tightly fits with the dowel 12*w*1, whereas the square hole 11*q* loosely fits with the dowel 12*w*2 in terms of the lengthwise direction while tightly fitting therewith in terms of the lengthwise direction.

The toner chamber frame 11 and the image developing chamber frame 12 are independently assembled as a compound component prior to a process in which they are united. Then, they are united in the following manner. First, the cylindrical positioning dowel 12*w*1 and square positioning dowel 12*w*2 of the image developing chamber frame 12 are fitted into the positioning round hole 11*r* and positioning square hole 11*q* of the toner chamber frame 11, and the tongue 12*v* of the image developing chamber frame 12 is placed in the groove 11*n* of the toner chamber frame 11. Then, the toner chamber frame 11 and the image developing chamber frame 12 are pressed toward each other. As a result, the sealing members 54 and 56 come in contact with, being thereby compressed by, the corresponding lengthwise end portions of the flange 11*j*, and at the same time, a rib-like projections 12*z*, which are located, as a spacer, at each lengthwise end of the flat surface 12*u* of the image developing chamber frame 12, are positioned close to the flange 11*j* of the toner chamber frame 11. The rib-like projection 12*z* is integrally formed with the image developing chamber frame 12, and is located at both sides, relative to the lengthwise direction, of the tear tape 52, so that the tear tape can be passed between the opposing projections 12*z*.

With the toner chamber frame 11 and the image developing chamber frame 12 being pressed toward each other as described above, ultrasonic vibration is applied between the tongue-like portion 12*v* and the groove 11*n*. As a result, the angular ridge 12*v*1 is melt by frictional heat and fuses with the bottom of the groove 11*n*. Consequently, the rim portion 11*n*1 of the groove 11*n* of the toner chamber frame 11 and the rib-like projection 12*z* of the image developing chamber frame 12 remain airtightly in contact with each other, leaving a space between the recessed surface 11*k* of the toner chamber frame 11 and the flat surface 12*u* of the image developing chamber frame 12. The aforementioned cover film 51 and tear tape 52 fit in this space.

In order to feed the toner stored in the toner chamber frame 11 into the image developing chamber frame 12, the opening 11*i* of the toner chamber frame 11 must be unsealed. This is accomplished in the following manner. First, the pull-tab 11*t* attached to the end portion 52*a* (FIG. 6) of the tear tape 52 extending from the process cartridge B is cut loose, or torn loose, from the toner chamber frame 11, and then, is pulled by the hand of an operator. This will tear the cover film 51 to unseal the opening 11*i*, enabling the toner to be fed from the toner chamber frame 11 into the image developing chamber frame 12. After the cover film 52 is pulled out of the process cartridge B, the lengthwise ends of the cartridge B are kept sealed by the elastic seals 54 and 56 which are located at the corresponding lengthwise ends of the flange 11*j* of the toner chamber frame 11. Since the elastic sealing members 54 and 56 are deformed (compressed) only in the direction of their thickness while maintaining their hexahedral shapes, they can keep the process cartridge sealed very effectively.

Since the side of the toner chamber frame 11, which face the image developing chamber frame 12, and the side of the image developing chamber frame 12, which faces the toner chamber frame 11, are structured as described above, the tear tape 52 can be smoothly pulled out from between the two frames 11 and 12 by simply applying to the tear tape 52 a force strong enough to tear the cover film 51.

As described above, when the toner chamber frame 11 and the image developing chamber frame 12 are united, a welding method employing ultrasonic is employed to generate frictional heat which melts the angular ridge 12*v*1. This frictional heat is liable to cause thermal stress in the toner chamber frame 11 and the image developing chamber frame 12, and these frames may become deformed due to the stress. However, according to this embodiment, the groove 11*n* of the toner chamber frame 11 and the tongue 12*v* of the image developing chamber frame 12 engage with each other across the almost entire length of theirs. In other words, as the two frames 11 and 12 are united, the welded portion and its adjacencies are reinforced, and therefore, the two frames are not likely to be deformed by the thermal stress.

As for the material for the toner chamber frame 11 and the image developing chamber frame 12, plastic material is used; for example, polystyrene, ABS resin (acrylonitrile-butadiene-styrene), polycarbonate, polyethylene, polypropylene, and the like.

Referring to FIG. 3, this drawing is a substantially vertical cross-section of the toner chamber frame 11 of the process cartridge B in this embodiment, and illustrates the interface between the toner chamber frame 11 and the image developing chamber frame 12, and its adjacencies.

VIII. Toner Container 11A

At this time, the toner chamber frame 11 of the process cartridge 2 in this embodiment will be described in more detail with reference to FIG. 3. The toner held in a toner container 11A is single component toner. In order to allow this toner to efficiently free fall toward the opening 11*i*, the toner chamber frame 11 is provided with slanted surfaces K and L, which extend across the entire length of the toner chamber frame 11. The slanted surface L is above the opening 11*i*, and the slanted surface K is in the rear of the toner chamber frame 11 as seen from the opening 11*i* (in the widthwise direction of the toner chamber frame 11). The slanted surfaces L and K are parts of the top and bottom pieces 11*a* and 11*b*, respectively, of the toner chamber frame 11. After the process cartridge B is installed in the apparatus main assembly 14, the slanted surface L faces diagonally downward, and the slanted surface K faces diagonally upward, an angle θ3 between the slanted surface K and the line m perpendicular to the interface between the toner chamber frame 11 and the image developing chamber frame 12 being approximately 20 deg.–40 deg. In other words, in this embodiment, the configuration of the top portion 11*a* of the toner chamber frame 11 is designed so that the slanted surfaces K and L hold the aforementioned angles, respectively, after the top and bottom portions 11*a* and 11*b* of the toner chamber frame 11 are united. This, according to this embodiment, the toner container 11A holding the toner is enabled to efficiently feed the toner toward the opening 11*i*.

Next, the image developing chamber frame will be described in detail.

IX. Image Developing Chamber Frame

Figure 14:
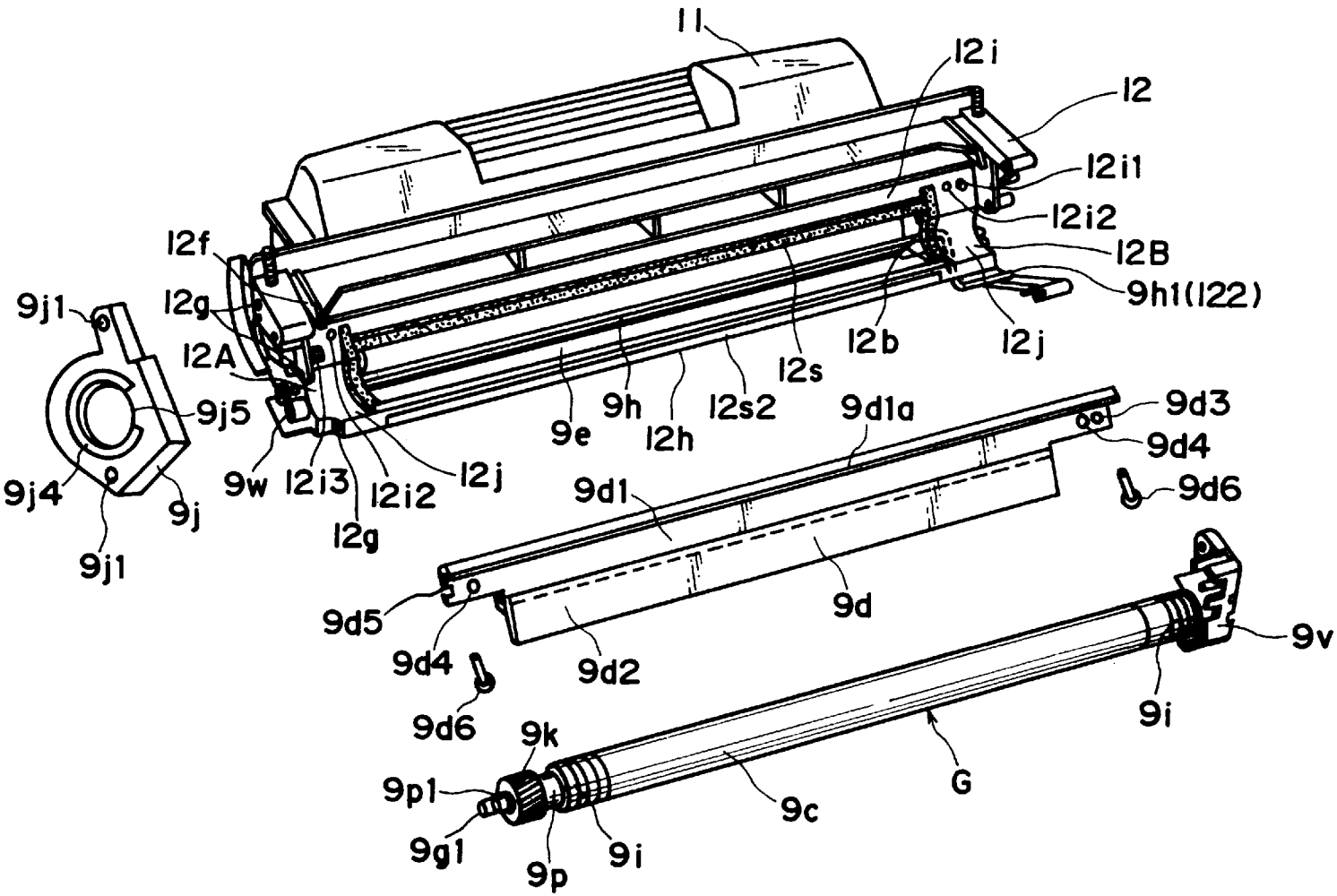
FIG. 14 is a perspective view of the developing unit illustrated in FIG. 13, which has been partially disassembled.
Figure 15:
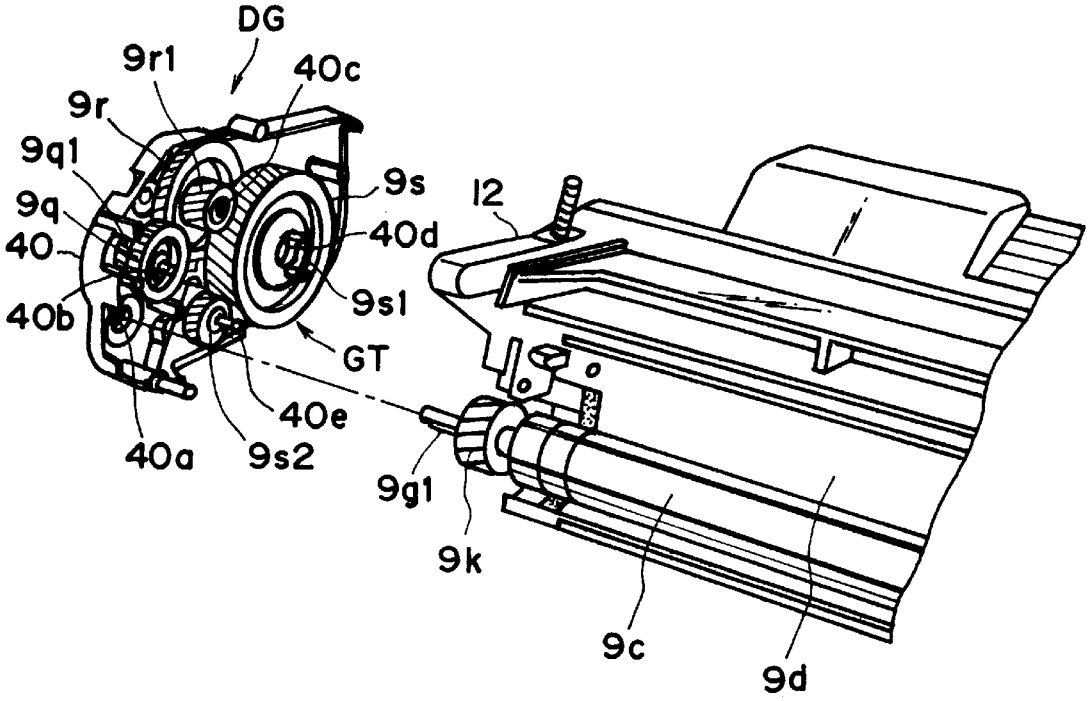
FIG. 15 is a perspective view of the back side of a developing means frame.
Figure 17:
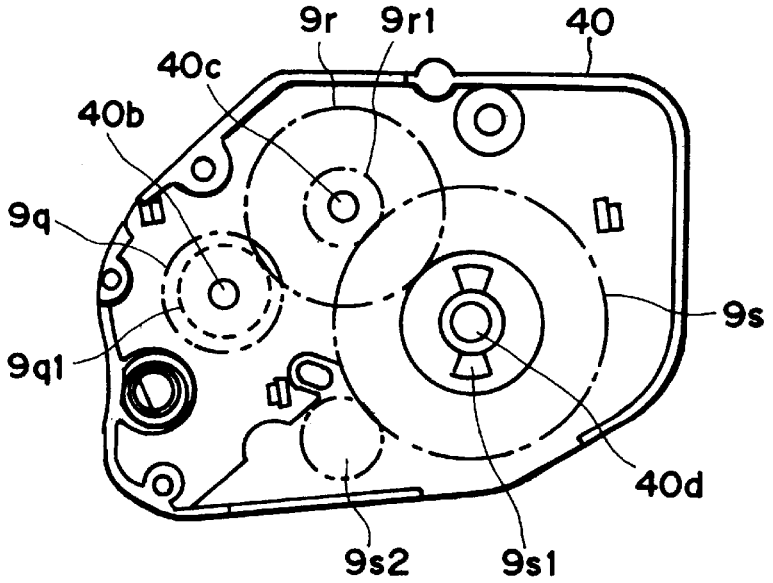
FIG. 17 is an internal plan view of one of the lateral ends of the process cartridge, showing the interior of the developing means frame illustrated in FIG. 15.
Figure 18:
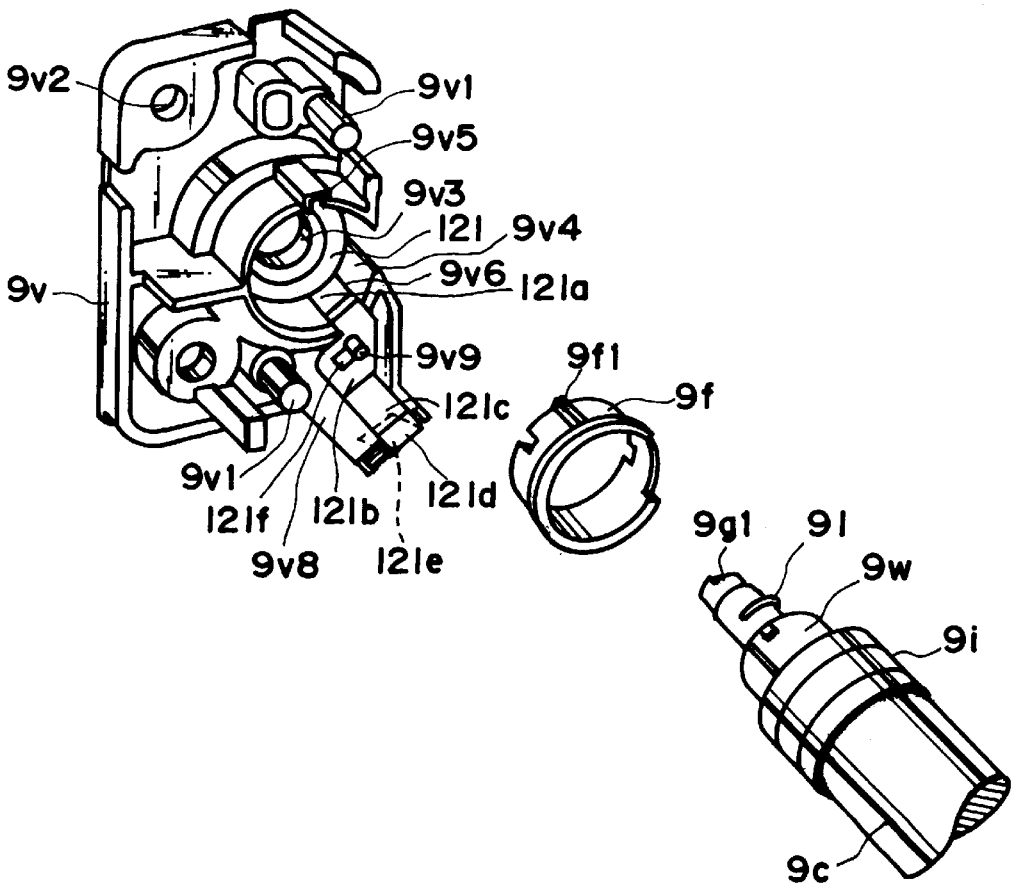
FIG. 18 is a perspective view of the bearing box for the development roller.

The image developing chamber frame or developing frame 12 of the process cartridge B will be described with reference to FIGS. 3, 14, 15, 16, 17, and 18. FIG. 14 is a perspective view depicting the way various components are assembled into the image developing chamber frame 12; FIG. 15, a perspective view depicting the way a developing station driving force transmitting unit DG is assembled into the image developing chamber frame 12; FIG. 16, a side view of the development unit before the driving force transmitting unit DG is attached; FIG. 17, a side view of the developing station driving force transmitting unit DG as seen from inside the image developing chamber frame 12; and FIG. 18 is a perspective view of the bearing box as seen from inside.

As described before, the developing roller 9*c*, the developing blade 9*d*, the toner stirring member 9*e*, and the rod antenna 9*h* for detecting the toner remainder, are assembled into the image developing chamber frame 12.

Referring to FIG. 14, the developing blade 9*d* comprises an approximately 1–2 mm thick metallic plate 9*d*1, and an urethane rubber 9*d*2 glued to the metallic plate 9*d*1 with the use of hot melt glue, double-side adhesive tape, or the like. It regulates the amount of the toner to be carried on the peripheral surface of the developing roller 9*c* as the urethane rubber 9*d*2 is placed in contact with the generatrix of the developing roller 9*c*. Both the lengthwise ends of the blade mounting reference flat surface 12*i*, as a blade mount, of the image developing chamber frame 12, are provided with a dowel 12*i*1, a square projection 12*i*3, and a screw hole 12*i*2. The dowel 12*i*1 and the projection 12*i*3 are fitted in a hole 9*d*3 and a notch 9*d*5, respectively, of the metallic plate 9*d*1. Then, a small screw 9*d*6 is put through a screw hole 9*d*4 of the metallic plate 9*d*1, and is screwed into the aforementioned screw hole 12*i*2 with female threads, to fix the metallic plate 9*d*1 to the flat surface 12*i*. In order to prevent toner from leaking out, an elastic sealing member 12*s* formed of MOLTPLANE, or the like, is pasted to the image developing chamber frame 12, along the lengthwise top edge of the metallic plate 9*d*1. Also, an elastic sealing member 12*s*1 is pasted to the toner chamber frame 11, along the edge 12*j* of the curved bottom wall portion which accommodates the developing roller 9*c*, starting from each lengthwise end of the elastic sealing member 12*s*. Further, a thin elastic sealing member 12*s*2 is pasted to the image developing chamber frame 12, along a mandible-like portion 12*h*, in contact with the generatrix of the developing roller 9*c*.

The metallic plate 9*d*1 of the developing blade 9*d* is bent 90 deg. on the side opposite to the urethane rubber 9*d*2, forming a bent portion 9*d*1*a*.

Next, referring to FIGS. 14 and 18, the image developing roller unit G will be described. The image developing roller unit G comprises as a unit: (1) image developing roller 9*c*; (2) spacer roller 9*i* for keeping constant the distance between the peripheral surfaces of the developing roller 9*c* and the photosensitive drum 7, being formed of electrically insulative synthetic resin and doubling a sleeve cap which covers the developing roller 9*c* at each lengthwise end to prevent electrical leak between the aluminum cylinder portions of the photosensitive drum 7 and the developing roller 9*c*; (3) developing roller bearing 9*j* (illustrated in enlargement in FIG. 14); (4) developing roller gear 9*k* (helical gear) which receives driving force from a helical drum gear 7*b* attached to the photosensitive drum 7 and rotates the developing roller 9*c*; (5) a coil spring, type contact 91, one end of which is in contact with one end of the developing roller 9*c* (FIG. 18); and (6) a magnet which is contained in the developing roller 9*c* to adhere the toner onto the peripheral surface of the developing roller 9*c*. In FIG. 14, the bearing box 9*v* has been already attached to the developing roller unit G. However, in some cases, the developing roller unit G is first disposed between the side plates 12A and 12B of the image developing chamber frame 12, and then is united with the bearing box 9*v* when the bearing box 9*v* is attached to the image developing chamber frame 12.

Figure 31:
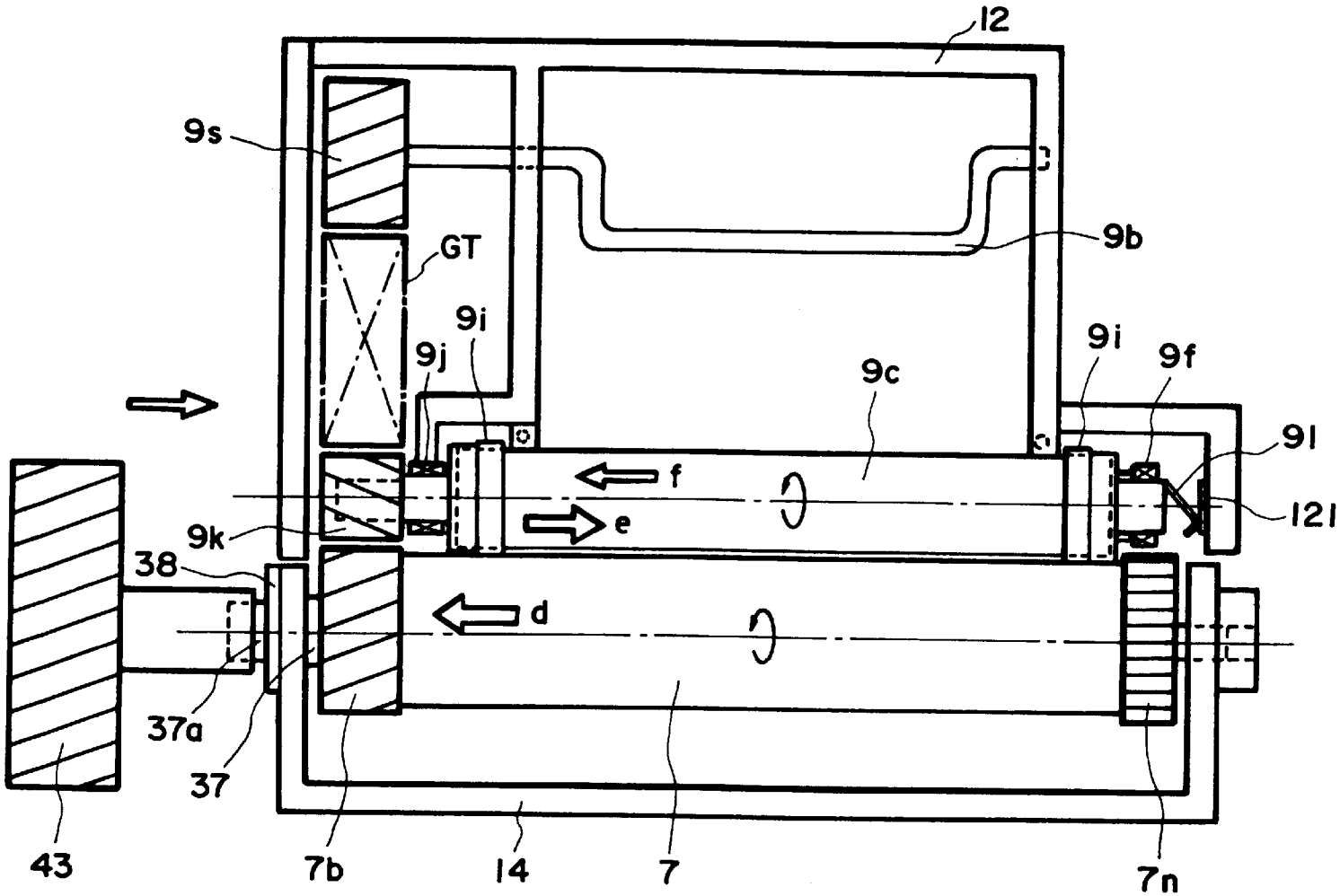
FIG. 31 is a schematic plan view of the process cartridge in the main assembly of the electrophotographic image forming apparatus, and the areas adjacent thereto, depicting the relationship among the various thrusting forces generated as the process cartridge is installed in the main assembly of the electrophotographic image forming apparatus.

Referring again to FIG. 14, in the developing roller unit G. the developing roller 9*c* is rigidly fitted with a metallic flange 9*p* at one lengthwise end. This flange 9*p* has a developing roller gear shaft portion 9*p*1 which extends outward in the lengthwise direction of the developing roller 9*c*. The developing roller gear shaft portion 9*p*1 has a flattened portion, with which the developing roller gear 9*k* mounted on the developing gear shaft portion 9*p*1 is engaged, being prevented from rotating on the developing roller gear shaft portion 9*p*1. The developing roller gear 9*k* is a helical gear, and its teeth are angled so that the thrust generated by the rotation of the helical gear is directed toward the center of the developing roller 9*c* (FIG. 31). One end of the shaft of the magnet 9*g,* which is shaped to give it a D-shaped cross-section, projects outward through the flange 9*p,* and engages with the developing means gear holder 40 to be nonrotatively supported. The aforementioned developing roller bearing 9*j* is provided with a round hole having a rotation preventing projection 9*j*5 which projects into the hole, and in this round hole, the C-shaped bearing 9*j*4 perfectly fits. The flange 9*p* rotatively fits in the bearing 9*j*4. The developing roller bearing 9*j* is fitted into a slit 12*f* of the image developing chamber frame 12, and is supported there as the developing means gear holder 40 is fixed to the image developing chamber frame 12 by putting the projections 40*g* of the developing means gear holder 40 through the corresponding holes 9*j*1 of the developing roller gear bearing 9*j,* and then inserting them in the corresponding holes 12*g* of the image developing chamber frame 12. The bearing 9*j*4 in this embodiment has a C-shaped flange. However, there will be no problem even if the cross-section of the actual bearing portion of the bearing 9*j*4 is C-shaped. The aforementioned hole of the development roller bearing 9*j,* in which the bearing 9*j*1 fits, has a step. In other words, it is consisted of a large diameter portion and a small diameter portion, and the rotation preventing projection 9*j*5 is projecting from the wall of the large diameter portion in which the flange of the bearing 9*j*4 fit. The material for the bearing 9*j,* and the bearing 9*f* which will be described later, is polyacetal, polyamide, or the like.

Although substantially encased in the developing roller 9*c,* the magnet 9*g* extends from the developing roller 9*c* at both lengthwise ends, and is fitted in a D-shaped supporting hole 9*v*3 of the developing roller bearing box 9*v* illustrated in FIG. 18, at the end 9*g*1 having the D-shaped cross-section. In FIG. 18, the D-shaped supporting hole 9*v*3, which is located in the top portion of the developing roller bearing box 9*v,* is not visible. At one end of the developing roller 9*c,* a hollow journal 9*w* formed of electrically insulative material is immovably fitted within the developing roller 9*c,* in contact with the internal peripheral surface. A cylindrical portion 9*w*1 which is integral with the journal 9*w* and has a smaller diameter than the journal 9*w* electrically insulates the magnet 9*g* from a coil spring type contact 91 which is electrically in contact with the developing roller 9*c*. The bearing 9*f* with the aforementioned flange is formed of electrically insulative synthetic resin, and fits in the bearing accommodating hole 9*v*4 which is coaxial with the aforementioned magnet supporting hole 9*v*3. A key portion 9*f*1 integrally formed with the bearing 9*f* fits in a key groove 9*v*5 of the bearing accommodating hole 9*v*4, preventing the bearing 9*f* from rotating.

As shown in FIG. 18, the bearing accommodating hole 9*v*4 has a bottom, and on this bottom, a doughnut-shaped development bias contact 121 is disposed. As the developing roller 9*c* is assembled into the developing roller bearing box 9*v,* the metallic coil spring type contact 91 comes in contact with this doughnut-shaped development bias contact 121, and is compressed, establishing thereby electrical connection. The doughnut-shaped development bias contact 121 has a lead which comprises: a first portion 121*a* which perpendicularly extends from the outer periphery of the doughnut-shaped portion, fitting in the recessed portion 9*v*6 of the bearing accommodating hole 9*v*4, and runs along the exterior wall of the bearing 9*f* up to the cutaway portion located at the edge of the bearing accommodating hole 9*v*4; a second portion 121*b* which runs from the cutaway portion, being bent outward at the cutaway portion; a third portion 121*c* which is bent from the second portion 121*b;* a fourth portion 121*d* which is bent from the third portion 121*c* in the outward, or radial, direction of the developing roller 9*c;* and an external contact portion 121*e* which is bent from the fourth portion 121*d* in the same direction. In order to support the development bias contact 121 having the above described shape, the developing roller bearing box 9*v* is provided with a supporting portion 9*v*8, which projects inward in the lengthwise direction of the developing roller 9*c*. The supporting portion 9*v*8 is in contact with the third and fourth portion 121*c* and 121*d,* and the external contact portion 121*e,* of the lead of the development bias contact 121. The second portion 121*b* is provided with an anchoring hole 121*f,* into which a dowel 9*v*9 projecting inward from the inward facing wall of the developing roller bearing box 9*v* in the lengthwise direction of the developing roller 9*c* is pressed. The external contact portion 121*e* of the development bias contact 121 comes in contact with the development bias contact member 125 of the apparatus main assembly 14 as the process cartridge B is installed in the apparatus main assembly 14, so that development bias is applied to the developing roller 9*c*. The development bias contact member 125 will be described later.

In order to fix the developing roller bearing box 9*v* to the developing frame 12, two cylindrical projections 9*v*1 of the developing roller bearing box 9*v* are fitted into the corresponding holes 12*m* of the image developing chamber frame 12, which are provided at the lengthwise end as illustrated in FIG. 19. as a result, the developing roller gearing box 9*v* is precisely positioned on the image developing chamber frame 12. Then, an unillustrated small screw is put through each screw hole of the developing roller bearing box 9*v,* and then is screwed into the female-threaded screw hole 12*c* of the image developing chamber frame 12 to fix the developing roller bearing box 9*v* to the image developing chamber frame 12.

As is evident from the above description, in this embodiment, in order to mount the developing roller 9*c* in the image developing chamber frame 12, the developing roller unit G is assembled first, and then, the assembled developing roller unit G is attached to the image developing chamber frame 12.

The developing roller unit G is assembled following the steps described below. First, the magnet 9*g* is put through the developing roller 9*c* fitted with the flange 9*p,* and the journal 9*w* and the coil spring type contact 91 for development bias are attached to the end of the developing roller 9*c*. Thereafter, the spacer roller 9*i* and the developing roller bearing 9*j* are fitted around each lengthwise end portion of the developing roller 9*c,* the developing roller bearing 9*j* being on the outer side relative to the lengthwise direction of the developing roller 9*c*. Then, the developing roller gear 9*k* is mounted on the developing roller gear shaft portion 9*p*1 located at the end of the developing roller 9*c*. It should be noted here that the lengthwise end 9*g*1 of the magnet 9*g,* which has a D-shaped cross-section, projects from the developing roller 9*c,* on the side where the developing roller 9*k* is attached; it projects from the end of the cylindrical portion 9*w*1 of the hollow journal 9*w*.

In FIG. 19, designated by 12*p* is an opening extended along the length of the developing frame 12. The opening 12*p* is faced to the opening 11*i* of the toner frame 11 when the toner frame and the developing frame 12 are coupled with each other. Thus, the toner contained in the toner frame 11 can be supplied to the developing roller 9*c*. Along the entire longitudinal width of the opening 12*p*, the toner stirring member 9*e* and a antenna rod 9*h* are provided.

Next, the rod antenna 9*h* for detecting the toner remainder will be described. Referring to FIGS. 14 and 19, one end of the rod antenna 19*h* is bent like that of a crank shaft, wherein the portion comparable to the arm portion of the crank shaft constitutes a contact portion 9*h*1 (toner remainder detecting contact 122), and must be electrically in contact with the toner detecting contact member 126 attached to the apparatus main assembly 14. The toner detection contact member 126 will be described later. In order to mount the rod antenna 9*h* in the image developing chamber frame 12, the rod antenna 9*h* is first inserted into the image developing chamber frame 12 through a through hole 12*b* of a side plate 12B of the image developing chamber frame 12, and the end which is put through the hole 12*b* first is placed in an unillustrated hole of the opposite side plate of the image developing chamber frame 12, so that the rod antenna 9*h* is supported by the side plate. In other words, the rod antenna 9*h* is properly positioned by the through hole 12*b* and the unillustrated hole on the opposite side. In order to prevent toner from invading the through hole 12*b*, an unillustrated sealing member (for example, a ring formed of synthetic resin, a piece of felt or sponge, or the like) is insert in the through hole 12*b*.

As the developing roller gear box 9*v* is attached to the image developing chamber frame 12, the contact portion 9*h*1 of the rod antenna 9*h*, that is, the port-on comparable to the arm portion of a crank shaft, is positioned so that the rod antenna 9*h* is prevented from moving or coming out of the image developing chamber frame 12.

After the toner chamber frame 11 and the image developing chamber frame 12 are united, the side plate 12A of the image developing chamber frame 12, through which the rod antenna 9*h* is inserted, overlaps with the side plate of the toner chamber frame 11, partially covering the toner sealing cap 11*f* of the bottom portion 11*b* of the toner chamber frame 11. Referring to FIG. 16, the side plate 12A is provided with a hole 12*x*, and a shaft fitting portion 9*s*1 (FIG. 15) of the toner feeding gear 9*s* for transmitting driving force to the toner feeding member 9*b* is put through this hole 12*x*. The shaft fitting portion 9*s*1 is a part of the toner feeding gear 9*s*, and is coupled with the coupling member lie (FIGS. 16 and 20) to transmits driving force to the toner feeding member 9*b*. As described before, the coupling member 11*e* is engaged with one of the lengthwise ends of the toner feeding member 9*b* and is rotatively supported by the toner chamber frame 11.

Referring to FIG. 19, in the image developing chamber frame 12, the toner stirring member 9*e* is rotatively supported in parallel to the rod antenna 9*h*. The toner stirring member 9*e* is also shaped like a crank shaft. One of the crank shaft journal equivalent portions of the toner stirring member 9*e* is fitted in a bearing hole (unillustrated) of the side plate 12B, whereas the other is fitted with the toner stirring gear 9*m* which has a shaft portion rotatively supported by the side plate 12A illustrated in FIG. 16. The crank arm equivalent portion of the toner stirring member 9*c* is fitted in the notch of the shaft portion of the toner stirring gear 9*m* so that the rotation of the toner stirring gear 9*m* is transmitted to the toner stirring member 9*e*.

X. Drive Transmission to Developing Unit D

Next, transmission of driving force to the image developing unit D will be described.

Referring to FIG. 15, the shaft 9*g*1 of the magnet 9*g*, which has the D-shaped cross-section, engages with a magnet supporting hole 40*a* of the image developing means gear holder 40. As a result, the magnet 9*g* is nonrotatively supported. As the image developing mean gear holder 40 is attached to the image developing chamber frame 12, the developing roller gear g*k* meshes with a gear 9*q* of a gear train GT, and the toner stirring gear 9*m* meshes with a small gear 9*s*2. Thus, the toner feeding gear 9*s* and the toner stirring gear 9*m* are enabled to receive the driving force transmitted from the developing roller gear 9*k*.

All the gears from the gear 9*q* to the toner gear 9*s* are idler gears. The gear 9*q* which meshes with the developing roller gear 9*k*, and a small gear which is integral with the gear 9*q*, are rotatively supported on a dowel 40*b* which is integral with the image developing means gear holder 40. A large gear 9*r* which engages with the small gear 9*q*1, and a small gear 9*r*1 which is integral with the gear 9*r*, are rotatively supported on the dowel 40*c* which is integral with the image developing means gear holder 40. The small gear 9*r*1 engages with the toner feeding gear 9*s*. The toner feeding gear 9*s* is rotatively supported an a dowel 40*d* which is a part of the image developing means gear holder 40. The toner feeding gear 9*s* has the shaft fitting portion 9*s*1. The toner feeding gear 9*s* engages with a small gear 9*s*2. The small gear 9*s*2 is rotatively supported an a dowel 40*e* which is a part of the image developing means gear holder 40. The dowels 40*b*, 40*c*, 40*d*, and 40*e* have a diameter of approximately 5–6 mm, and support the corresponding gears of the gear train GT.

With the provision of the above described structure, the gears which constitute the gear train can be supported by a single component (image developing means gear holder 40). Therefore, when assembling the process cartridge B, the gear train GT can be partially preassembled onto the image developing means gear holder 40; compound components can be preassembled to simplify the main assembly process. In other words, first, the rod antenna 9*h*, and the toner stirring member 9*e* are assembled into the image developing chamber frame 12, and then, the developing roller unit G and the gear box 9*v* are assembled into the developing station driving force transmission unit DG and the image developing chamber frame 12, respectively, completing the image developing unit D.

The materials suitable for the image developing chamber frame 12 is the same as the aforementioned materials suitable for the toner chamber frame 11.

XI. Structure of Electrical Contact

Next, referring to FIGS. 8, 9, 11, 23 and 30, connection and positioning of the contacts which establish electrical connection between the process cartridge B and the image forming apparatus main assembly 14 as the former is installed into the latter will be described.

Referring to FIG. 8. the process cartridge B has a plurality of electrical contacts: (1) cylindrical guide 13*a*L as an electrically conductive contact placed in contact with the photosensitive drum 7 to ground the photosensitive drum 7 through the apparatus main assembly 14 (actual ground contact is the end surface of the cylindrical guide 13*a*L; it is designated by a numerical reference 119 when referred to as an electrically conductive grounding contact); (2) electrically conductive charge bias contact 120 electrically connected to the charging roller shaft 8*a* to apply charge bias to the charging roller 8 from the apparatus main assembly 14; (3) electrically conductive development bias contact 121 electrically connected to the developing roller 9*c* to apply development bias to the developing roller 9*c* from the apparatus main assembly 14; (4) electrically conductive toner remainder detecting contact 122 electrically connected to the rod antenna 9*h* to detect the toner remainder. These four contacts 119–122 are exposed from the side or bottom wall of the cartridge frame. More specifically, they all are disposed so as to be exposed from the left wall or bottom wall of the cartridge frame, as seen from the direction from which the process cartridge B is installed, being separated from each other by a predetermined distance sufficient to prevent electrical leak. The grounding contact 119 and the charge bias contact 121 belong to the cleaning unit C, and the development bias contact 121 and the toner remainder detection contact 122 belong to the image developing chamber frame 12. The toner remainder detection contact 122 doubles as a process cartridge detection contact through which the apparatus main assembly 14 detects whether or not the process cartridge B has been installed in the apparatus main assembly 14.

Referring to FIG. 11, the grounding contact 119 is a part of the flange 29 formed of electrically conductive material as described before. Therefore, the photosensitive drum 7 is grounded through a grounding plate 7*f* electrically in connection with the drum portion 7*d* of the photosensitive drum 7, the drum shaft 7*a* which is integral with the flange 29 and the cylindrical guide 13*a*L and is in contact with the grounding plate 7*f,* and the grounding contact 119 which is the end surface of the cylindrical guide 13*a*L. The flange 29 in this embodiment is formed of metallic material such as steel. The charge bias contact 120 and the development bias contact 121 are formed of approximately 0.1–0.3 mm thick electrically conductive metallic plate (for example, stainless steel plate and phosphor bronze plate), and are laid (extended) along the internal surface of the process cartridge. The charge bias contact 120 is exposed from the bottom wall of the cleaning unit C, on the side opposite to the side from which the process cartridge B is driven. The development bias contact 121 and the toner remainder detection contact 122 are exposed from the bottom wall of the image developing unit D, also on the side opposite to the side from which the process cartridge B is driven.

This embodiment will be described further in detail.

As described above, in this embodiment, the helical drum gear 7*b* is provided at one of the axial ends of the photosensitive drum 7 as illustrated in FIG. 11. The drum gear 7*b* engages with the developing roller gear 9*k* to rotate the developing roller 9*c*. As it rotates, it generates thrust in the direction (indicated in an arrow mark d in FIG. 11). This thrust pushes the photosensitive drum 7, which is disposed in the cleaning chamber frame 13 with a slight play in the longitudinal direction, toward the side on which the drum gear 7*b* is mounted. Further, the reactive force, which is generated as the grounding plate 7*f* fixed to the spur gear 7*n* is pressed against the drum shaft 7*a,* adds to the thrust, in the direction of the arrow mark d. As a result, the outward edge 7*b*1 of the drum gear 7*b* remains in contact with the surface of the inward end of the bearing 38 fixed to the cleaning chamber frame 13. Thus, the position of the photosensitive drum 7 relative to the process cartridge B in the axial direction of the photosensitive drum 7 is regulated. The grounding contact 119 is exposed from the side plate 13*k* of the cleaning chamber frame 13. The drum shaft 7*a* extends into the base drum 7*d* (aluminum drum in this embodiment) coated with a photosensitive layer 7*e,* along the axial line. The base drum 7*d* and the drum shaft 7*a* are electrically connected through the internal peripheral surface 7*d*1 of the base drum 7*d* and the grounding plate 7*f* in contact with the end surface 7*a*1 of the drum shaft 7*a*.

Figure 23:
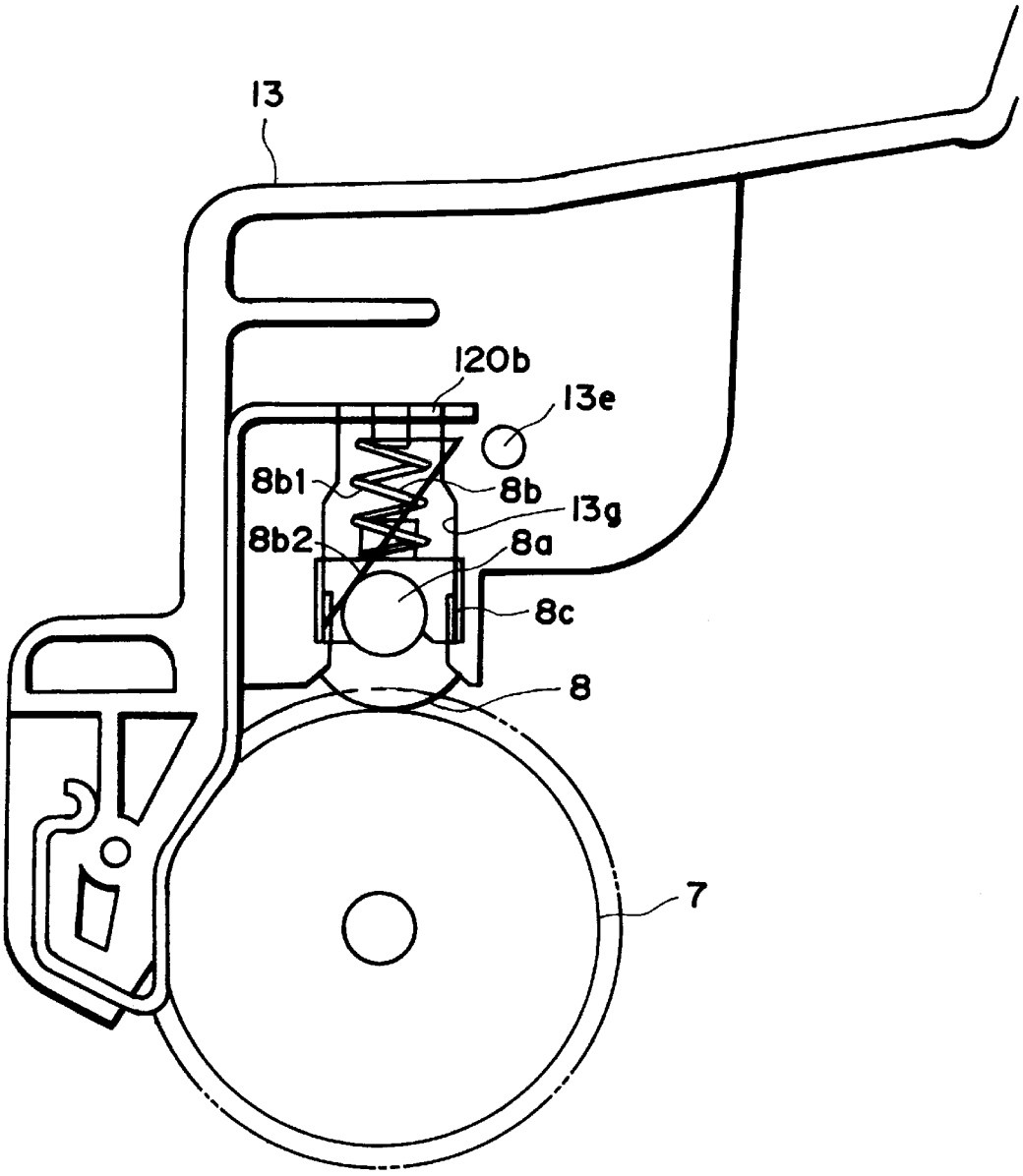
FIG. 23 is a vertical section of the structure which supports the charge roller section.
Figure 24:
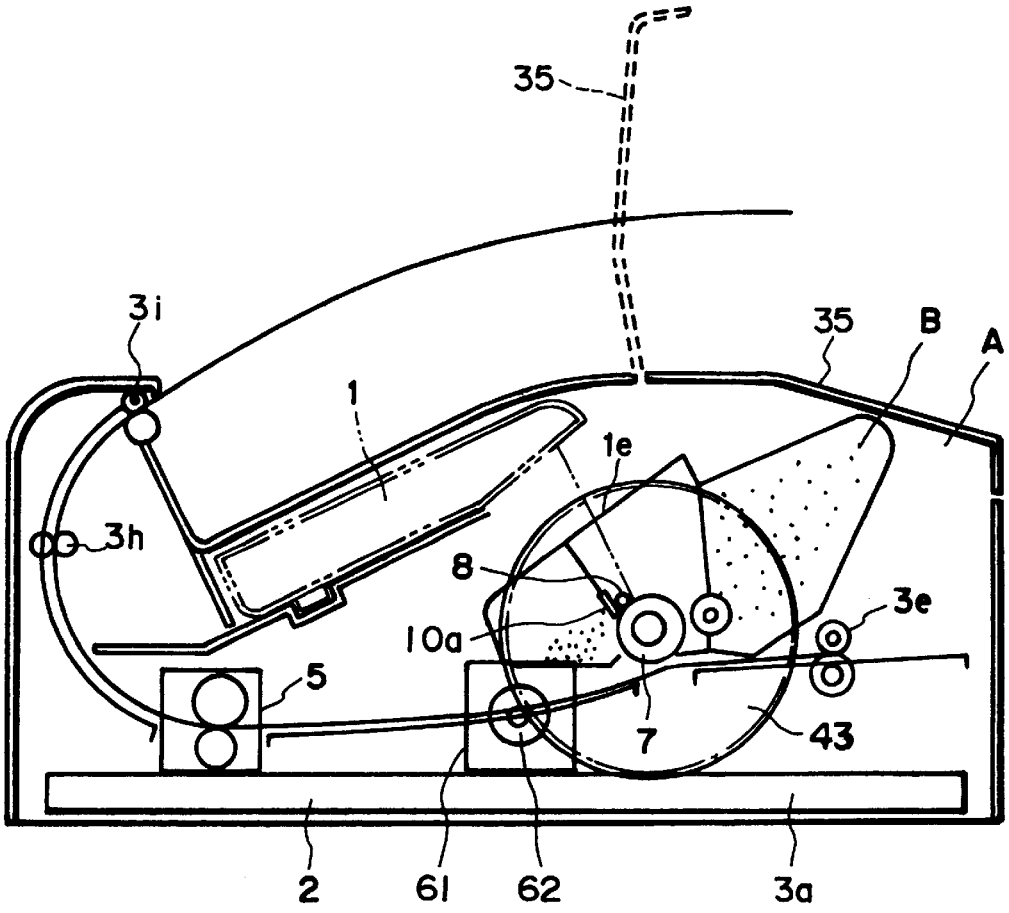
FIG. 24 is a schematic vertical section of the driving system of the main assembly of the image forming apparatus.

The charge bias contact 120 is attached to the cleaning chamber frame 13, adjacent to where the charging roller 8 is supported (FIG. 8). Referring to FIG. 23, the charge bias contact 120 is electrically in contact with the shaft 8*a* of the charging roller 8 by way of a compound spring 8*b* which is in contact with the charge roller shaft 8*a*. This compound spring 8*b* is constituted of a compression spring portion 8*b*1 and an internal contact portion 8*b*2. The compression coil portion 8*b*1 is placed between the spring seat 120*b* and a charging roller bearing 8*c*. The internal contact portion 8*b*2 extends from the spring seat side end of the compression spring portion 8*b*1 and presses on the charge roller shaft 8*a*. The charging roller bearing 8*c* is slidably fitted in a guide groove 13*g,* and the spring seat 120*b* is located at the closed end of the guiding groove 13*g*. The guide groove 13*g* extends in the direction of an imaginary line which runs through the centers of the cross-sections of the charging roller 8 and photosensitive drum 7, the center line of the guiding groove 13*g* substantially coinciding with this imaginary line. Referring to FIG. 23, the charge bias contact 120 enters the cleaning chamber frame 13 at the location where it is exposed, runs along the internal wall of the cleaning chamber frame 13, bends in the direction which intersects with the direction in which the charge roller shaft 8*a* of the charging roller 8 is moved, and ends at the spring seat 120*b*.

Next, the development bias contact 121 and the toner remainder detection contact 122 will be described. Both contacts 121 and 122 are disposed on the bottom surface (surface of the image developing unit D, which faces downward when the process cartridge B is in the apparatus main assembly 14) of the image developing unit D, on the same side as the side plate 13*k* of the cleaning chamber frame 13. The aforementioned third portion 121*e* of the development contact 121, that is, the portion exposed from the image developing unit D, is disposed so as to oppose the charge bias contact 120 across the spur gear 7*n*. As described previously, the development bias contact 121 is electrically in contact with the developing roller 9*c* through the coil spring type contact 91 which is electrically in contact with the lengthwise end of the developing roller 9*c* (FIG. 18).

FIG. 31 schematically depicts the relationships between the various thrusts which work on a drum gear 7*b* and a development roller gear 9*k,* and a development bias contact point 121. As described before, as the photosensitive drum 7 is driven, it shifts in the direction of an arrow mark d in FIG. 31. As a result, the end surface of the drum gear 7*b* comes in contact with the unillustrated end surface of a bearing 38, fixing the position of the photosensitive drum 7 in terms of its longitudinal direction. Meanwhile, the development roller gear 9*k* meshed with the drum gear 7*b* is thrust in a direction e, which is opposite to the direction of the arrow d, being forced to press a development bias contact 91 in the form of a spring, which is pressing a development bias contact 121. Consequently, the pressure generated in the direction indicated by an arrow mark f, between the development roller 9*c* and the development roller bearing 9*j* by the development bias contact 91 in the form of a coil spring, is reduced. This arrangement assures that the development bias contact 91 and the development bias contact 121 remain desirably in contact with each other, and yet, the friction between the end surface of the development roller 9*c* and the end surface of the development roller bearing 9*j* is kept at a moderate level so that the development roller 9*c* is allowed to smoothly rotate.

Referring to FIG. 8, a referential FIG. 122 is a contact point 122 for detecting the amount of the remaining toner. It is exposed from the developing means frame 12, being on the upstream side of the development bias contact 121 in terms of the cartridge installation direction (direction indicated by an arrow mark X in FIG. 9). Referring to FIG. 19, the toner amount detection contact point 122 is on the toner frame 11 side relative to the development roller 9*c,* and is a part of a rod antenna 9*h,* which is formed of electrically conductive material, for example, metallic material, being extended from the developing means frame 12 in parallel to the longitudinal direction of the development roller 9*c.* As described before, the rod antenna 9*h* extends across the entire length of the development roller 9*c,* maintaining a predetermined distance from the development roller 9*c.* It comes in contact with the toner detection contact member 126 as the process cartridge B is installed in the apparatus main assembly 14. The capacitance between the rod antenna 9*h* and of the development roller 9*c* changes in response to the amount of the toner present between the two, and the change in this capacitance can be detected as the change in electrical potential. Thus, the amount of the remaining toner is determined by a control section (unillustrated) which is electrically connected to the toner detection contact member 126 of the apparatus main assembly 14 to detect the change in this capacitance.

The amount of the "remaining toner" means the amount of the toner which is present between the development roller 9*c* and the rod antenna 9*h,* and affects the capacitance between the two members. Thus, whether the amount of the toner remaining in the toner container 11A has been reduced to a predetermined level or not can be determined by detecting the capacitance between the development roller 9*c* and the rod antenna 9*h;* as the control section of the apparatus main assembly 14 detects, through the toner amount detection contact 122, that the capacitance has reached the predetermined first value, it determines that the amount of the remaining toner in the toner container 11A has been reduced to a predetermined level. As the control section of the apparatus main assembly 14 detects that the capacitance has reached the predetermined first value, it alerts the user that it is time for exchanging the process cartridge B; it flashes a lamp, sounds a buzzer, and the like. Further, as the control section detects that the capacitance has reached the predetermined second value, which is smaller than the first value, it determines that a fresh process cartridge B has been installed in the main assembly 14. The control section does not allow the apparatus main assembly 14 to start an image formation operation unless it determines that a process cartridge B has been installed.

It may be arranged so that the control section alerts a user that a process cartridge B has not been installed; a lamp may be flashed, or the like signaling method may be employed.

XII. Structure of Electrical Contact of Apparatus Main Assembly 14

Next, the connection between the electrical contacts on the process cartridge B side and the electrical contact members on the apparatus main assembly 14 side will be described.

Referring to FIG. 9, on one of the lateral surfaces of the cartridge space S in the image forming apparatus A, there are four contact members (ground contact member 123 which makes electrical contact with the ground contact 119; charge bias contact member 124 which makes electrical contact with the charge bias contact 120; development bias contact member 125 which makes electrical contact with the development bias contact 121; and toner amount detection contact member 126 which makes electrical contact with the toner amount detection contact 122).

As depicted in FIG. 9, the ground contact member 123 is located at the bottom of a cartridge positioning groove 16*b.* The development bias contact member 125, the toner amount detection contact member 126, and charge bias contact member 124 are located below the guide portion 16*a,* facing upward and being elastically supported.

At this time, the positional relationship between each contact and the correspondent guide will be described.

Referring to FIG. 6 which depicts the substantially horizontally positioned process cartridge B, the toner amount detection contact 122 is positioned bottommost, and the development bias contact 121 is at a level slightly above the toner amount detection contact 122. The charge bias contact 120 is at a level slightly above the development bias contact 121. At approximately the same levels slightly above the charge bias contact 120, a rotation controller guide 13*b*L and a cylindrical guide 13*a*L (ground contact 119) are positioned. In terms of the cartridge insertion direction (direction of the arrow mark X), the toner amount detection contact 122 is positioned most upstream, and the rotation controller guide 13*b*L and the development bias contact 121 are on the downstream side of the toner amount detection contact 122. The cylindrical guide 13*a*L (ground contact 119) is on the downstream side of the rotation controller guide 13*b*L and the development bias contact 121, and the charge bias contact 120 is on the downstream side of the cylindrical guide 13*a*L. With the above arrangement, the charge bias contact 120 and the development bias contact 121 can be placed adjacent to the charge roller 8 and the development roller 9*c,* respectively, and the toner amount detection contact 122 and the ground contact 119 can be placed adjacent to the rod antenna 9*h* and the photosensitive drum 7, respectively. Therefore, the distances among the contacts and also among the contact members are reduced, simplifying the electrical wiring, which must be intricately routed in the cases of a process cartridge B and an apparatus main assembly 14 which are not in accordance with the present invention.

The sizes of the contacts and the contact members are as follows. First, the size of the bias contact 120 is approximately 10.0 mm in both length and width. The development bias contact 121 is approximately 6.5 mm in length, and approximately 7.5 mm in width. The toner amount detection contact 122 is 2.0 mm in diameter, and approximately 18.0 mm in width. The ground contact 119 is circular, and its external diameter is approximately 10.0 mm. Obviously, the charge bias contact 120 and development bias contact 121 are rectangular. Regarding the sizes of the contacts and contact members, the word "length" means the measurements in the direction indicated by the arrow mark X, that is, the direction in which the process cartridge B is inserted into the apparatus main assembly 14, and "width" means the measurement in the horizontal direction perpendicular to the X direction.

The ground contact member 123 is considered of an electrically conductive plate spring. It is mounted adjacent to the groove 16*b,* in which the ground contact 119, that is, the cylindrical guide 13*a*L (which fixes the position of the drum shaft 7*a*), of the process cartridge B, is fitted (FIGS. 9, 11 and 30). It is grounded through the chassis of the apparatus main assembly 14. The toner amount detection contact member 126 is also constituted of an electrically conductive plate spring, and is located below, and adjacent to, the guide portion 16*a.* The other contact members 124 and 125 are placed in holders 127, respectively, located below, and adjacent to, the guide portion 16*a,* being forced to protrude upward from holders 127, by compression springs 129, respectively. At this time, the contact members will be described, using the charge bias contact member 124 as an example. Referring to FIG. 30 which provides a magnified view of the charge bias contact member 124, the charge bias contact member 124 is placed in the holder 127 which allows the charge bias contact member 124 to partially protrude from the holder 127. Then, the holder 127 is fixed to an electrical circuit plate 128 attached to the apparatus main assembly 14 so that the charge bias contact member 124 is partially projected upward by the compression springs 129, while being electrically connected to the corresponding wiring pattern by the compression spring 129.

Each of the contact members 123–126 protrudes from its holder because of the force from the compression spring, and remains protruding until it comes in contact with a predetermined portion of the cartridge space during the installation of the process cartridge B into the main assembly 14 of the image forming apparatus. In the initial stage of the cartridge installation, the contact members 123–126 of the apparatus main assembly 14 do not make contact with the corresponding contacts 119–122 of the process cartridge B, but as the process cartridge B is farther installed, they make contact with the corresponding contacts 119–122. Then, as the process cartridge B is farther inserted and the cylindrical guide 13*a*L on the process cartridge B fits into the positioning groove 16*b,* the contacts 119–122 depress the corresponding contact members 123–126 into the holders against the elastic force of the compression spring, increasing thereby the contact pressures between the contacts 119–122 and the corresponding contact members 123–126.

As is evident from the description given above, in this embodiment, it is assumed that each contact is desirably connected to the corresponding contact member as the process cartridge B is guided to a predetermined position in the cartridge space by the guide member 16.

Also as the process cartridge B reaches the predetermined position in the cartridge space, the ground contact member 123 constituted of a plate spring makes contact with the ground contact 119 which is the longitudinal end of the cylindrical guide 13*a*L (FIG. 11). Further, as the process cartridge B is installed in the main assembly 14 of the image forming apparatus, the ground contact 119 and the ground contact member 123 are electrically connected to ground the photosensitive drum 7; the charge bias contact 120 is electrically connected to the charge bias contact member 124 to apply high voltage (compound voltage composed of AC voltage and DC voltage) to the charge roller 8; the development bias contact 121 and the development bias contact member 125 are electrically connected to apply high voltage to the development roller 9*c;* and the toner amount detection contact 122 is electrically connected to the toner amount detection contact member 126 to transmit, to the apparatus main assembly 14, data reflecting the capacitance between the contact 122 and the development roller 9*c*.

In this embodiment, the contacts 119–122 are positioned on the bottom surface of the process cartridge S, and therefore, the state of the connections between the contacts 119–122 and the corresponding contact members 123–126 are not affected by the positional accuracy of the process cartridge B in terms of the direction perpendicular to the process cartridge B installation direction indicated by the arrow mark X.

Further, in this embodiment, all the contacts of the process cartridge B are located on one side of the cartridge frame, and therefore, the mechanical members of the process cartridge B can be located on the other side. Thus, the electrical and mechanical members of the apparatus main assembly 14 can also be located on one side of the cartridge space S and the other side, respectively, in the apparatus main assembly 14; in other words, all the mechanical members can be positioned on one side of the image forming apparatus, and all the electrical members can be positioned at the other side of the image forming apparatus. Therefore, the number of assembly steps can be reduced, and also, it becomes easier to check and/or maintain the image forming apparatus.

In the last stage of the installation of the process cartridge B into the main assembly 14 of the image forming apparatus, the lid 35 is closed, and as the lid 35 is closed, the coupler on the process cartridge B side becomes engaged with the coupler on the apparatus main assembly 14 side, readying the photosensitive drum 7 and the like to be driven by the force transmitted from the apparatus main assembly 14 as will he described later.

Also as described previously, all of the plurality of electrical contacts 119–122 are located on one side of the cartridge frame, and therefore, it is assured that the process cartridge B and the main assembly 14 of the image forming apparatus are desirably connected in terms of electrical connection.

Further, placing each of the contacts 119–122 in the manner described in this embodiment makes it unnecessary for the wiring to be intricately routed in the cartridge; the length of the wiring can be reduced.

XIII. Mechanical Structure for Transmitting Driving Force

Next, a coupling means, that is, the mechanical structure for transmitting the cartridge driving force from the main assembly 14 of the image forming apparatus to the process cartridge B, will be described.

FIG. 11 is a longitudinal section of the photosensitive drum 7 and the adjacencies thereof, in the process cartridge B which is in the cartridge space S. It depicts how the photosensitive drum 7 is mounted in the process cartridge B, and how the photosensitive drum 7 is coupled with the mechanism for driving the process cartridge B.

As depicted in FIG. 11, at one of the longitudinal ends of the photosensitive drum 7 mounted in the process cartridge B, the coupling means on the cartridge side is located. This coupling means comprises a drum flange 36 fixed to the aforementioned longitudinal end of the photosensitive drum 7, and a coupler shaft 37 (cylindrical) integral with the drum flange 36. The coupler shaft 37 has a projection 37*a* which projects from the end surface of the coupler shaft 37, and the end surface of the projection 37*a* is parallel to the end surface of the coupler shaft 37. The shaft 37 fits in a bearing 38, and functions as the rotational axis of the photosensitive drum 7. In this embodiment, the drum flange 36, the coupler shaft 37, and the projection 37*a* are integral. Further, the drum flange 36 integrally comprises a helical drum gear 7*b* for transmitting driving force to the development roller 9*c* within the process cartridge B. In other words, the drum flange 36 is a part of a molded single-piece component, which integrally comprises the drum gear 7*b,* the coupler shaft 37, and the projection 37*a,* in addition to the flange 36, and constitutes a component for transmitting the process cartridge driving force.

The projection 37*a* is in the form of a twisted polygonal prism. More specifically, it is in the form of a prism which has a substantially triangular cross section, and is slightly twisted in the rotational direction along the vertical axis. A hole 39*a* into which the projection 37*a* fits is also in the form of a polygonal prism which is substantially triangular in cross section perpendicular to its vertical axis, and is slightly twisted in the rotational direction along the vertical axis. The projection 37*a* and the hole 39*a* are substantially the same in terms of twist pitch, and also in terms of the twist direction. This hole 39*a* is in a coupler shaft 39*a* which is integral with a gear 43 on the apparatus main assembly 14 side. The coupler shaft 39*b* with the hole is rotatively supported in the apparatus main assembly 14, being allowed to freely shift in its axial direction. As the process cartridge B is installed into the apparatus main assembly 14, the projection 37*a* couples with the hole 39*a* on the apparatus main assembly 14 side. Then, rotational force is transmitted to the projection 37*a* from the coupler shaft 39*a* with the hole 39*b*. As the driving force is transmitted, the edges of the projection 37*a* in the form of a prism with a substantially triangular cross section come in contact with the internal surfaces of the hole 39*a,* and as a result, the axes of the projection 37*a* and the hole 39*a* align with each other. In order to facilitate this aligning action, the projection 37*a* and the hole 39*a* are formed so that the diameter of the circumcircle of the coupling projection 37*a* becomes larger than that of the inscribed circle of the coupling hole 39*a,* and is smaller than that of the circumcircle of the coupling hole 39*a*. Further, their twisted configurations generate such force that causes the coupler shaft 39*b* with the hole 39*a* to pull the projection 37*a* toward the coupler shaft 39*b;* in other words, both the coupling portion and the drum gear 7*b* are thrust in the direction indicated by an arrow mark d. Therefore, the end surface 37*a*1 of the projection 37*a* comes in contact with the bottom 39*a*1 of the hole 39*a*. Thus, the photosensitive drum 7 to which the projection 37*a* has been attached (indirectly) is accurately positioned in terms of its axial direction as well as radial direction, within the main assembly 14 of the image forming apparatus.

The direction in which the projection 37*a* is twisted as seen from its bottom side is opposite to the rotational direction of the photosensitive drum 7 as seen from the side of the photosensitive drum 7. The direction of the twist of the drum gear 7*b* of the drum flange 36 is opposite to the direction of the twist of the projection 37*a*.

The positional relationship between the coupler shaft 37 with the projection 37*a,* which is integral with the drum flange 36, and the drum flange 36 is such that after the drum flange 36 is attached to one of the longitudinal ends of the photosensitive drum 7, the axes of the coupler shaft 37 and the projection 37*a* align with the longitudinal axis of the photosensitive drum 7. An alphanumeric code 36*b* designates an integral part of the drum flange 36. This integral part of the photosensitive drum 7 constitutes the portion to be fitted into the cylindrical photosensitive drum 7 to attach the drum flange to the photosensitive drum 7. As for the methods for fixing the drum flange 36 to the photosensitive drum 7, crimping or gluing is used. The peripheral surface of the cylindrical drum, that is, the base member of the photosensitive drum 7, is covered with a layer 7*e* of photosensitive substance.

As described previously, to the other longitudinal end of photosensitive drum 7, a spur gear 7*n* is fixed.

As for the material for the drum flange 36 and the spur gear 7*n,* resin such as polyacetal, polycarbonate, polyamide, polybutyleneterephthalate, or the like, is used. However, materials other than those listed above may be used when necessary or appropriate.

The peripheral surface of the projection 37*a* of the coupler shaft 37*b* of the process cartridge B is surrounded by the cylindrical projection 38*a*(cylindrical guide 13*a*R), which is integral with the bearing 38 fixed to the cleaning frame 13 (FIG. 11), and is concentric with the coupler shaft 37. In other words, the projection 37*a* of the coupler shaft 37 is protected by this cylindrical projection 38*a;* it is prevented from being damaged (scratched, deformed, and/or the like) by external force when the process cartridge B is installed or removed, or in the like situations. Therefore, it is possible to prevent the rattling or vibration which is caused by the damaged projection 37*a*.

Further, the bearing 38 doubles as a guide member which guides the process cartridge B when the process cartridge B is inserted into, or removed from, the main assembly 14 of the image forming apparatus. In other words, when the process cartridge B is installed into the main assembly 14 of the image forming apparatus, the projection 38*a* of the bearing 38 comes in contact with the guide portion 16*c* of the main assembly side, and the projection 38*a* functions as the positioning guide 13*a*R, which guides the process cartridge B to the designated position, making it easier for the process cartridge B to be installed into, or removed from, the apparatus main assembly 14. After the process cartridge B is properly installed into the designated space, the projection 38*a* is supported by the groove 16*d* of the guide portion 16*c*.

The relationship among the photosensitive drum 7, the drum flange 36, and the coupler shaft 37 with the projection 37*a* is as depicted by FIG. 11. That is, the external diameter H of the photosensitive drum 7, the diameter E of the drum gear 7*b* at the base of the teeth, the internal diameter F of the bearing for the photosensitive drum 7 (external diameter of the coupler shaft 37, or the internal diameter of the bearing 38), the diameter M of the circumcircle of the projection 37*a* of the coupler shaft 37, and the internal diameter N of the base drum of the photosensitive drum 7, that is, the diameter of the hole of the photosensitive drum 7, into which the portion of the drum flange 36 is fitted, have the following relationship:

$$H>F\geqq M\&E>N.$$

Since H>F, the friction which occurs between the coupler shaft 37 and the bearing 38 is smaller than the friction which occurs when the base drum 7*d* is directly supported by a bearing, and therefore, the torque necessary to rotate the photosensitive drum 7 is smaller. Further, since F≧M, there is no undercut in terms of molding. Therefore, the mold for the flange portion, which is ordinarily split into two pieces in the directions indicated by an arrow mark P in FIG. 11, does not need to be split; the structure of the mold can be simplified.

Further, since E≧N, the shape of the mold for the flange portion becomes such that the mold section for the gear portion is located on the left side of the mold as seen from the side toward which the process cartridge B is inserted, and therefore, the right-hand side of the mold can be simplified to increase the durability of the mold.

Figure 25:
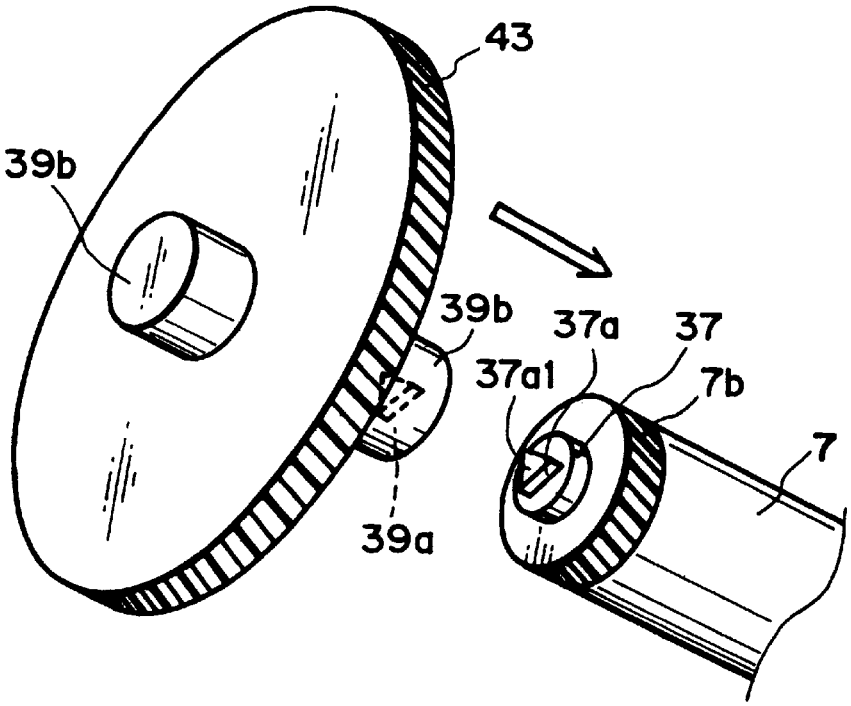
FIG. 25 is a perspective view which shows the coupler on the main assembly side of the image forming apparatus, and the coupler on the process cartridge side.
Figure 26:
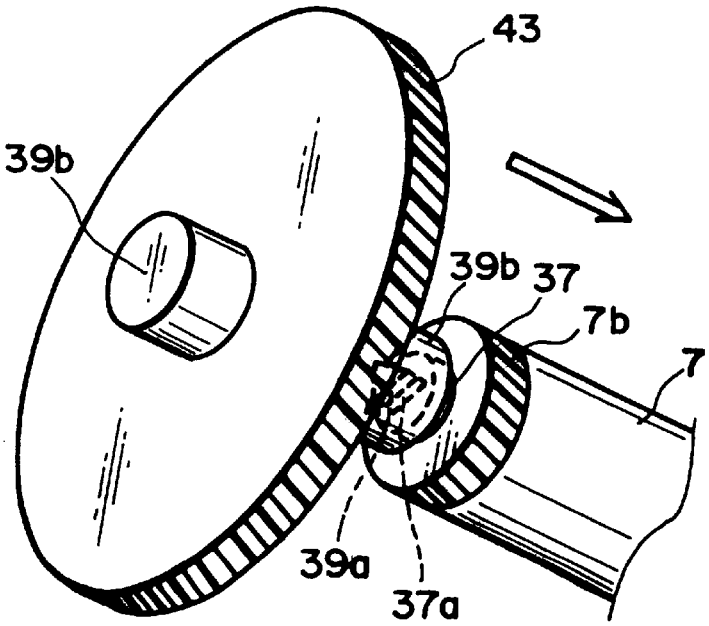
FIG. 26 is a perspective view which also shows the couplers on the main assembly side and the process cartridge side, respectively.

As for the main assembly 14 of the image forming apparatus, it is provided with a coupling means for the main assembly side. This coupling means on the main assembly side is constituted of a cylindrical coupler shaft 39*b* with the hole 39*a,* the rotational axis of which coincides with the rotational axis of the photosensitive drum 7 when the process cartridge B is in the main assembly 14 (FIGS. 11 and 25). As shown in FIG. 11, the coupler shaft 39*b* is integral with a large gear 43 which transmits the driving force of a motor 61 to the photosensitive drum 7; in other words, it is a driving shaft, and extends from the centers of the parallel surfaces of the large gear 43 (FIGS. 25 and 26). In this embodiment, the large gear 43 and the coupler shaft 39*b* are integrally molded.

The large gear 43 on the apparatus main assembly 14 side is a spur gear, and meshes with a small spur gear 62 which is fixed to the axis 61*a* of the motor 61 or is formed as an integral part of the axis 61*a*. Further, the large gear 43 has angled teeth, and each tooth is given a slight twist, so that, as the driving force is transmitted from the small gear 62, thrust is generated in the direction to shift the coupler shaft 39*b* toward the coupler shaft 37 with the projection 37*a*. Therefore, as the motor 61 is activated for image formation, the coupler shaft 39*b* is shifted toward the coupler shaft 37, and as a result, the hole 39*a* engages with the projection 37*a*. The hole 39*a* is on the end surface of the coupler shaft 39*b,* and the axis of the hole 39*b* coincides with the rotational axis of the coupler shaft 39*b*.

In this embodiment, the driving force is directly transmitted from the small gear 62 on the motor shaft 61*a* to the large gear 43. However, a gear train, a combination of belts and pulleys, a pair of friction rollers, a combination of a timing belt and pulleys, and the like may be used to transmit the driving force or to reduce the rotational speed.

Next, referring to FIGS. 24, 27, 28 and 29, the structure for causing the projection 37*a* to be engaged into the hole 39*b* by the closing movement of the lid 35 will be described.

Figure 29:
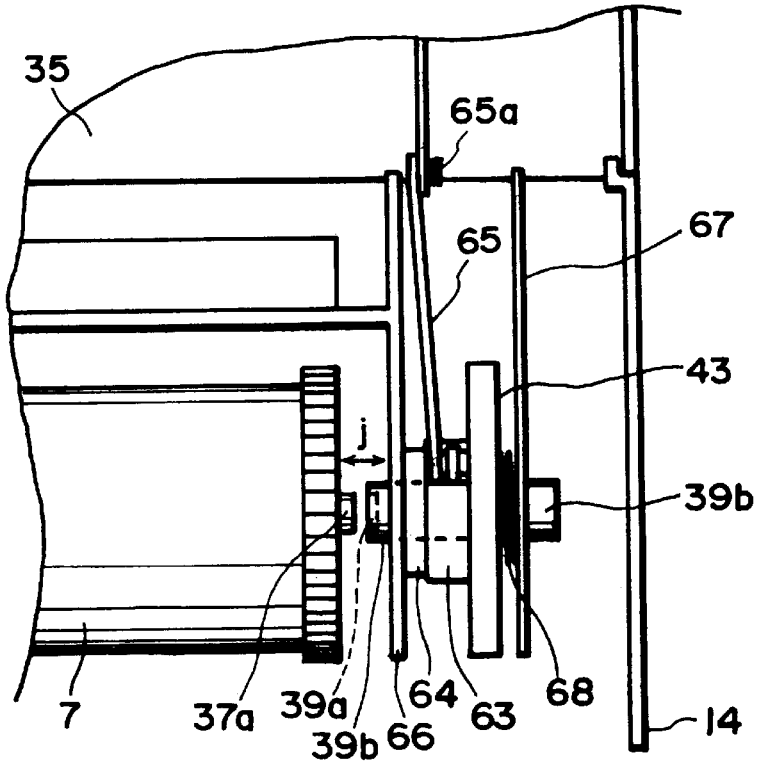
FIG. 29 is a plan view of the structure of the coupler shaft with the coupling hole, and the areas adjacent thereto, depicting a state in which the process cartridge is being installed into, or removed from, the main-assembly of the electrophotographic image forming apparatus.

Referring to FIG. 29, a side plate 67 is fixedly positioned so that the large gear 43 comes between the side plate 67 and the side plate 66 of the apparatus main assembly 14, and the coupler shaft 39*b* which is integrally formed with the large gear 43 and extends from the centers of the parallel surfaces of the large gear 43 is rotatively supported by these side plates 66 and 67. Between the large gear 43 and the side plate 66, an outer cam 63 and an inner cam 64 are disposed in contact with each other. The inner cam 64 is fixed to the side plate 66, and the outer cam 63 is rotatively fitted around the coupler shaft 39*b*. The inward side of the outer cam 63 in terms of the direction perpendicular to the rotational axis of the cam 63, and the outward side of the inner cam 64 in terms of the direction perpendicular to the axial direction of the cam 64, are threaded so that the former can be fitted around the latter. Further, between the large gear 43 and the side plate 67, a compression spring 68 is disposed in a compressed state, being fitted around the coupler shaft 39*b*.

Figure 27:
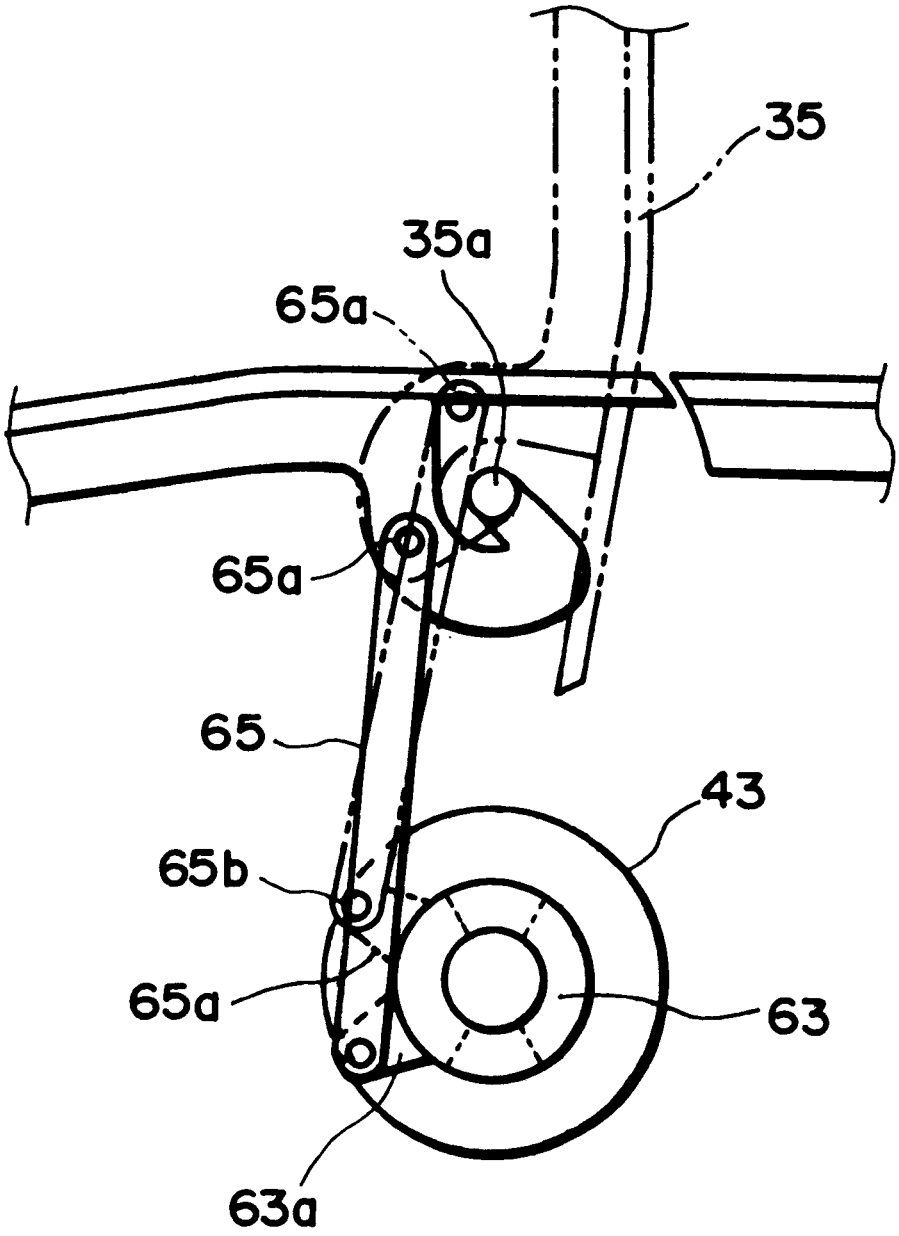
FIG. 27 is a schematic sectional drawing which depicts the structures of the member for opening or closing the main assembly of the electrophotographic image forming apparatus and the coupling means.

Referring to FIG. 27, an arm 63*a* is radially extended from the peripheral surface of the outer cam 63. The tip portion of the arm 63*a* is connected to one end of a linking member 65, with the use of a pin 65*b*. The other end of the linking member 65 is connected to the lid 35, with the use of a pin 65*a*. These pins 65*a* and 65*b* are positioned so that when the lid 35 is at the closed position, the pin 65*a* is on the left-hand side of the axis 35*a*, being diagonally below the supporting axis 35*a* of the lid 35, and the pin 65*b* is on the left-hand side of the coupler shaft 39*b*, being diagonally below the coupler shaft 39*b*.

Figure 28:
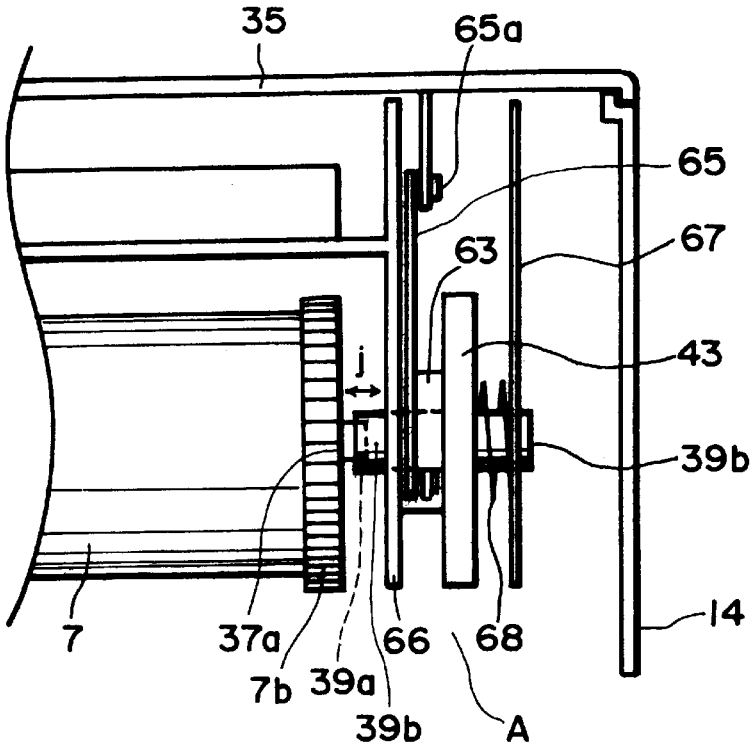
FIG. 28 is a plan view of the structure of the coupler shaft with a coupling hole, and the areas adjacent thereto, depicting a state in which the process cartridge is being driven by the main assembly of the electrophotographic image forming apparatus.

FIG. 28 depicts the portion depicted in FIG. 27, from the right-hand side of FIG. 27. When the lid 35 is closed, the linking member 65, and the outer cam 63, and the like are where they are in the drawing, and the coupling projection 37*a* and the coupling hole 39*a* are in the coupled state in which the driving force can be transmitted from the large gear 43 to the photosensitive drum 7. As the lid 35 is opened, the pin 65*a* is rotated about the supporting axis 35*a*, moving upward, and therefore, the arm 63*a* is pulled up by the linking member 65. Consequently, the outer cam 63 is rotated, or slides, around the inner cam 64, causing the large gear 43 to shift in the direction to move away from the photosensitive drum 7. As the large gear 43 is pushed by the outer cam 63, it shifts, pushing, and therefore, compressing, the compression spring 68 located between the side plate 67 and the large gear 43. As a result, the coupling projection 37*a* is moved away from the coupling hole 39*a* as depicted in FIG. 29, preparing the apparatus main assembly 14 for the removal or installation of the process cartridge B.

On the contrary, as the lid 35 is closed, the pin 65*a*, which connects the lid 35 and the linking member 65, is rotated about the supporting axis 35*a*, moving downward. Consequently, the linking member 65 moves downward, pushing the arm 63*a* downward. As a result, the outer cam 63 is reversely rotated, moving thereby toward the side plate 66. Then, the large gear 43, which is under the constant pressure from the spring 68, moves leftward to where it was, that is, whether it is in FIG. 28, and settles there, with the coupling projection 37*a* fitting in the coupling hole 39*a*, and therefore, being ready to transmit the driving force. With the provision of this structure, the main assembly 14 becomes ready for the process cartridge B to be installed into, or removed from, the main assembly 14, or becomes ready to drive the process cartridge B, in response to the opening or closing of the lid 35. It sometimes occurs that after the large gear 43 is shifted leftward in FIG. 29 by the reverse rotation of the outer cam 63 which is caused by the closing of the lid 35, the coupling projection 37*a* does not immediately engage with the coupling hole 39*b*, although the end surface of the coupler shaft 39*b* comes in contact with the end surface of the coupling shaft 37. Even in such cases, they immediately engage as soon as the image formation apparatus A is activated for image formation, as will be described later.

As described above, in this embodiment, when the process cartridge B is installed into, or removed from, the main assembly 14, the lid 35 is opened. As the lid 35 is opened or closed, the coupling shaft 39*b* with the hole 39*a* is horizontally moved (direction indicated by an arrow mark j) by the movement of the lid. Therefore, the coupling projection 37*a* of the process cartridge B and the coupling hole 39*a* do not engage while the process cartridge B is inserted into, or removed from, the main assembly 14, or do not remain engaged. Thus, the process cartridge B can be smoothly installed into, or removed from, the main assembly 14. Further, in this embodiment, the large gear 43 is under the pressure from the compression spring 68, and therefore, the coupler shaft 39*b* with the coupling hole 39*a* is under the same pressure, being pressed toward the process cartridge B. Thus, even if the coupling projection 37*a* collides with the edge of the coupling hole 39*a*, and fails to immediately engage with the coupling hole 39*a*, they instantly engage with each other as soon as the coupler shaft 39*b* with the coupling hole 39*a* is rotated by the motor 61 for the first time after the process cartridge B is installed into the main assembly 14.

XIV. Structure of End Seal between Photosensitive Drum 7 and Cleaning Blade

In this embodiment of the present invention, the process cartridge B comprises two main sections: a cleaning means frame 13 (cleaning means container) and a developing means frame 12. As described before, the cleaning means frame 13 holds a photosensitive drum 7, a charge roller 8 as charging means, a cleaning means 10 constituted of a cleaning blade 10*a* (cleaning member), and the like, whereas the developing means frame 12 holds a developing means 9 constituted of a development roller 9*c*, and the like. These two frames are connected to each other with the use of an axial member 22 (connecting member) in such a manner that they are allowed to rotate about the axial member relative to each other. Further, a spring 22*a* (compression spring) is placed between the cleaning means frame 13 and the developing means frame 12 so that the development roller 9*c* axially supported in the developing means frame 12 remains pressed upon the photosensitive drum 7; more specifically, a spacer ring 9*i* (gap maintaining member) with a diameter larger than that of the development roller 9*c* is attached to both longitudinal ends of the development roller 9*c*, one for one, and therefore, these spacer rings 9*i* are sandwiched between the electrophotographic photosensitive drum 7 and the development roller 9*c*, maintaining a predetermined gap between the two members.

While a toner image is transferred from the photosensitive drum 7 to a recording medium 2; while a recording medium 2 enters, holding a transferred toner image, into a fixing means 5; or in the like situation, toner particles sometimes go astray and float in the main assembly 14 of the image forming apparatus, although the amount of the stray toner particles is extremely small. Some of these floating toner particles land on, and adhere to, the photosensitive drum 7. Those which adhere to the photosensitive drum 7, on the surface area within the cleaning range of the cleaning blade 10*a*, are scraped away, along with the toner particles remaining on the surface of the photosensitive drum 7 after image transfer, by the cleaning blade 10*a*, and are collected into a waste toner bin 10*b*. But, those which adhere to the photosensitive drum 7, on the surface area outside the cleaning range of the cleaning blade 10*a,* remain on the surface of the photosensitive drum 7 until they are carried away by the stream of air flowing through the main assembly 14 of the image forming apparatus, which causes the following problem. That is, such areas of the peripheral surface of the photosensitive drum 7 that repeatedly come in contact with the spacer ring 9*i* as the photosensitive drum 7 and spacer ring 9*i* rotate, are outside the cleaning range of the cleaning blade 10*a*. In these areas, the toner particles having adhered to the photosensitive drum surface are compressed, becoming aggregated, by the photosensitive drum surface and the space ring surface as the toner particles enter between the two surfaces due to the force from the spring 22*a* which presses the development roller 9*c* upon the photosensitive drum 7. Some of these aggregated toner particles firmly adhere to the surface of the photosensitive drum 7, that is, the surface areas which come in contact with the spacer ring 9*i*. Further, to make the matter worse, the size of these aggregations gradually grows through the life of the process cartridge B, sometimes reaching a substantial size.

With the presence of such lumps of toner particles on the photosensitive drum 7, on the surface areas which come in contact with the spacer ring 9*i,* the gap between the photosensitive drum 7 and the development roller 9*c* varies, which interferes with the process in which the latent image on the photosensitive drum 7 is developed with toner. Further, when the development roller 9*c* rides over these lumps of toner particles, vibrations occur, which are liable to randomly induce irregularity in terms of pitch in the direction perpendicular to the recording medium 2 conveyance direction.

Figure 32:
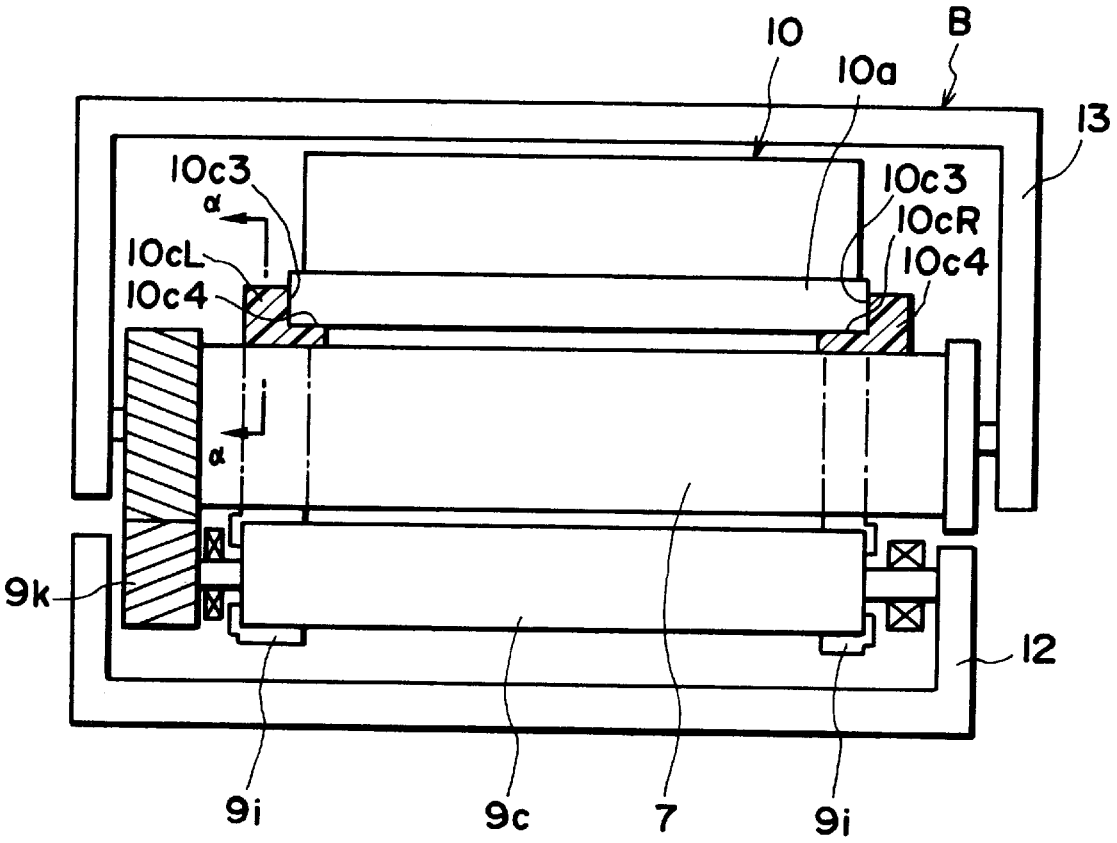
FIG. 32 is a schematic section of the process cartridge, depicting the sealing structure which seals between the longitudinal end portion of the photosensitive drum and the cleaning blade, at both longitudinal ends.
Figure 33:
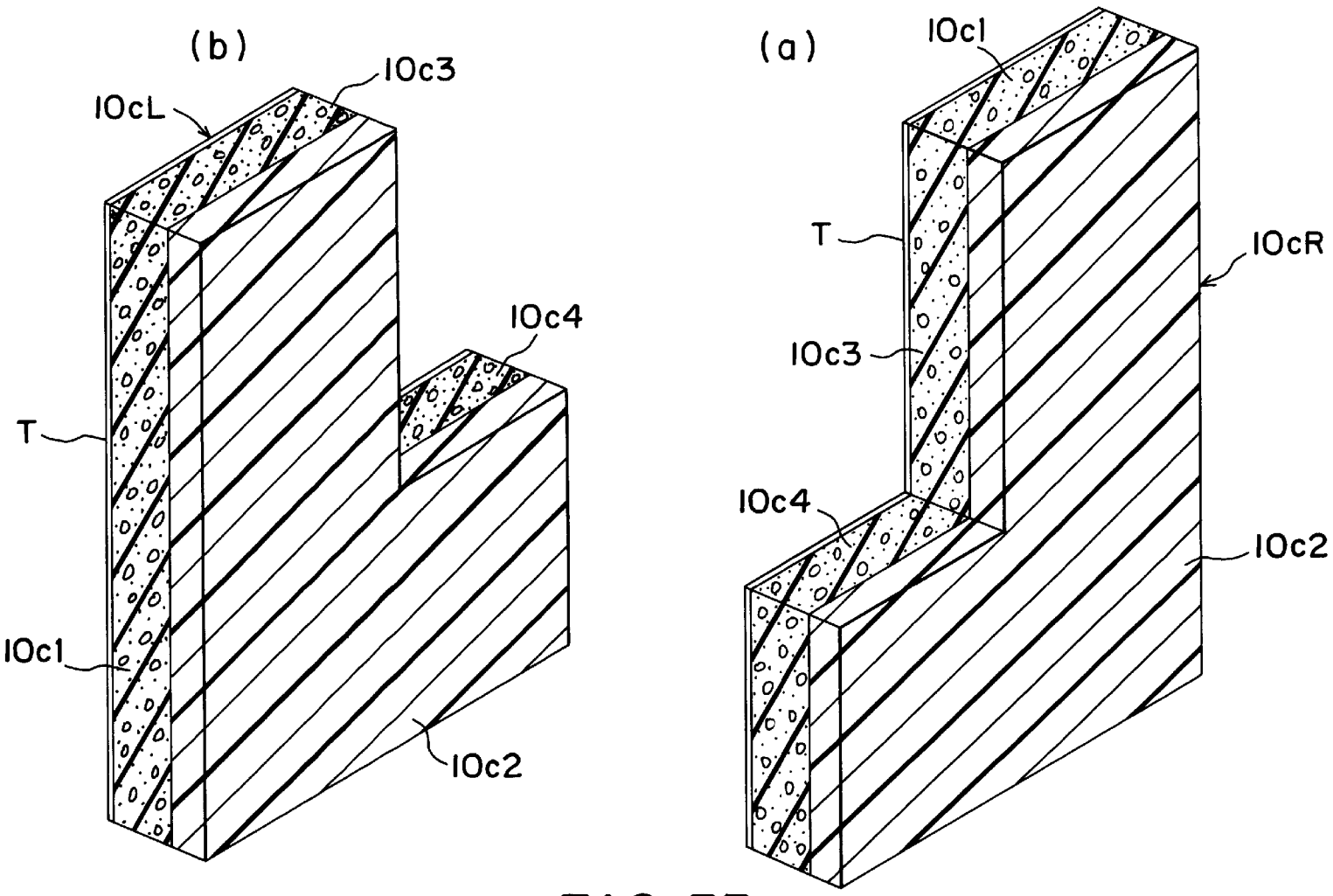
FIG. 33 is a perspective view of the sealing member, (a) and (b) depicting the sealing members to be disposed between the photosensitive drum and the cleaning blade on the right-hand and left-hand sides, respectively, of the process cartridge depicted in FIG. 32.
Figure 34:
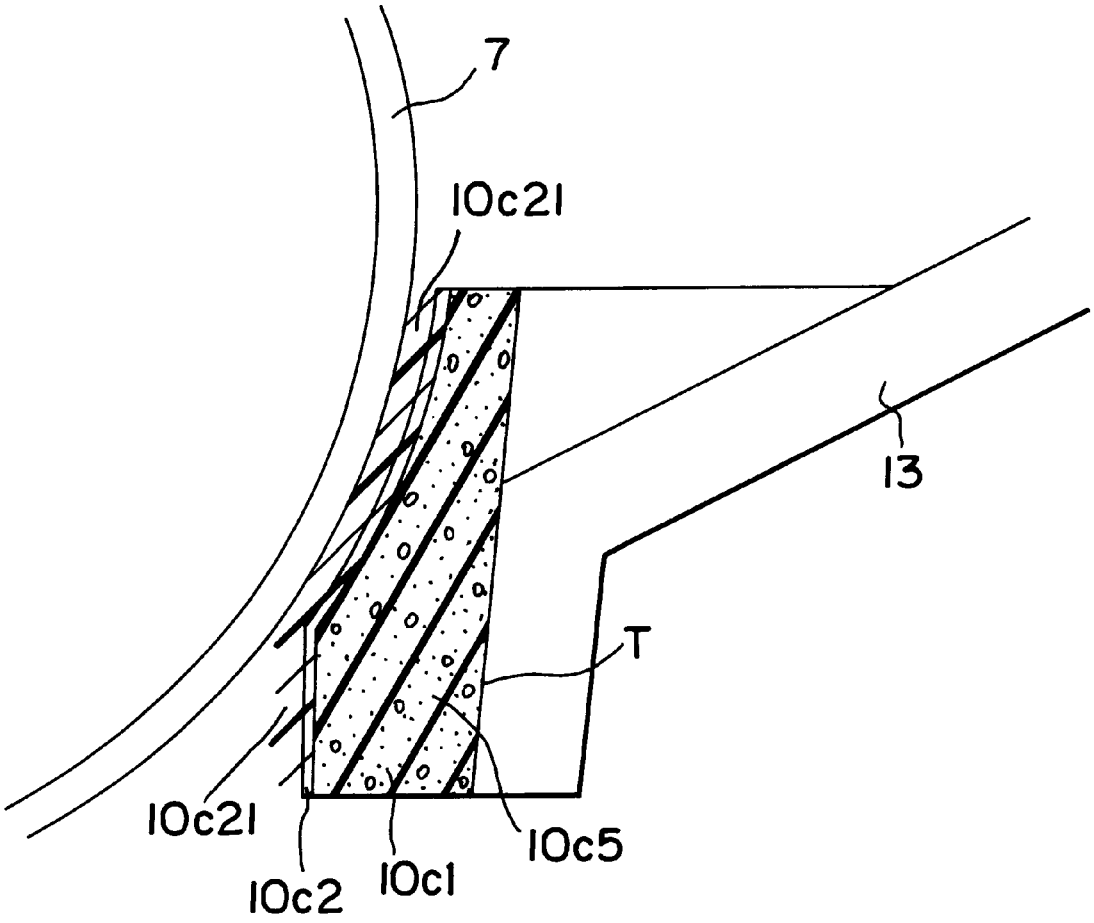
FIG. 34 is an enlarged section of the sealing member and the area adjacent thereto, at the line a—a in FIG. 32.

Thus, in this embodiment, single-piece sealing members 10*c*R and 10*c*L, which are depicted in FIGS. 32–34, are attached to the cleaning means frame 13 in such a manner that they contact the longitudinal ends of the photosensitive drum 7, one for one, at the right-hand and left-hand side, respectively, to prevent the toner particles removed from the photosensitive drum 7 by the cleaning blade 10*a* from leaking, and also to remove the toner particles adhering to the photosensitive drum 7, on the areas outside the cleaning range of cleaning blade 10*a*.

Referring to FIGS. 32 and 33, both of the sealing members 10*c*R and 10*c*L comprise two layers, a layer 10*c*1 of elastic foamed material formed of foamed polyurethane rubber such as MOLPLANE (registered trademark), and a layer 10*c*2 of pile such as velvet woven from polyethylene fluoride fiber such as TEFLON (registered trademark), which is laid upon the elastic foamed material layer 10*c*1. In other words, a piece of pile 10*c*2 is backed by a piece of elastic foamed material 10*c*1. The reason for using the piece of pile woven from polyethylene fluoride fiber as the material for the developer removing means is to reduce the friction as much as possible so that the force (rotational force) necessary for driving the photosensitive drum 7 can be minimized. Referring to FIGS. 33, (*a*) and (*b*), both sealing members 10*cR* and 10*cL* are approximately in the form of a letter "L", contacting the cleaning blade 10*a* by two surfaces: a first contact surface 10*c*3, that is, the upright surface, and a second contact surface 10*c*4, that is, the horizontal surface.

The right-hand sealing member 10*cR* and the left-hand sealing member 10*cL,* which are shaped as described above, are pasted to the cleaning means frame 13 by placing a piece of double-sided tape T (FIG. 34) between the elastic foamed material layer 10*c*1 and the cleaning means frame 13, being positioned in contact with the corresponding longitudinal ends of the cleaning blade 10*a* in such a manner that the first contact surface 10*c*3 contacts the vertical surface, and the second contact surface 10*c*4 contacts the horizontal surface which faces toward the photosensitive drum 7 (FIG. 32). Thus, as the process cartridge B is assembled, the elastic foamed material layer 10*c*1 is compressed between the cleaning means frame 13 and the photosensitive drum 7, and consequently, the resiliency (elastic force) from the compressed elastic foamed material layer 10*c*1 assures that the fiber tips 10*c*21 of the pile layer 10*c*2 make desirable contact with the photosensitive drum 7. Further, referring to FIG. 34, the sealing member is disposed so that the bottom portion 10*c*5 of the sealing member is not compressed between the cleaning means frame 13 and the photosensitive drum 7. Therefore, it is assured that the stray toner particles having adhered to the surface of the photosensitive drum 7 are caught by the pile layer 10*c*2; they do not fall into the internal space of the main assembly 14.

As described above, according to this embodiment of the present invention, the first-contact surface 10*c*3 of the seal member is in contact with the longitudinal end of the cleaning blade 10*a,* on the vertical surface, and the second contact surface 10*c*4 of the sealing member is in contact with the longitudinal end of the cleaning blade 10*a,* on the horizontal surface which faces toward the photosensitive drum 7. Therefore, the toner particles removed from the photosensitive drum 7 by the cleaning blade 10*a* while the photosensitive drum 7 is rotatively driven are prevented from leaking from around the longitudinal ends of the cleaning blade 10*a*. In addition, the stray toner particles having adhered to the photosensitive drum 7, on the areas outside the cleaning range of the cleaning blade 10*a,* are captured, that is, removed, by the fiber tips 10*c*21 of the pile layer 10*c*2 of the sealing member.

Thus, according to this embodiment, it does not occur that toner particles aggregate on the photosensitive drum 7, on the surface areas with which the spacer ring 9*i* makes contact, in the region outside the cleaning range of the cleaning blade 10*a*. Therefore, a predetermined gap is always maintained between the photosensitive drum 7 and the development roller 9*c,* making it possible to always form a desirable image on the recording medium 2.

Also according to this embodiment, the spacer ring 9*i* for maintaining a predetermined gap between the photosensitive drum 7 and the development roller 9*c* is at locations corresponding to the longitudinal ends of the cleaning blade 10*a* for scraping off the toner particles remaining on the photosensitive drum 7. The sealing member (end seal) placed tightly in contact with the longitudinal end of the cleaning blade 10*a* comprises two layers: the elastic foamed material layer 10*c*1 (elastic layer) formed of foamed polyurethane rubber, and the pile layer 10*c*2 constituted of a piece of velvet woven from polyethylene fluoride fiber. Therefore, it is possible to prevent toner particles from remaining adhered to the photosensitive drum 7, on the surface areas which come in contact with the spacer ring 9*i,* without increasing the component count. Further, giving the sealing member (end seal) a double layer structure comprising the elastic foamed material layer 10*c*1 (elastic layer) and the pile layer 10*c*2 increases the resiliency of the sealing member, improving the efficiency with which the sealing member is assembled into a process cartridge. Therefore, it is possible to reliably form a desirable image while minimizing the increase in the process cartridge B cost.

Further, since the sealing member in this embodiment is of a single-piece type, the spacer ring 9*i* can be placed at the location which corresponds to the longitudinal end of the. Therefore, the dimension of the process cartridge B in its longitudinal direction can be reduced, which contributes to the size reduction of an image forming apparatus.

The process cartridge B is a consumable product which is exchanged with a new one at the end of its life, and therefore, its cost must be minimized. In order to minimize the process cartridge B cost, effort must be constantly made to reduce its component count or to improve its assembly efficiency. However, the application of this embodiment eliminates the need for placing two sealing members, one at the longitudinal end of the cleaning blade 10*a* and another (conventional wiping member) at the location correspondent to the surface areas of the photosensitive drum 7, which come in contact with the spacer ring 9*i*. Therefore, the component count can be reduced, which leads to improvement in assembly efficiency.

As described above, the sealing member in this embodiment comprises the following: an elastic layer 10*c*1 formed of foamed material and a layer 10*c*2 of pile. The elastic foamed material layer 10*c*1 is placed in contact with the longitudinal end of the cleaning blade 10*a* placed in contact with the electrophotographic photosensitive drum 7 to remove the toner, to prevent the toner from leaking from the cleaning means frame 13. The pile layer 10*c*2 is placed in contact with the electrophotographic photosensitive drum 7, on the areas corresponding to the spacer ring 9*i* for maintaining a predetermined gap between the development roller 9*c* for supplying the electrophotographic photosensitive drum 7 with toner, and the electrophotographic photosensitive drum 7, to remove the toner having adhered to the electrophotographic photosensitive drum 7.

The cleaning apparatus in this embodiment comprises: a cleaning blade 10*a* placed in contact with the electrophotographic photosensitive drum 7 to remove toner; a cleaning means frame 13 which stores the toner removed by the cleaning blade 10*a;* sealing members which are placed in the cleaning means frame 13 and comprise an elastic foamed material layer 10*c*1 placed in contact with the longitudinal end of the cleaning blade 10*a* to prevent toner from leaking from the cleaning means frame 13, and a pile layer 10*c*2 placed in contact with the electrophotographic photosensitive drum 7, on the area corresponding to the spacer ring 9*i* for maintaining a predetermined gap between the development roller 9*c* for supplying the electrophotographic photosensitive drum 7 with toner, and the electrophotographic photosensitive drum 7, to remove the toner having adhered to the electrophotographic photosensitive drum 7.

The process cartridge in this embodiment comprises: the electrophotographic photosensitive drum 7; the development roller 9*c* for supplying the electrophotographic photosensitive drum 7 with toner; the spacer rings 9*i* for maintaining a predetermined gap between the electrophotographic photosensitive drum 7 and the development roller 9*c;* the cleaning blade 10*a* placed in contact with the electrophotographic photosensitive drum 7 to remove toner; the cleaning means frame 13 which stores the toner removed by the cleaning blade 10*a;* and the sealing members which are placed in the cleaning means frame 13 and comprise the elastic foamed layers 10*c*1 placed in contact with the longitudinal end of the cleaning blade 10*a* to prevent toner from leaking from the cleaning means frame 13, and the pile layer 10*c*2 placed in contact with the electrophotographic photosensitive drum 7, on the area corresponding to the spacer ring 9*i,* to remove the toner having adhered to the electrophotographic photosensitive drum 7.

The electrophotographic image forming apparatus in this embodiment comprises the guide portions 16*a* and the guide portions 16*c* for removably installing the process cartridge B into the main assembly 14, and the conveying means 3 for conveying the recording medium 2. The process cartridge B comprises: the electrophotographic photosensitive drum 7; the development roller 9*c* for supplying the electrophotographic photosensitive drum 7 with toner; the spacer rings 9*i* for maintaining a predetermined gap between the electrophotographic photosensitive drum 7 and the development roller 9*c;* the cleaning blade 10*a* placed in contact with the electrophotographic photosensitive drum 7 to remove toner; the cleaning means frame 13 which stores the toner removed by the cleaning blade 10*a;* and the sealing members which are placed in the cleaning means frame 13 and comprise the elastic foamed layers 10*c*1 placed in contact with the longitudinal end of the cleaning blade 10*a* to prevent toner from leaking from the cleaning means frame 13, and the pile layer 10*c*2 placed in contact with the electrophotographic photosensitive drum 7, on the area corresponding to the spacer ring 9*i* to remove the toner having adhered to the electrophotographic photosensitive drum 7.

XV. Miscellaneous

In the preceding embodiments, the present invention was described with reference to the process cartridge B which was a process cartridge for forming monochromatic images. However, the present invention is also applicable to process cartridges which comprise a plurality of developing means and are capable of forming multicolor images (two color images, three color images, full-color images, or the like).

The type of the electrophotographic photosensitive member to which the present invention is applicable is not limited to the one described in the preceding embodiments. More specifically, the photoconductor employed as the photosensitive material may be any of the following: amorphous silicon, amorphous selenium, zinc oxide, titanium oxide, organic photoconductor, and the like. The configuration of the base member which carries the photosensitive material does not need to be in the form of a drum; it may be in the form of a belt. In the case of a drum type, photoconductive material may be simply painted, or may be applied by vapor deposition, on a cylinder form of aluminum alloy or the like.

As for the developing method, it is possible to use any of the various known developing methods: for example, the two component magnetic brush method, the cascade method, the touch-down method, the cloud method, and the like.

The charging method in the preceding embodiments was the so-called contact type charging method. But, obviously, other methods may be employed; for example, one of the conventional methods, in which a piece of tungsten wire is surrounded on three sides by a metallic shield of aluminum or the like, and the surface of a photosensitive drum is uniformly charged by transferring the positive or negative ions generated by applying high voltage to the tungsten wire, onto the surface of the photosensitive member.

As for the configuration of the charging means, it may be in the form of a roller, a blade (charging blade), a pad, a block, a rod, a wire, or the like.

As for the method for cleaning the toner remaining on a photosensitive drum, cleaning means may comprise any of the following: a blade, a fur brush, a magnetic brush, and the like.

The method for sealing toner may be a method other than the one described in the preceding embodiments, that is, the method which uses a combination of the cover film 51 and the tear tape 52. For example, there is an easy peal sealing method in which a single sheet is folded back to be used in the same manner as the one used in the aforementioned method. Obviously, the present invention is applicable to process cartridges in which toner is sealed using a toner sealing method other than the one described above.

According to the above-described embodiments of the present invention, it is possible to provide a sealing member, a cleaning apparatus, and a process cartridge, which are capable of reliably preventing developer from leaking, and also capable of removing the developer having adhered to an electrophotographic photosensitive drum, and also it is possible to provide an electrophotographic image forming apparatus in which such a process cartridge can be removably installed.

Further, according to the preceding embodiments, it is possible to provide a single-piece sealing member, a cleaning apparatus, and a process cartridge, which are capable of preventing the developer removed from an electrophotographic photosensitive member with the use of a cleaning member from leaking, and also capable of removing the developer having adhered to the electrophotographic photosensitive member, on the areas outside the cleaning range of the cleaning member, and also it is possible to provide an electrophotographic image forming apparatus in which such a process cartridge can be removably installed.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable relative to a main assembly of an image forming apparatus, said process cartridge comprising:

an image bearing member;

a developing roller for developing an electrostatic image formed on said image bearing member with a developer;

a spacer provided at a longitudinal end of said developing roller and contacting said image bearing member to provide a predetermined gap between said developing roller and said image bearing member;

a cleaning member, contacting said image bearing member, for removing the developer from said image bearing member, wherein a longitudinal end of said cleaning member is provided in a region, in a longitudinal direction, in which said spacer contacts said image bearing member;

a seal member, for preventing leakage of the developer, contacting the longitudinal end of said cleaning member; and a fibrous member, provided on an image-bearing-member contacting side of said seal member, for removing the developer from said image bearing member, said fibrous member extending from inside portion to an outside portion of the longitudinal end of said cleaning member.

2. A process cartridge according to claim 1, wherein said region is within a region in which said fibrous member contacts said image bearing member, in a longitudinal direction of said cleaning member.

3. A process cartridge according to claim 1, wherein said seal member is provided with a seal portion contacting a free end of said cleaning member adjacent to the longitudinal end of said cleaning member.

4. A process cartridge according to claim 1, wherein said seal member is provided with an elastic layer at a back side of said fibrous member.

5. A process cartridge according to claim 4, wherein said elastic layer is made of foam material.

6. A process cartridge according to claim 1, wherein said fibrous member is made of pile fabric.

7. A process cartridge according to claim 1, wherein said image bearing member is photosensitive.

8. A process cartridge according to claim 1, wherein said image bearing member is in the form of a drum.

9. An image forming apparatus comprising:

an image bearing member;

image forming means for forming an image on said image bearing member, said image forming means including a developing roller for developing an electrostatic image formed on said image bearing member with a developer;

a spacer provided at a longitudinal end of said developing roller and contacting said image bearing member to provide a predetermined gap between said developing roller and said image bearing member;

a cleaning member, contacting said image bearing member, for removing the developer from said image bearing member, wherein a longitudinal end of said cleaning member is provided in a region, in a longitudinal direction, in which said spacer contacts said image bearing member;

a seal member, for preventing leakage of the developer, contacting the longitudinal end of said cleaning member, and a fibrous member, provided on an image-bearing-member contacting side of said seal member, for removing the developer from said image bearing member, said fibrous member extending from an inside portion to an outside portion of the longitudinal end of said cleaning member.

10. An apparatus according to claim 9, wherein said contact region is within a region in which said fibrous member contacts said image bearing member, in a longitudinal direction of said cleaning member.

11. An apparatus according to claim 9, wherein said seal member is provided with a seal portion contacting a free end of said cleaning member adjacent to the longitudinal end of said cleaning member.

12. An apparatus according to claim 9, wherein said seal member is provided with an elastic layer at a back side of said fibrous member.

13. An apparatus according to claim 12, wherein said elastic layer is made of foam material.

14. An apparatus according to claim 9, wherein said fibrous member is made of pile fabric.

15. An apparatus according to claim 9, wherein said image bearing member is photosensitive.

16. An apparatus according to claim 9, wherein said image bearing member is in the form of a drum.

* * * * *

UNITED STATES PATENT AND TRADEMARK OFFICE

CERTIFICATE OF CORRECTION

PATENT NO. : 6,115,565

DATED : September 5, 2000

INVENTOR(S): SHINYA NODA

It is certified that error appears in the above-identified patent and that said Letters Patent is hereby corrected as shown below:

COLUMN 1:
Line 29, "electrophotogaphic" should read --electrophotographic--.

COLUMN 3:
Line 54, "main-assembly" should read --main assembly--.

COLUMN 6:
Line 39, "9e," should read --9c,--.
Line 63, "tho" should read --the--.
Line 65, "is" should be deleted.

COLUMN 7:
Line 8, "tho" should read --the--.
Line 16, "2" should read --B.--.
Line 29, "9e," should read --9c,--.
Line 41, "assembly 16," should read --assembly 18,--.
Line 43, "extend" should read --extended--.

COLUMN 8:
Line 15, "an the" should read --on the--.
Line 16, "mains" should read --main--.
Line 48, "joined." should read --joined--.

UNITED STATES PATENT AND TRADEMARK OFFICE

CERTIFICATE OF CORRECTION

PATENT NO. : 6,115,565

DATED : September 5, 2000

INVENTOR(S): SHINYA NODA

It is certified that error appears in the above-identified patent and that said Letters Patent is hereby corrected as shown below:

COLUMN 10:
Line 29, "separate two" should read --two separate--.

COLUMN 12:
Line 22, "2" should read --B--.
Line 52, "mashes" should read --meshes--.
Line 55, "t he" should read --the--.

COLUMN 13:
Line 4, "via" should read --11a--.
Line 20, "surface U." should read --surface U,--.
Line 29, "the" should be deleted.

COLUMN 14:
Line 51, "is" should be deleted.

COLUMN 15:
Line 59, "width" should read --width of--.

COLUMN 21:
Line 27, "insert" should read --inserted--.
Line 46, "lie" should read --11e--.

UNITED STATES PATENT AND TRADEMARK OFFICE

CERTIFICATE OF CORRECTION

PATENT NO. : 6,115,565

DATED : September 5, 2000

INVENTOR(S): SHINYA NODA

It is certified that error appears in the above-identified patent and that said Letters Patent is hereby corrected as shown below:

COLUMN 22:
Line 7, "gk" should read --9k--.

COLUMN 27:
Line 54, "cartridge S," should read --cartridge B,--.

COLUMN 33:
Line 42, "MOLPLANE" should read --MOLTPLANE--.

COLUMN 34:
Line 58, "end of the." should read --end.--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*